US008998004B2

(12) United States Patent
Watabe et al.

(10) Patent No.: US 8,998,004 B2
(45) Date of Patent: Apr. 7, 2015

(54) CONVEYANCE RACK, METHOD FOR RETAINING METAL RING, AND METHOD FOR HEAT TREATMENT OF METAL RING

(75) Inventors: Yoshiharu Watabe, Iruma (JP); Masaomi Saruyama, Utsunomiya (JP); Kensuke Shiota, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 526 days.

(21) Appl. No.: 13/390,745

(22) PCT Filed: Sep. 2, 2010

(86) PCT No.: PCT/JP2010/065024

§ 371 (c)(1),
(2), (4) Date: Feb. 16, 2012

(87) PCT Pub. No.: WO2011/027823

PCT Pub. Date: Mar. 10, 2011

(65) Prior Publication Data

US 2012/0148968 A1 Jun. 14, 2012

(30) Foreign Application Priority Data

| | | |
|---|---|---|
| Sep. 2, 2009 | (JP) | 2009-202998 |
| Sep. 2, 2009 | (JP) | 2009-203004 |
| Sep. 2, 2009 | (JP) | 2009-203008 |
| Mar. 31, 2010 | (JP) | 2010-082969 |
| Apr. 30, 2010 | (JP) | 2010-104881 |

(51) Int. Cl.

| | |
|---|---|
| ***C21D 9/40*** | (2006.01) |
| ***C21D 9/00*** | (2006.01) |
| ***F27D 3/12*** | (2006.01) |
| ***F27D 5/00*** | (2006.01) |

(52) U.S. Cl.

CPC ..... *C21D 9/0025* (2013.01); *C21D 9/40* (2013.01); *F27D 3/12* (2013.01); *F27D 5/00* (2013.01)

(58) Field of Classification Search

CPC ..... C21D 9/0025; C21D 9/40; F27D 3/12; F27D 5/00

USPC ..... 211/41.18, 49.1; 206/454, 711; 118/500, 728; 432/258

See application file for complete search history.

(56) References Cited

U.S. PATENT DOCUMENTS

| | | | | | |
|---|---|---|---|---|---|
| 1,860,374 | A | * | 5/1932 | Vincent | 432/259 |
| 4,184,841 | A | * | 1/1980 | Robinson et al. | 432/258 |
| 4,504,224 | A | * | 3/1985 | Hewitt | 432/258 |
| 4,636,170 | A | * | 1/1987 | Stupka | 432/258 |

(Continued)

FOREIGN PATENT DOCUMENTS

| | | |
|---|---|---|
| EP | 1 801 245 A1 | 6/2007 |
| JP | 10-251741 A | 9/1998 |

(Continued)

*Primary Examiner* — Joshua Rodden

(74) *Attorney, Agent, or Firm* — Carrier Blackman & Associates, P.C.; Joseph P. Carrier; Anne G. Sabourin

(57) ABSTRACT

Disclosed are a conveyance rack for retaining and conveying resilience-memory metal rings and a method for retaining the metal rings. The conveyance rack is provided with a base and a plurality of retaining shafts which extend parallel to each other, being erected on the base, and which are provided with, on the side walls thereof, a plurality of protrusions abutting on the lower end surfaces of the metal rings. The protrusions abut on the lower end surfaces of the metal rings by point contact.

8 Claims, 41 Drawing Sheets

(56) References Cited

U.S. PATENT DOCUMENTS

| | | | | |
|---|---|---|---|---|
| 4,872,554 | A * | 10/1989 | Quernemoen | 206/454 |
| 5,858,103 | A * | 1/1999 | Nakajima et al. | 118/728 |
| 6,062,853 | A * | 5/2000 | Shimazu et al. | 432/258 |
| 6,092,981 | A * | 7/2000 | Pfeiffer et al. | 414/810 |
| 6,450,346 | B1 * | 9/2002 | Boyle et al. | 211/41.18 |
| 6,532,642 | B1 * | 3/2003 | Wingo | 29/558 |
| 6,811,040 | B2 * | 11/2004 | Payne et al. | 211/41.18 |
| 7,501,370 | B2 * | 3/2009 | Narendar et al. | 501/88 |
| 7,508,482 | B2 * | 3/2009 | Son et al. | 349/187 |
| 7,694,690 | B2 * | 4/2010 | Yen | 134/134 |
| 7,736,436 | B2 * | 6/2010 | Cadwell et al. | 117/200 |
| 2004/0069732 | A1 * | 4/2004 | Huang et al. | 211/183 |
| 2005/0145584 | A1 * | 7/2005 | Buckley et al. | 211/41.18 |
| 2010/0015817 | A1 * | 1/2010 | Kobayashi | 438/795 |
| 2012/0000868 | A1 * | 1/2012 | Watabe | 211/59.2 |

FOREIGN PATENT DOCUMENTS

| | | | |
|---|---|---|---|
| JP | 2002-161314 | A | 6/2002 |
| JP | 2007-191788 | A | 8/2007 |
| JP | 2010-002165 | A | 1/2010 |

* cited by examiner (REARWARD END POSITION)

CONVEYANCE RACK, METHOD FOR RETAINING METAL RING, AND METHOD FOR HEAT TREATMENT OF METAL RING

TECHNICAL FIELD

The present invention relates to a conveyance rack for conveying metal rings that are used preferably as a continuously variable transmission (CVT) belt, as well as to a method for retaining metal rings and a method for heat treatment of metal rings, by use of such a conveyance rack.

BACKGROUND ART

In a CVT, a belt which is made up from stacked rings, in which plural metal rings are stacked, serves as a power transmission. In general, the metal rings are fabricated by implementing a predetermined heat treatment such as a solution heat treatment, an aging treatment, a nitriding treatment or the like, with respect to pre-form bodies, which are formed by cutting a cylindrical drum made from maraging steel into predetermined widths.

In order to carry out such a heat treatment, generally, a plurality of such metal rings is retained on a conveyance rack and the multiple rings are conveyed simultaneously into a heat treatment furnace. In this condition, heat treatment is carried out together with the conveyance rack. As a conveyance rack of this type, for example, there is known the conveyance rack disclosed in Japanese Laid-Open Patent Publication No. 2007-191788.

The conveyance rack disclosed in Japanese Laid-Open Patent Publication No. 2007-191788 includes a plurality of retaining shafts, which are erected on a base, wherein a plurality of ring seats, formed in the shape of abacus beads, are attached to each of the retaining shafts. In such a structure, each of the metal rings is interposed between each of adjacent ring seats, as shown in FIG. 4 of Japanese Laid-Open Patent Publication No. 2007-191788.

On the other hand, as disclosed in Japanese Laid-Open Patent Publication No. 10-251741, a plurality of piece members are disposed respectively on a plurality of retaining shafts, and intermediate base boards to be processed into aluminum base boards for magnetic disks are gripped between each of the adjacent piece members.

In this manner, retention of workpieces having annular or disk shapes as a result of being gripped between respective piece members, which are provided on a plurality of retaining shafts, is performed in various technical fields.

SUMMARY OF INVENTION

Abacus bead shaped pieces may be approximated locally by triangular columnar shaped protrusions 1, as shown in FIG. 39. Further, reference numeral 2 in FIG. 39 indicates a retaining shaft, which is mounted on a non-illustrated base. In FIG. 39, the retaining shaft 2 is a substantially rectangular parallelepiped shaped member, whereas the protrusions 1 are disposed on a short side surface of the retaining shaft 2, separated from each other by predetermined intervals along the axial direction of the retaining shaft 2.

A condition in which a metal ring 3 is retained with respect to the protrusions 1 is shown in FIGS. 40 and 41. FIG. 40 is a front view as seen from the center of the metal ring 3, whereas FIG. 41 is a side view along the axial direction of the protrusions 1. As shown in FIGS. 40 and 41, the metal ring 3 is gripped between mutually adjacent protrusions 1, 1.

Apexes of the protrusions 1 are directed toward the center of the metal ring 3, and therefore, a lower end surface of the metal ring 3 is positioned on an upper side inclined surface on a lower protrusion 1, whereas an upper end surface of the metal ring 3 abuts against a lower side inclined surface on the upper protrusion 1 (see FIG. 41). Both of the lower end surface and the upper end surface of the metal ring 3 are arranged in a state of line contact with respect to the inclined surfaces of the protrusions (refer especially to FIG. 40).

From such a condition, when metal rings 3 together with the conveyance rack are raised in temperature to carry out heat treatment thereon, due to a difference in the coefficient of thermal expansion between the protrusions 1, 1 and the metal rings 3, the metal rings 3, which are in line contact with respect to respective inclined surfaces of the protrusions 1, 1, are blocked by the inclined surfaces (see FIG. 41). Owing thereto, there is a concern that thermal expansion of the metal rings 3 will be restrained. Such a situation is believed to be a cause of warping or strain on the metal rings 3.

Further, even in the case that thermal expansion is not restrained, the metal rings 3 and the protrusions 1, 1 are kept in a condition of line contact. More specifically, the location of contact between the metal rings 3 and the protrusions 1, 1 is comparatively large in area. Due to the large area contact region between the metal rings 3 and the protrusions 1, 1, for example, when a nitriding treatment is carried out, heat of the metal rings 3 is usurped by the protrusions 1, 1. As a result, the rise in temperature of the metal rings 3 is insufficient, leading to a concern that the nitriding treatment cannot progress adequately.

Moreover, for example, when the nitriding treatment is implemented, nitriding gas does not come into contact with the location of contact between the metal rings 3 and the protrusions 1, 1, which is large in area. Consequently, there is a fear that irregularities may occur in the degree of nitriding.

A general object of the present invention is to provide a conveyance rack in which concerns over warping or strain in the metal rings can be dispensed with.

A principal object of the present invention is to provide a conveyance rack in which usurpation of heat from the metal rings can be avoided.

Another object of the present invention is to provide a conveyance rack that enables the occurrence of irregularities in the degree of heat treatment to be avoided.

A further object of the present invention is to provide a method for retaining metal rings using the aforementioned conveyance rack.

A still further object of the present invention is to provide a method for heat-treating metal rings using the aforementioned conveyance rack.

According to the present invention, there is provided a conveyance rack for retaining and conveying a plurality of metal rings that exhibit an elastic restorative force, comprising:

a base; and a plurality of retaining shafts erected on the base and which extend parallel to each other, the retaining shafts being provided on side walls thereof with a plurality of protrusions, which abut on lower end surfaces of the metal rings, wherein the protrusions abut by point contact with respect to the lower end surfaces of the metal rings.

In the present invention, the metal rings are retained on the retaining shafts in a state of abutment by point contact with respect to the protrusions. Due to such point contact, the area of contact between the protrusions and the metal rings is extremely small. Therefore, the constraining force of the protrusions with respect to the metal rings also is small.

Accordingly, in the case that a heat treatment is implemented with respect to the metal rings, the metal rings are capable of undergoing thermal expansion to approach the sides of the retaining shafts without being stopped by the protrusions. Stated otherwise, suppression of thermal expansion of the metal rings can be avoided, and thus, concerns over the occurrence of strain on the metal rings can be dispensed with.

Further, because the area of contact between the protrusions and the metal rings is extremely small, heat transfer between the protrusions and the metal rings is kept to a minimum, and various types of gases, such as nitriding gases or the like, can easily wrap around the metal rings. Owing thereto, the temperature of the metal rings is substantially equivalent around the entirety thereof, and the various gases come into contact with substantially the entirety of the metal rings. Coupled with the foregoing features, the heat treatment can be implemented substantially equally over the entirety of the metal rings. Specifically, for example, a nitriding treatment can be implemented evenly without irregularities.

Regions of the protrusions, for example, which are in contact with the metal rings, may comprise tapered reduced diameter portions, which are reduced in diameter in tapered shapes approaching toward the metal rings. Preferred examples of such protrusions may comprise cone shapes or truncated cone shapes.

Further, the protrusions may comprise triangular columnar shaped bodies including inclined surfaces that are inclined vertically downward approaching the metal rings. In this case, the inclined surfaces abut against lower end surfaces of the metal rings. Further, in order that the lower end surfaces of the metal rings are in point contact with respect to the inclined surfaces, apex portions of the protrusions may face toward directions away from the centers of the metal rings.

The protrusions may be formed as cylindrical shaped bodies. In this case, diameters of the cylindrical shaped bodies may be set at a dimension to make point contact with respect to the metal rings.

In the above-noted structure, additionally, blocking projections may be provided on side walls of the retaining shafts, the blocking projections being interposed between each of respective adjacent protrusions and abut against side walls of the metal rings. In this case, the blocking projections press the metal rings in a radial inward direction. More specifically, in a condition of exhibiting an expansive force, the metal rings are pressed against the blocking projections and are retained in this state.

Owing thereto, the aforementioned protrusions, without serving a primary role of retaining the metal rings, can serve an auxiliary roll to prevent the metal rings from dropping out. Accordingly, since the area of contact between the metal rings and the protrusions can be kept as small as possible, the above advantages can more easily be achieved.

One conveyance rack may retain the metal rings in two or more vertically arranged columns. In this case, the plural retaining shafts should be arranged so as to be capable of retaining the metal rings in a condition of being arranged in two or more vertically arranged columns.

Further, the conveyance rack may further comprise a connecting plate disposed at a position separated from the base and to which ends of all of the retaining shafts are connected. Owing thereto, the retaining shafts that retain the metal rings are prevented from becoming inclined. Thus, dropping of the metal rings due to the retaining shafts becoming inclined can be avoided.

Furthermore, the retaining shafts may be made from nickel or a nickel-base alloy. Of course, a nickel or nickel-base alloy film may also be formed on surfaces of the retaining shafts.

Nickel functions as a barrier with respect to diffusion of constituent elements of the retaining shafts into the metal rings during implementation of various types of heat treatments such as a nitriding treatment or the like. Consequently, metal rings having a favorable (aesthetically pleasing) appearance can easily be obtained.

Still further, at least part of the plurality of retaining shafts may be erected on the base so as to be capable of being displaced in a direction to enlarge or in a direction to reduce the diameter of an inscribed circle defined by the retaining shafts. In this case, by displacing the retaining shaft so as to suitably change the diameter of the inscribed circle, the diameter thereof can be made to correspond to the diameters of the metal rings on which various types of heat treatments, such as a nitriding treatment or the like, are carried out. Stated otherwise, metal rings of various different diameters can be retained.

Thus, there is no need to prepare a plurality of conveyance racks corresponding to multiple metal rings of differing diameters, and owing thereto, equipment costs can be made less expensive.

When the plurality of retaining shafts may be arranged to be capable of retaining the metal rings in two or more vertically arranged columns, and the invention further comprises the connecting plate, which is disposed at a position separated from the base, retaining shafts, which retain both of two adjacent columns of the metal rings, are fixed in position, whereas other retaining shafts, which retain only one column of the metal rings, are displaceable. Additionally, an axial dimension of the retaining shafts that are fixed in position preferably is set greater than the axial dimension of the displaceable retaining shafts.

In the conveyance rack, cases may occur in which the base becomes flexed by hot zones that occur during heat treatment. In particular, in the event that the connecting plate is provided, there is a tendency for the base and the connecting plate to undergo flexure in directions toward one another. When such a situation occurs, there is a concern that the retaining shafts may become tightly gripped between the flexed base and the flexed connecting plate and made less susceptible to displacement.

With respect to this problem, in the case that the aforementioned structure is adopted, the base and the connecting plate are flexed so as to mutually approach each other along with being connected to the retaining shafts. Consequently, upon completion of the heat treatment, when the base and the connecting plate are made to separate away from the retaining shafts that support only one column of metal rings, the base and the connecting plate are separated by elasticity from the retaining shafts that retain only one column of metal rings.

Owing thereto, the retaining shafts that retain only one column of metal rings are released from restraint by the base and the connecting plate. Accordingly, the retaining shafts can easily be displaced.

In addition, at this time, it is unnecessary for the retaining shafts that retain both of the two columns of metal rings to be released from restraint by the base and the connecting plate. Consequently, because the working time can be reduced, the time to retention of the next batch of metal rings can also be shortened, and as a result, working efficiency for the metal rings can be improved.

Of course, all of the plurality of retaining shafts may be displaceable. In accordance with this structure, in the case that two or more columns of metal rings are retained by one conveyance rack, one of such columns is capable of supporting metal rings of a small diameter, whereas the other of the columns is capable supporting metal rings of a large diameter. More specifically, metal rings having mutually different diameters can be retained simultaneously while the aforementioned heat treatment is carried out thereon.

In the case that the connecting plate is used, preferably the connecting plate may comprise a substantially H-shaped body having two long bar portions that extend mutually in parallel and one short bar portion connecting the long bar portions, with ends of the two long bar portions mutually approaching toward one another to form substantially C-shaped portions. By providing such a shape, a lightweight connecting plate can be constructed. In addition, retention of metal rings by the retaining shafts is made easier.

Further, according to another embodiment of the present invention, there is provided a method for retaining metal rings for carrying out a heat treatment on a plurality of metal rings that exhibit an elastic restorative force, wherein the metal rings are retained by a conveyance rack equipped with a plurality of retaining shafts erected on a base and which extend parallel to each other, the retaining shafts being provided on side walls thereof with a plurality of protrusions, which abut on lower end surfaces of the metal rings, the method comprising:

causing the protrusions to abut by point contact with respect to the lower end surfaces of the metal rings.

In particular, preferably, retaining shafts are used, on which there are further provided blocking projections disposed between each of respective adjacent protrusions, wherein the blocking projections are brought into abutment against side walls of the metal rings.

By retaining the metal rings in this manner, for the reasons discussed above, the temperature of the metal rings during heat treatment is substantially equivalent around the entirety thereof, and the various heat treatment gases, such as nitriding gases or the like, come into contact with substantially the entirety of the metal rings. Therefore, the heat treatment can be implemented without irregularities, while in addition, concerns over the occurrence of warping or strain in the metal rings can be dispensed with.

In the above retaining method, preferably, at least part of the plurality of retaining shafts is provided to be capable of being displaced in a direction to enlarge or in a direction to reduce the diameter of an inscribed circle defined by the retaining shafts.

In the case that at least part of the retaining shafts is erected on the base to be displaceable in this manner, by displacing the retaining shafts so as to suitably change the diameter of the inscribed circle, the diameter thereof can be made to correspond to the diameters of the metal rings on which the heat treatment is carried out. Stated otherwise, by changing the position of the retaining shafts, metal rings of various different diameters can be retained.

In this case, the plurality of retaining shafts may be arranged to be capable of retaining the metal rings in two or more vertically arranged columns, and when the connecting plate is provided, retaining shafts, which retain both of two adjacent columns of the metal rings, are fixed in position, whereas retaining shafts, which retain only one column of the metal rings, are made displaceable. Together therewith, preferably, an axial dimension of the retaining shafts that are fixed in position is set to be greater than the axial dimension of the displaceable retaining shafts. In addition, only the displaceable retaining shafts may be displaced after having been released from restraint by the base.

As noted above, the retaining shafts can easily be made displaceable by being arranged in this manner. Together therewith, working efficiency for the metal rings can be improved.

Of course, for the reasons discussed above, all of the plurality of retaining shafts may be displaceable.

According to another embodiment of the present invention, a method for heat-treating metal rings may be provided for implementing a heat treatment in a state in which a plurality of metal rings that exhibit an elastic restorative force are retained by a conveyance rack, the method comprising the steps of:

retaining the metal rings in the conveyance rack with respect to a plurality of retaining shafts erected on a base of the conveyance rack and which extend parallel to each other, wherein the retaining shafts comprise columnar members which are shaped as polygons in horizontal cross section, one of the side surfaces of each columnar member facing toward the metal rings, a plurality of protrusions being provided only on the side surfaces that face toward the metal rings, by causing lower end surfaces of the metal rings to come into point-contact with the protrusions; and conveying the metal rings into a heat treatment furnace together with the conveyance rack and performing a heat treatment.

In this manner, the columnar members are shaped as polygons in horizontal cross section, and protrusions are provided only on side surfaces of the columnar members that face toward the metal rings, whereby retaining shafts are obtained, which are small and lightweight with a small heat capacity. Consequently, transportation of the metal rings together with the conveyance rack is made easier, and the occurrence of irregularities in the heat treatment can more easily be avoided.

DESCRIPTION OF EMBODIMENTS

Conveyance racks according to preferred embodiments of the present invention, in relation to a retaining method and a heat treatment method using the conveyance racks, shall be described below with reference to the accompanying drawings.

First, a conveyance rack equipped with retaining shafts on which protrusions are formed, apexes of which face toward the centers of metal rings, and wherein the protrusions include tapered reduced-diameter portions, shall be explained in connection with a first embodiment of the present invention.

Figure 1:
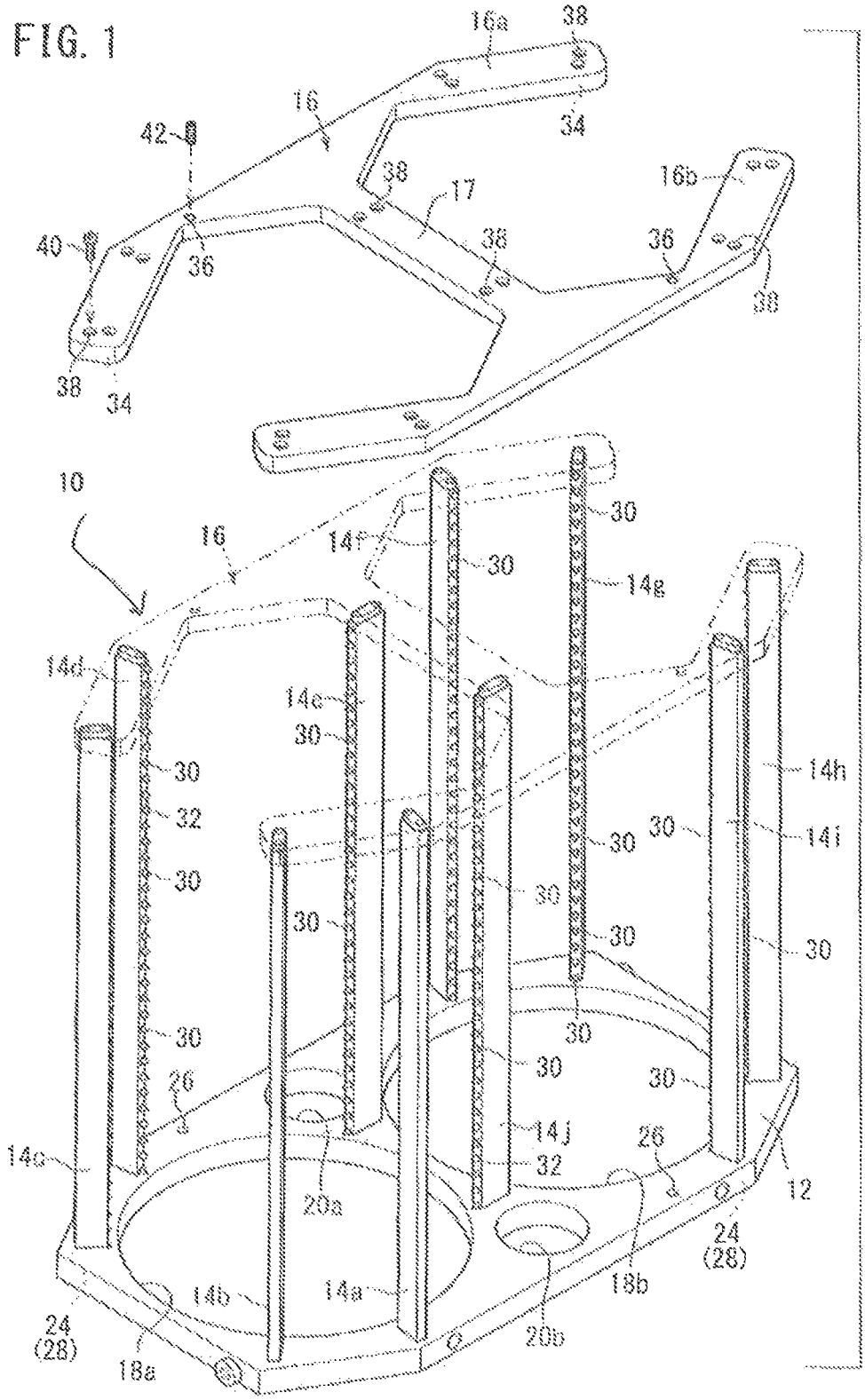
FIG. 1 is an overall outline perspective view of a conveyance rack according to a first embodiment.
Figure 2:
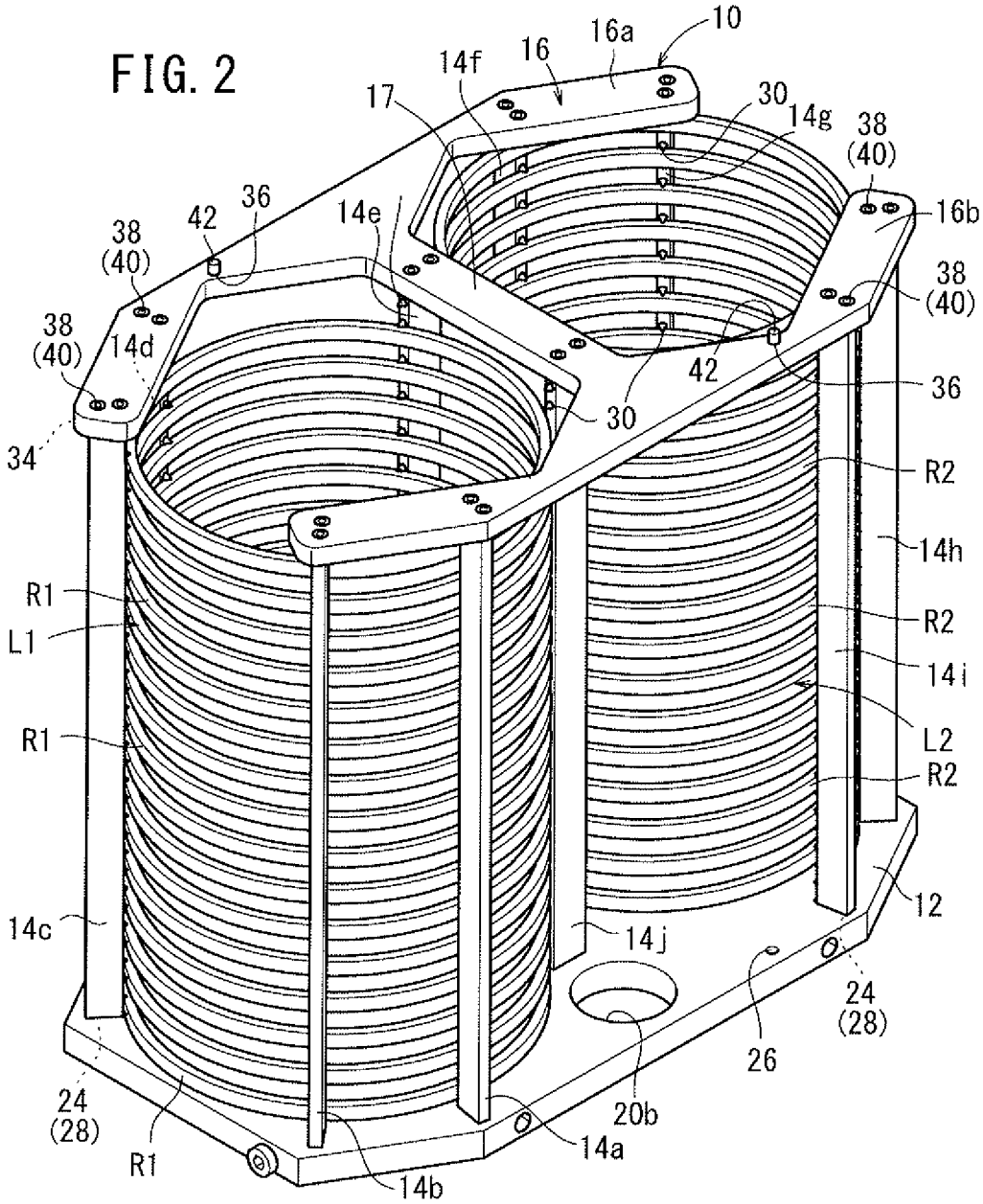
FIG. 2 is an overall outline perspective view showing a condition in which two columns of metal rings are retained in the conveyance rack of FIG. 1.

FIG. 1 is an overall outline perspective view of a conveyance rack 10 according to a first embodiment. FIG. 2 is an overall outline perspective view showing a condition in which metal rings R1, R2 are retained in the conveyance rack 10. The conveyance rack 10 serves to retain and transport a first column L1 made up of a plurality of metal rings R1, and a second column L2 made up of a plurality of metal rings R2, and includes a base 12, ten retaining shafts 14*a* to 14*j* erected on the base 12, and a connecting plate 16 that connects all of the ten retaining shafts 14*a* to 14*j* together.

For the sake of convenience, separate reference numerals are used to designate the metal rings R1, R2. However, the structure of the metal rings R1, R2 is the same. Further, among the retaining shafts 14*a* to 14*j*, the structure of the retaining shafts 14*a* to 14*d*, 14*f* to 14*i* is the same, whereas the structure of the retaining shafts 14*e*, 14*j* is the same.

The base 12 is of a form made by cutting out isosceles right triangles from the long side and over the short sides of a flat plate, to thereby form the base 12 in an octagonal shape. Further, for reducing the weight thereof, large circular openings 18*a*, 18*b* and small circular openings 20*a*, 20*b* are formed to penetrate through the base 12. By forming the large circular openings 18*a*, 18*b* and the small circular openings 20*a*, 20*b*, the base 12 is made lightweight, which as a result, contributes to lessening the weight of the conveyance rack 10.

Figure 3:
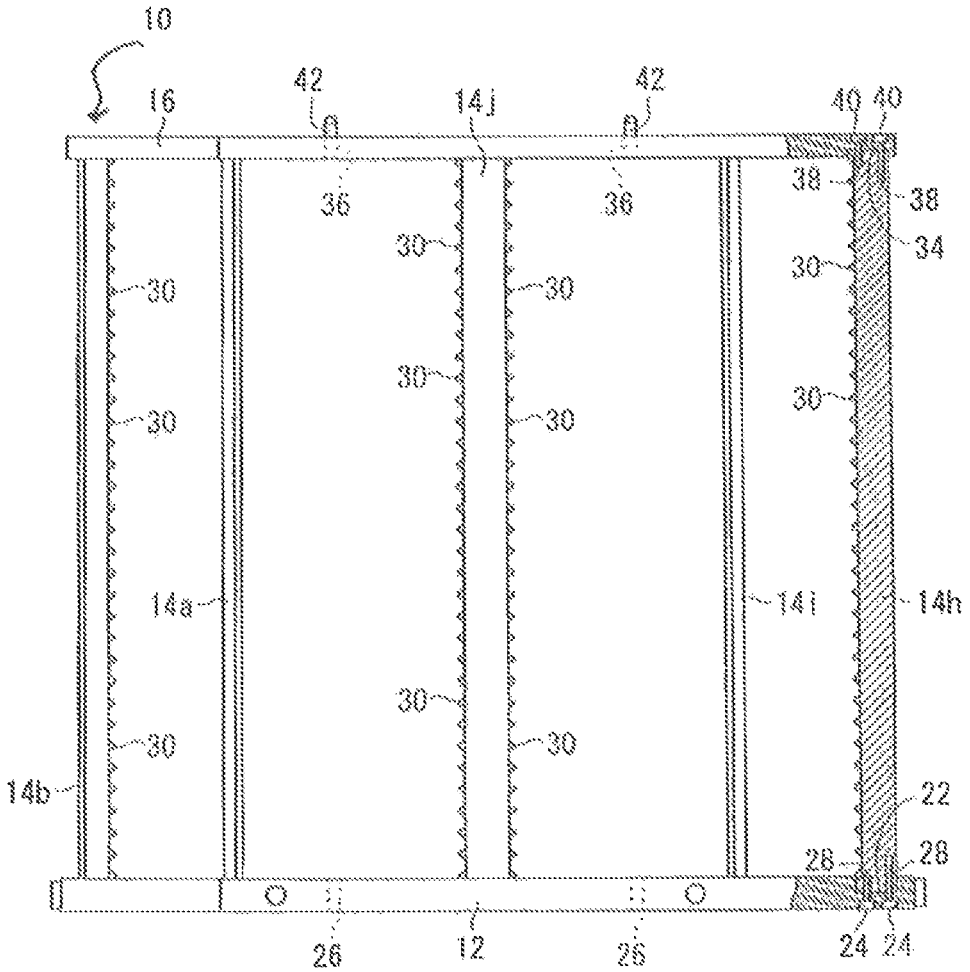
FIG. 3 is a partial vertical cross sectional side view of the conveyance rack of FIG. 1.

Further, as shown in FIG. 3, on the base 12 there are formed retaining shaft insertion recesses 22, bolt insertion holes 24 that penetrate from the lower surface of the base 12 into the retaining shaft insertion recesses 22, and two connecting pin insertion holes 26. Lower ends of the retaining shafts 14*a* to

14*j* are inserted respectively into the retaining shaft insertion recesses 22, and are connected to the base 12 by bolts 28, which are inserted through the bolt insertion holes 24. Owing thereto, the retaining shafts 14*a* to 14*j* are erected in an upstanding manner on the base 12.

Figure 4:
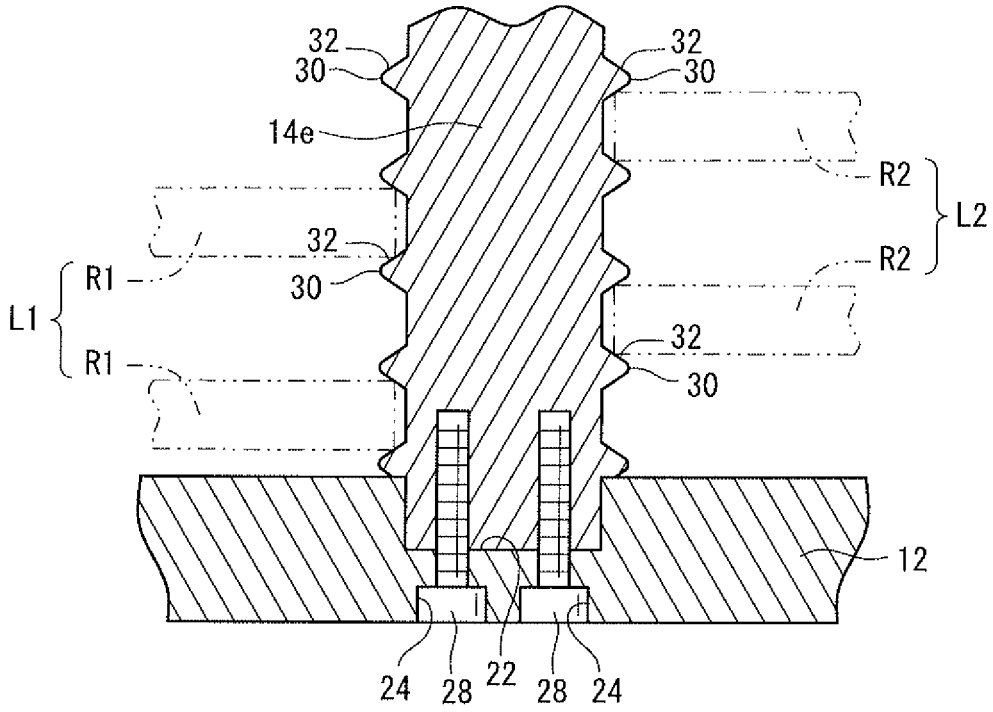
FIG. 4 is an enlarged vertical cross sectional view of essential elements of the conveyance rack of FIG. 1.
Figure 5:
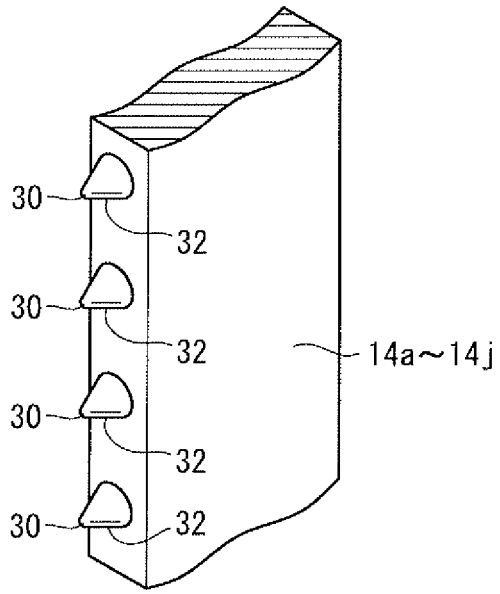
FIG. 5 is an outline perspective view of essential elements of a retaining shaft constituting the conveyance rack of FIG. 1.

FIGS. 4 and 5 illustrate respectively a vertical cross sectional view and an outline perspective view of essential parts of the retaining shaft 14*e*. As can be understood from FIGS. 4 and 5, the retaining shaft 14*e* is formed as a solid rectangular columnar body. Substantially conical shaped retaining protrusions (hereinafter referred to simply as "protrusions") 30 are formed on the two short side wall portions thereof.

As noted above, the retaining shaft 14*j* is of the same structure as the retaining shaft 14*e*. Further, the remaining retaining shafts 14*a* to 14*d*, 14*f* to 14*i* are configured to conform to the retaining shaft 14*e*, except for the fact that the protrusions 30 are formed on only one of the two short side wall portions thereof.

Respective apexes of the protrusions 30 of the retaining shafts 14*a* to 14*d*, 14*f* to 14*i* are disposed to point toward the center of the metal rings R1, R2. On the other hand, apexes of the protrusions 30 of the retaining shafts 14*e*, 14*j* extend so as to point in the longitudinal direction of the base 12 and face toward the metal rings R1, R2.

The conical apexes of each of the protrusions 30 are curved, and thus surfaces of the frustoconical apexes are formed in a bulging manner. Apexes of the respective protrusions 30 face toward the metal rings R1, R2, and accordingly, the protrusions 30 are reduced in diameter in tapered shapes from the retaining shafts 14*a* to 14*j* toward the side of the metal rings R1, R2. Stated otherwise, the protrusions 30 include tapered reduced-diameter portions 32.

As shown by the two-dot-chain line in FIG. 4, the metal rings R1, R2 are gripped by respective adjacent protrusions 30, 30. Alternatively, lower end surfaces of the metal rings R1, R2 may be placed on the protrusions 30 that are positioned beneath the metal rings R1, R1, whereas the upwardly positioned protrusions 30 and upper end surfaces of the metal rings R1, R2 may be separated mutually from each other.

The retaining shafts 14*a* to 14*j* that are shaped in this manner can be fabricated, for example, by forming the protrusions 30 by carrying out a cutting process on solid rectangular columnar bodies from outer wall sides thereof. Alternatively, the rectangular columnar bodies and the protrusions 30 may be fabricated separately, and the protrusions 30 may be attached with respect to short side walls of the rectangular columnar bodies, for example, by boring screw holes into the rectangular columnar bodies, while lower surfaces of the protrusions 30 are provided with threaded round bars thereon for screw engagement with the screw holes, and the threaded round bars are threaded into the screw holes.

Naturally, as shown in FIG. 1, the retaining shafts 14*a* to 14*j* are erected on the base 12 so that the positions of the protrusions 30 are in agreement. Accordingly, the metal rings R1 are interposed between respective protrusions 30 of the retaining shafts 14*a* to 14*e*, 14*j*, and the metal rings R2 are interposed between respective protrusions 30 of the retaining shafts 14*e* to 14*j*. More specifically, among the retaining shafts 14*a* to 14*j*, two of the retaining shafts 14*e* and 14*j* serve to retain both the metal rings R1 and R2 (i.e., the first column L1 and the second column L2).

In the forgoing structure, on respective side wall surfaces of the retaining shafts 14*a* to 14*j*, a nickel film is formed, for example, by carrying out a nickel plating process thereon. Instead of forming a nickel film, the retaining shafts 14*a* to 14*j* may be constituted entirely from nickel.

The connecting plate 16 is substantially H-shaped in form, having long bar parts 16*a*, 16*b* that extend mutually in parallel, and a short bar part 17 that bridges roughly central portions of the long bar parts 16*a*, 16*b*. The connecting plate 16, which is shaped in this manner, is remarkably lighter in weight compared to a flat plate shaped connecting plate. More specifically, by forming the connecting plate 16 to be substantially H-shaped, the connecting plate 16, and consequently the conveyance rack 10, can be made even lighter in weight.

Ends of the long bar parts 16*a*, 16*b* are made to approach each other. As a result, roughly C-shaped portions are formed by roughly half of the long bar parts 16*a*, 16*b* and the short bar part 17. Stated otherwise, two substantially C-shaped openings are formed on the connecting plate 16.

Further, retaining shaft insertion recesses 34 are formed in a depressed fashion on the lower surface of the connecting plate 16, at positions corresponding to the retaining shaft insertion recesses 22 in the base 12, whereas on the upper surface thereof, connecting pin fixing holes 36 are formed at positions corresponding to the positions of the connecting pin insertion holes 26 on the base 12. Moreover, bolt insertion holes 38 are formed to penetrate from the upper end surface of the connecting plate 16 to the retaining shaft insertion recesses 34. Upper ends of each of the retaining shafts 14*a* to 14*j* are inserted into the retaining shaft insertion recesses 34, and are connected to the connecting plate 16 by bolts 40, which are inserted into the aforementioned bolt insertion holes 38.

On the other hand, screw threads are engraved on inner walls of the connecting pin fixing holes 36. Connecting pins 42, the side walls of which are formed with threads, are screw-engaged in the connecting pin fixing holes 36. As described later, in the case that respective conveyance racks 10 are stacked on one another, the connecting pins 42 are inserted into the connecting pin insertion holes 26 of the base 12 of the upper conveyance rack 10.

The conveyance rack 10 according to the first embodiment is constructed basically as described above. Next, effects and advantages of the conveyance rack 10 shall be described in relation to a heat treatment method on the metal rings R1, R2, which is conducted using the conveyance rack 10.

At first, before the connecting plate 16 is connected to the retaining shafts 14*a* to 14*j*, the metal rings R1, R2 are retained by the retaining shafts 14*a* to 14*j* as the first column L1 and the second column L2. Of course, the retaining shafts 14*a* to 14*j* are erected beforehand on the base 12 through the bolts 28, which are inserted respectively into the bolt insertion holes 24.

The metal rings R1, R2 are fabricated, for example, by cutting a cylindrical drum made from maraging steel into predetermined widths, and possess an elastic restorative force with respect to being pressed. More specifically, when such a pressing force is released, the metal rings R1, R2 return to their original shape due to an elastic action thereof.

Plural metal rings R1, which are constituted in this manner, are gripped from the outer circumferential side thereof by a non-illustrated gripping device. At this time, a gripping force (pressing force) is imposed on the metal rings R1 through the gripping device, whereby all of the metal rings R1 are deformed in an elliptical shape or a substantially hexagonal shape, for example. Stated otherwise, the metal rings R1 are gripped by the gripping device under a condition of being deformed in an elliptical shape or a substantially hexagonal shape or the like. Naturally, deformation thereof is carried out within a range in which the metal rings R1 remain elastic.

The plural metal rings R1, which have been deformed in an elliptical shape or the like, are transferred to a position between the retaining shafts 14*a* to 14*e*, 14*j*. The aforementioned gripping device is stopped in the heightwise direction of the retaining shafts 14*a* to 14*e*, 14*j*, at a position at which the metal rings R1 are arranged respectively between adjacent protrusions 30.

Thereafter, all of the metal rings R1 are released simultaneously from the gripping force of the aforementioned gripping device, along with the metal rings R1 being restored to their original substantially true circular shape due to the elastic restorative force. At this time, the respective metal rings R1 are interposed between the protrusions 30 of the retaining shafts 14*a* to 14*e*, 14*j*, and as a result, as shown in FIG. 2, the plural metal rings R1 are retained simultaneously by the retaining shafts 14*a* to 14*e*, 14*j* as the first column L1.

Next, the gripping device simultaneously grips the plural metal rings R2, which are deformed in the same elliptical shape or the like as mentioned above, and in this state, the metal rings R2 are transferred to a position between the retaining shafts 14*e* to 14*j*. Thereafter, similar to the above, after the gripping device is stopped at a position in which the metal rings R2 are arranged respectively between the adjacent protrusions 30 of the retaining shafts 14*a* to 14*j*, all of the rings R2 are released simultaneously from the gripping force of the gripping device. Along with being released, all of the metal rings R2 are restored to their original substantially true circular shape, such that outer walls thereof are interposed respectively between respective protrusions 30 of the retaining shafts 14*e* to 14*j*. As a result, the plural metal rings R2 are retained by the retaining shafts 14*e* to 14*j* as the second column L2. The metal rings R1, R2 are retained at different levels to avoid mutual interference therebetween.

Figure 6:
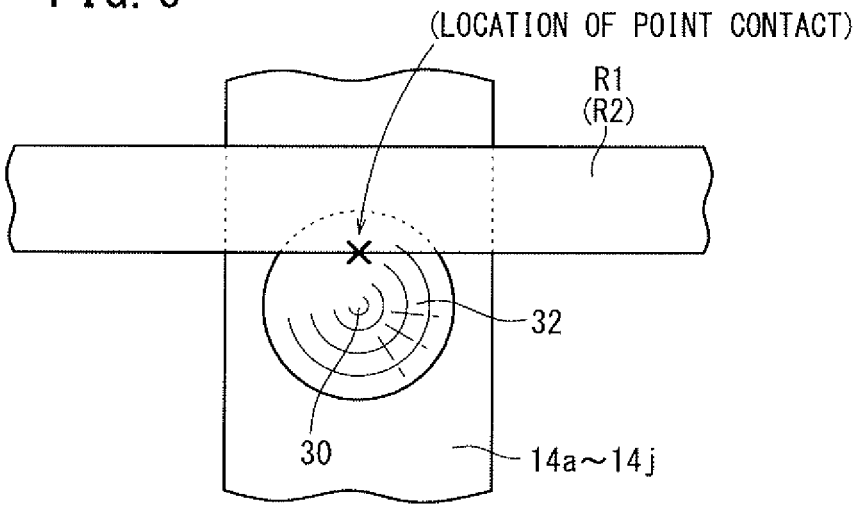
FIG. 6 is a front view of essential elements showing a condition in which a lower end surface of a metal ring is in point contact with a protrusion shown in FIG. 5.

At this time, as shown in FIG. 6, the lower end surface of the metal ring R1 (R2) contacts the tapered reduced-diameter portion 32 on the protrusion 30. Because the tapered reduced-diameter portion 32 is curved, the lower end surface of the metal ring R1 (R2) is in point contact, at the location shown by the character x, with respect to the reduced-diameter portion 32. More specifically, the metal rings R1 (R2) and the protrusions 30 are placed in a state of point contact with each other. In the foregoing explanations and in FIG. 6, for the sake of convenience, the protrusion 30 that is positioned on the upper end surface side of the metal ring R1 (R2) is omitted, and explanations have been given only concerning the lower end surface side. However, in a similar manner, the upper end surfaces of the metal rings R1 (R2) also are in point contact with respect to the tapered reduced-diameter portions 32 of the protrusions 30.

Figure 7:
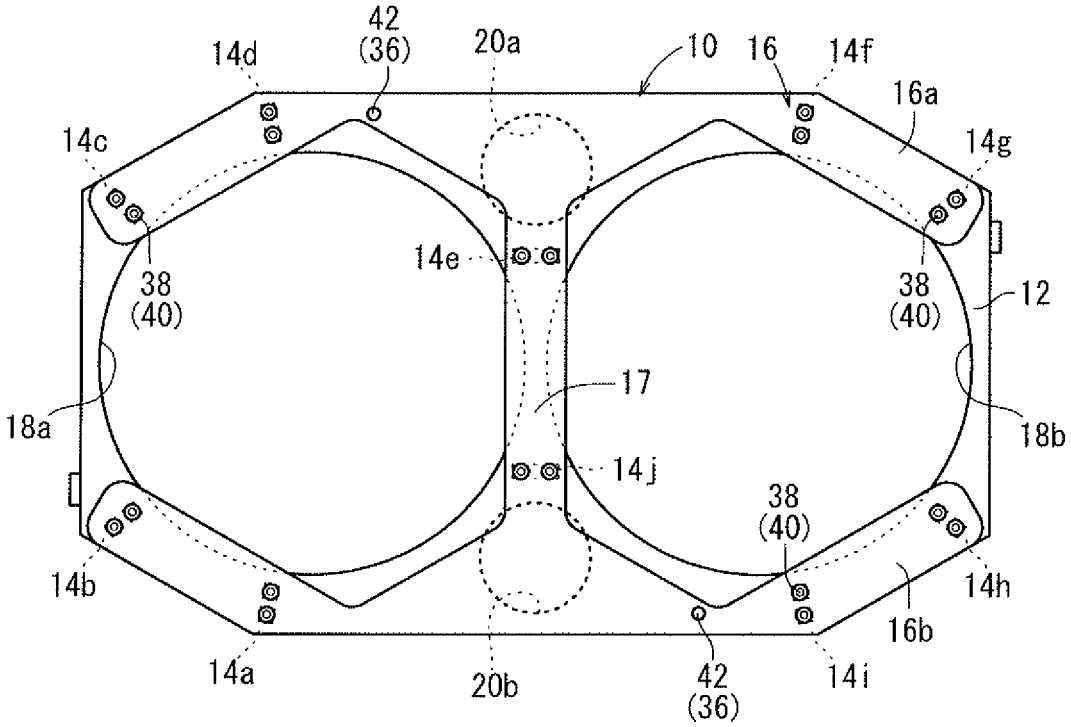
FIG. 7 is an upper plan view of the conveyance rack of FIG. 1.

Once the metal rings R1, R2 have been retained in the foregoing manner, upper ends of the retaining shafts 14*a* to 14*j* are inserted into the retaining shaft insertion recesses 34 formed on the lower surface of the connecting plate 16. Thereafter, as shown in FIG. 7, respective upper ends of the retaining shafts 14*a* to 14*j* are connected with respect to the connecting plate 16 by the bolts 40 inserted into the bolt insertion holes 38. (In FIG. 7, the metal rings R1, R2 have been omitted from illustration, in order to show the positional relationship between the base 12, the retaining shafts 14*a* to 14*j*, and the connecting plate 16.) Further, when needed, connecting pins 42 are threaded into screw-engagement with the connecting pin fixing holes 36.

In accordance with the above steps, the metal rings R1, R2 and the conveyance rack 10 are placed in the condition shown in FIG. 2. The connecting plate 16 interconnects the retaining shafts 14*a* to 14*j*, whereby the retaining shafts 14*a* to 14*j* are prevented from inclining, and the falling out of the metal rings R1, R2 from the retaining shafts 14*a* to 14*j* due to inclination thereof also is prevented.

In this manner, in the case that the connecting plate 16 is connected after the metal rings R1, R2 have been retained by the retaining shafts 14*a* to 14*j*, a simple structure can be utilized as the aforementioned gripping device. The metal rings R1, R2 may also be retained by the retaining shafts 14*a* to 14*j* after the connecting plate 16 has been connected to respective upper ends of the retaining shafts 14*a* to 14*j* that have been erected on the base 12, although in this case, it is necessary to use a gripping device which is slightly more complex than the aforementioned gripping device, and for which control to transfer the metal rings R1, R2 must be performed somewhat more precisely. In this case, the metal rings R1, R2 may be inserted from between two adjacent shafts from among the retaining shafts 14*a* to 14*j*.

Alternatively, the metal rings R1, R2 may be gripped while being deformed in a substantially hexagonal shape, within a range in which the metal rings R1, R2 remain elastic, by a non-illustrated gripping device. In this case, after the upper ends of the retaining shafts 14*a* to 14*j*, which are erected on the base 12, have been connected to the substantially H-shaped connecting plate 16, the gripping device is inserted into the C-shaped openings of the connecting plate 16. In this state, along with the metal rings R1, R2 being released from the gripping device, the metal rings R1, R2, which have been restored under the elasticity thereof, are gripped between the retaining shafts 14*a* to 14*j*.

Figure 8:
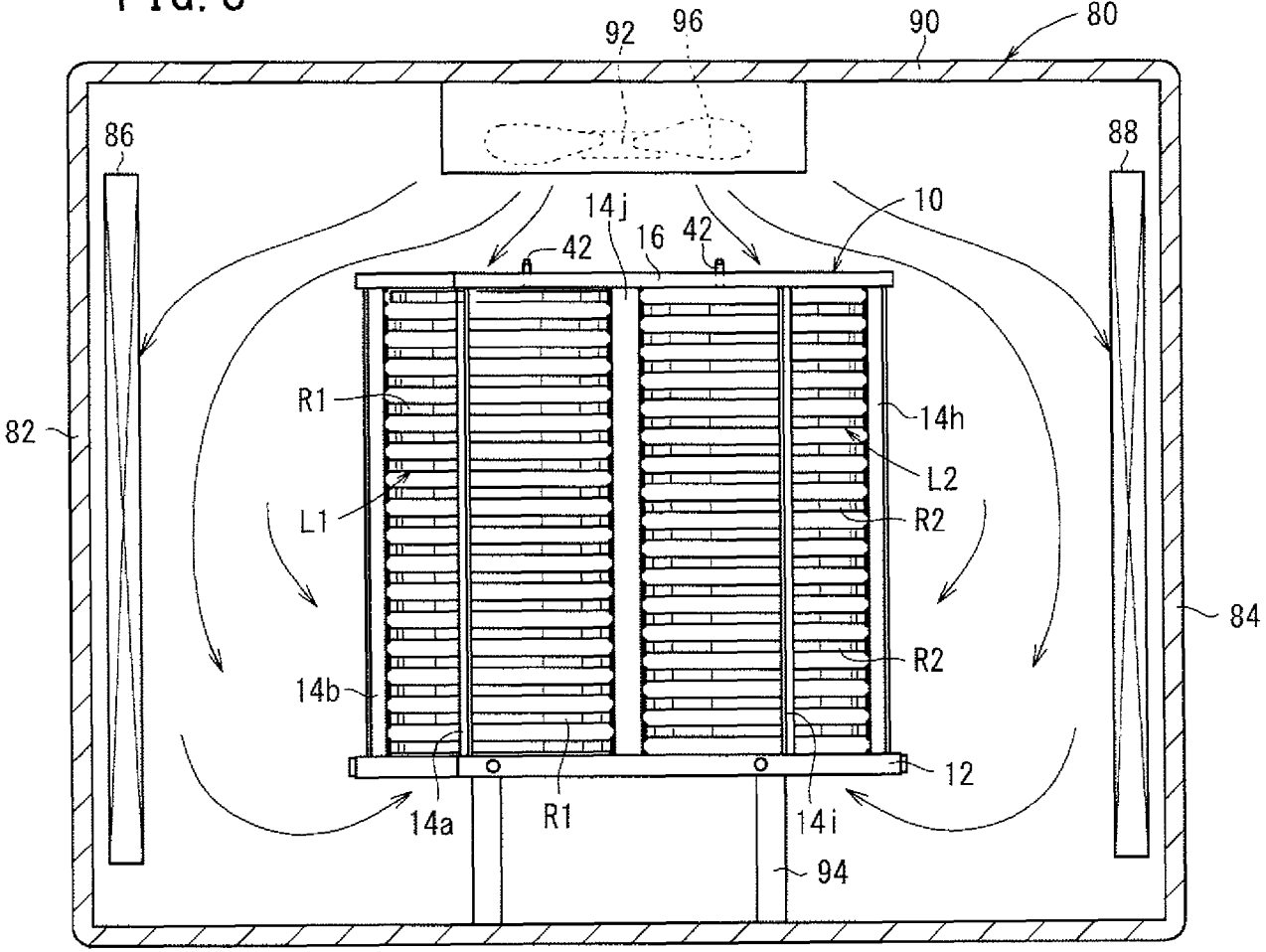
FIG. 8 is a vertical cross sectional front view showing a condition in which the conveyance rack is introduced into a heat treatment furnace.

Next, the metal rings R1, R2 are transported together with the conveyance rack 10 into the interior of a heat treatment furnace 80 shown in FIG. 8, under the action of a non-illustrated transfer. As noted above, large circular openings 18*a*, 18*b* and small circular openings 20*a*, 20*b* are formed to penetrate through the base 12 that constitutes the conveyance rack 10, whereas the connecting plate 16 is formed in a substantially H-shape. Accordingly, the conveyance rack 10 is lighter in weight compared to a conveyance rack comprising a base and a connecting plate that are shaped as flat plates.

Furthermore, because the two centrally located retaining shafts 14*e*, 14*j* retain both the first column L1 of the metal rings R1 and the second column L2 of the metal rings R2, an increase in the number of retaining shafts can be avoided. By adopting such a structure, the retaining shafts 14*a* to 14*j* contribute greatly to reducing the weight thereof and thus of the conveyance rack 10.

Owing thereto, the conveyance rack 10 can easily be transported. Further, less electrical power or the like is required to transport the conveyance rack 10.

The heat treatment furnace 80 is formed with a longitudinal dimension along the direction in which the conveyance rack 10 is transported, and is constituted by providing heaters 86, 88 on the inside of side walls 82, 84, and a convection fan 92 on a ceiling wall 90. The conveyance rack 10, which is supported on the aforementioned transfer via a mounting jig 94, is conveyed into the heat treatment furnace 80 together with the mounting jig 94.

A nitriding treatment shall be described as an example of the heat treatment process. A nitriding gas, for example, such as ammonia or the like, is supplied to the interior of the heat treatment furnace 80 shown in FIG. 8. The nitriding gas is heated to a predetermined temperature, for example, 500° C., under the action of the heaters 86, 88, so as to enable nitriding of the metal rings R1, R2.

Along with the rise in temperature, the metal rings R1, R2 receive radiant heat, and thermal expansion is induced therein such that the metal rings R1, R2 approach the retaining shafts 14*a* to 14*j*.

As noted above, lower end surfaces and upper end surfaces of the metal rings R1, R2 are retained in a condition of point contact with respect to the protrusions 30 (see FIG. 6 concerning the lower end side). Thus, the restraining force of the protrusions 30 with respect to the metal rings R1, R2 is small. Owing thereto, the metal rings R1, R2 can thermally expand without being obstructed by the protrusions 30.

More specifically, according to the present embodiment, suppression of thermal expansion of the metal rings R1, R2 can be avoided. Thus, concerns over the occurrence of strain on the metal rings R1, R2 can be dispensed with.

The nitriding gas, which has risen in temperature, rises toward the ceiling wall 90 of the heat treatment furnace 80 (see FIG. 8). In the first embodiment, the convection fan 92 is energized to rotate agitating blades 96, whereby the nitriding gas inside the heat treatment furnace 80 is subjected to convection. Consequently, the nitriding gas descends along the side walls, and the mounting jig 94, and then rises again in the vicinity of the conveyance rack 10.

In the foregoing manner, the lower end surfaces and upper end surfaces of the metal rings R1, R2 are in a state of point contact with respect to the protrusions 30. More specifically, the area of contact between the metal rings R1, R2 and the protrusions 30 is extremely small. Owing thereto, the nitriding gas can wrap around and enter sufficiently into the vicinity of the contact locations between the metal rings R1, R2 and the protrusions 30.

Stated otherwise, according to the first embodiment, the nitriding gas comes into contact with substantially the entirety of the metal rings R1, R2. Further, heat transfer between the metal rings R1, R2 and the protrusions 30 is suppressed to a minimum, and therefore the temperature of the metal rings R1, R2 is substantially uniform over the entirety thereof. In other words, the temperature at the contact points between the retaining shafts 14*a* to 14*j* and the metal rings R1, R2 is substantially the same as the temperature at other locations on the metal rings R1, R2.

For this reason, nitriding progresses substantially uniformly over the entirety of the metal rings R1, R2. More specifically, variations in the progression of nitriding are avoided, and therefore, the thickness of the nitriding layer, and thus variations in the degree of hardening of the metal rings R1, R2 can be avoided.

In this manner, according to the first embodiment, in which the protrusions 30 disposed on the retaining shafts 14*a* to 14*j* and the metal rings R1, R2 are placed in a state of point contact, the temperature of the metal rings R1, R2 can be kept substantially the same over the entirety thereof, and the nitriding gas can come into contact with substantially the entirety of the metal rings R1, R2. Consequently, nitriding is substantially uniform over the entirety of the metal rings R1, R2, and thus the rings R1, R2 can be hardened substantially uniformly.

Further, because a nickel film is formed on side wall surfaces of the retaining shafts 14*a* to 14*j*, constituent elements of the retaining shafts 14*a* to 14*j* are prevented from diffusing into the metal rings R1, R2 during the nitriding process. More specifically, the nickel film functions as a barrier with respect to diffusion of constituent elements of the retaining shafts 14*a* to 14*j* into the metal rings R1, R2. Naturally, the same effects can be achieved if the retaining shafts 14*a* to 14*j* are constituted entirely from nickel.

In this manner, after the metal rings R1, R2 have been subjected to the nitriding process, the conveyance rack 10 is taken out of the heat treatment furnace 80. Thereafter, nuts 48 are loosened, the connecting plate 16 is removed from the retaining shafts 14*a* to 14*j*, and the metal rings R1, R2 are exposed.

The exposed metal rings R1, R2 are gripped by the gripping device, are removed from the retaining shafts 14*a* to 14*j* while being deformed in a elliptical shape or the like, and are transported to a predetermined station or storage location. Of course, the metal rings R1, R2, upon being released from the gripping device, are restored to their substantially true circular shape due to their elastic action.

Henceforth, when another new batch of metal rings R1, R2 is retained, the conveyance rack 10 including the retaining shafts 14*a* to 14*j* fabricated in the foregoing manner is reused repeatedly.

Figure 9:
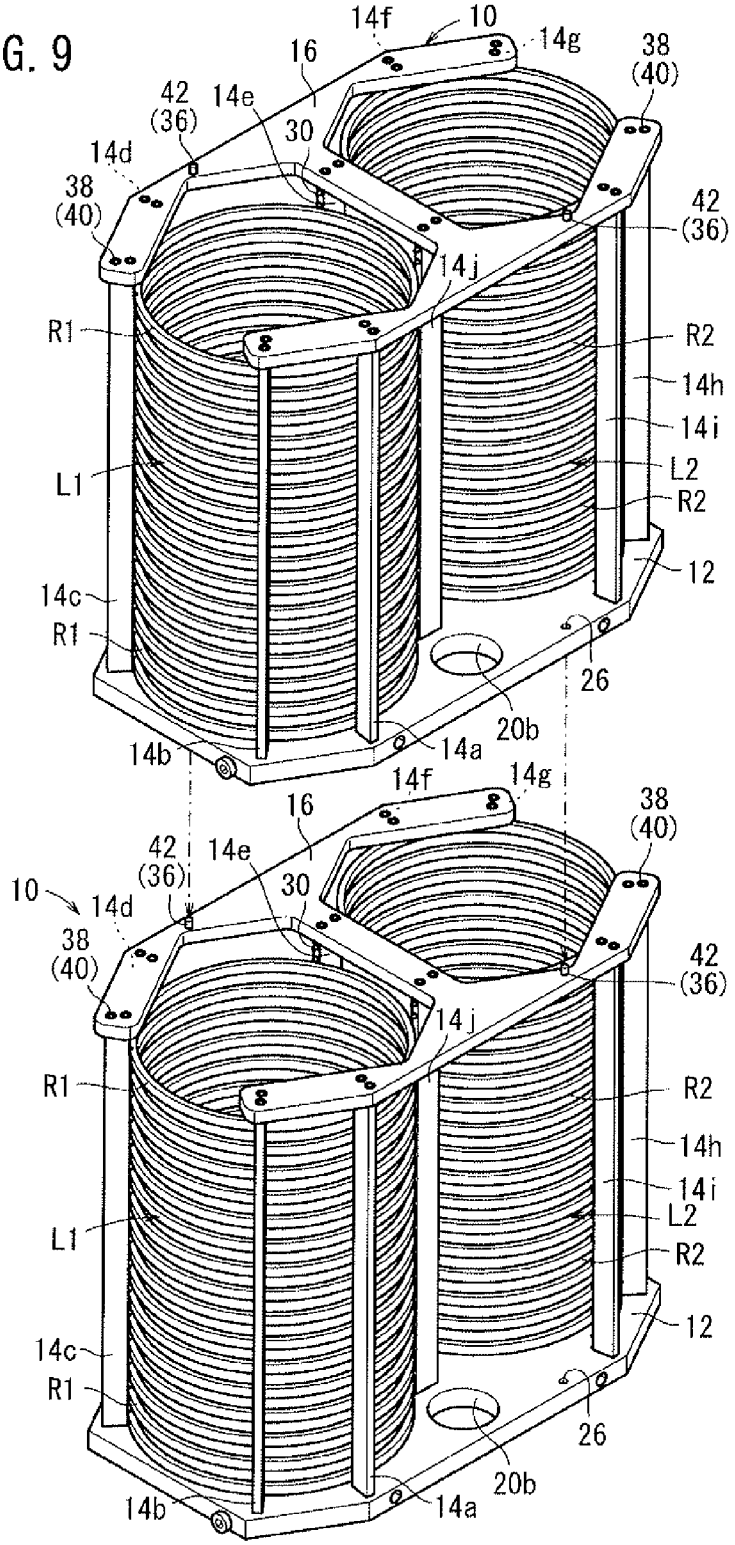
FIG. 9 is an exploded perspective view during stacking of conveyance racks.
Figure 10:
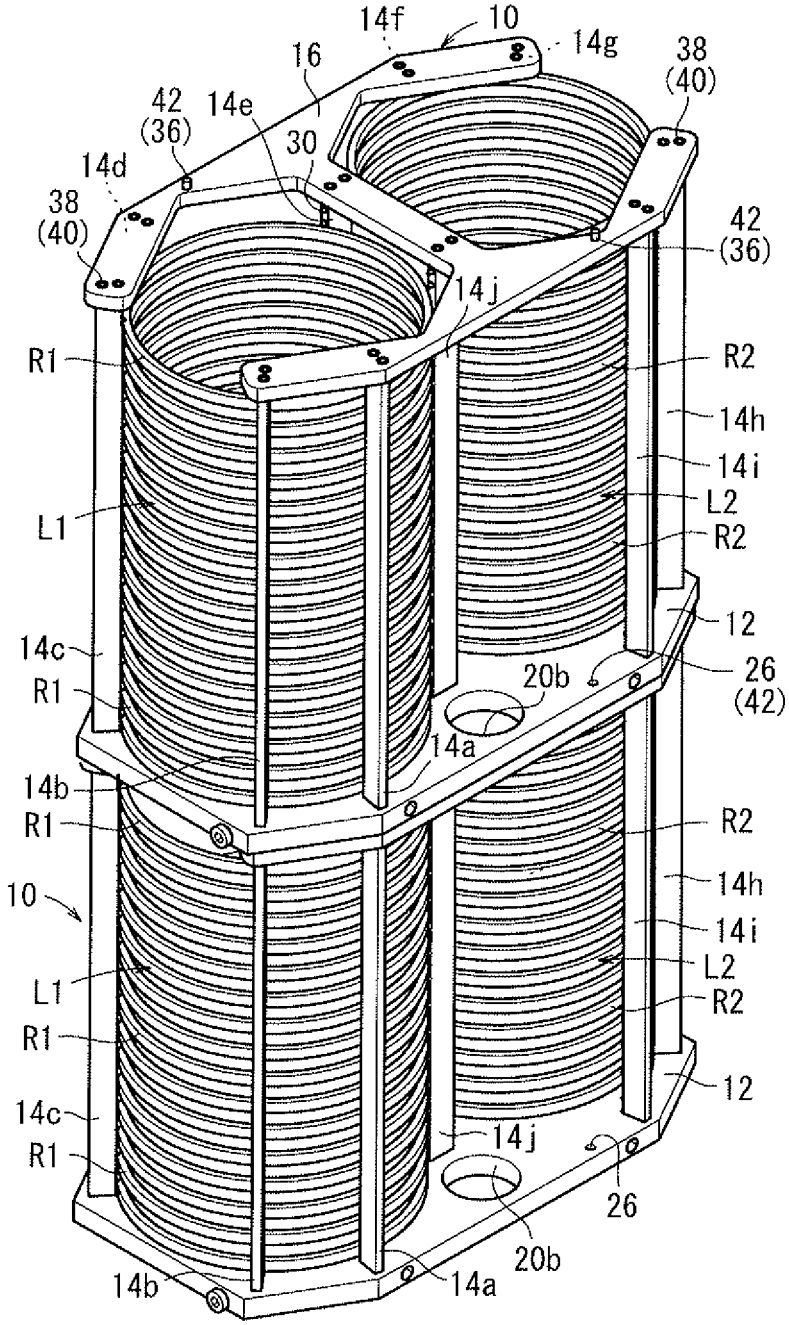
FIG. 10 is an overall outline perspective view showing a condition in which the conveyance racks from FIG. 9 are stacked.

In FIG. 8, a case is shown in which the conveyance rack 10 is transported into the heat treatment furnace 80 in a non-stacked state. However, if a large capacity heat treatment furnace is used, then as shown in FIGS. 9 and 10, respective conveyance racks 10, 10 may be stacked on each other through connecting pins 42, and transported into the interior of the heat treatment furnace in this state.

Similarly, it is a matter of course that the conveyance racks 10 may be stacked in three or more levels.

Next, a second embodiment shall be described, in which a conveyance rack is equipped with retaining shafts formed with projections, the apexes of which face in directions away from the center of the metal rings. Structural features of the conveyance rack, which are the same as those of the conveyance rack 10 according to the first embodiment, are designated by the same reference characters.

Figure 11:
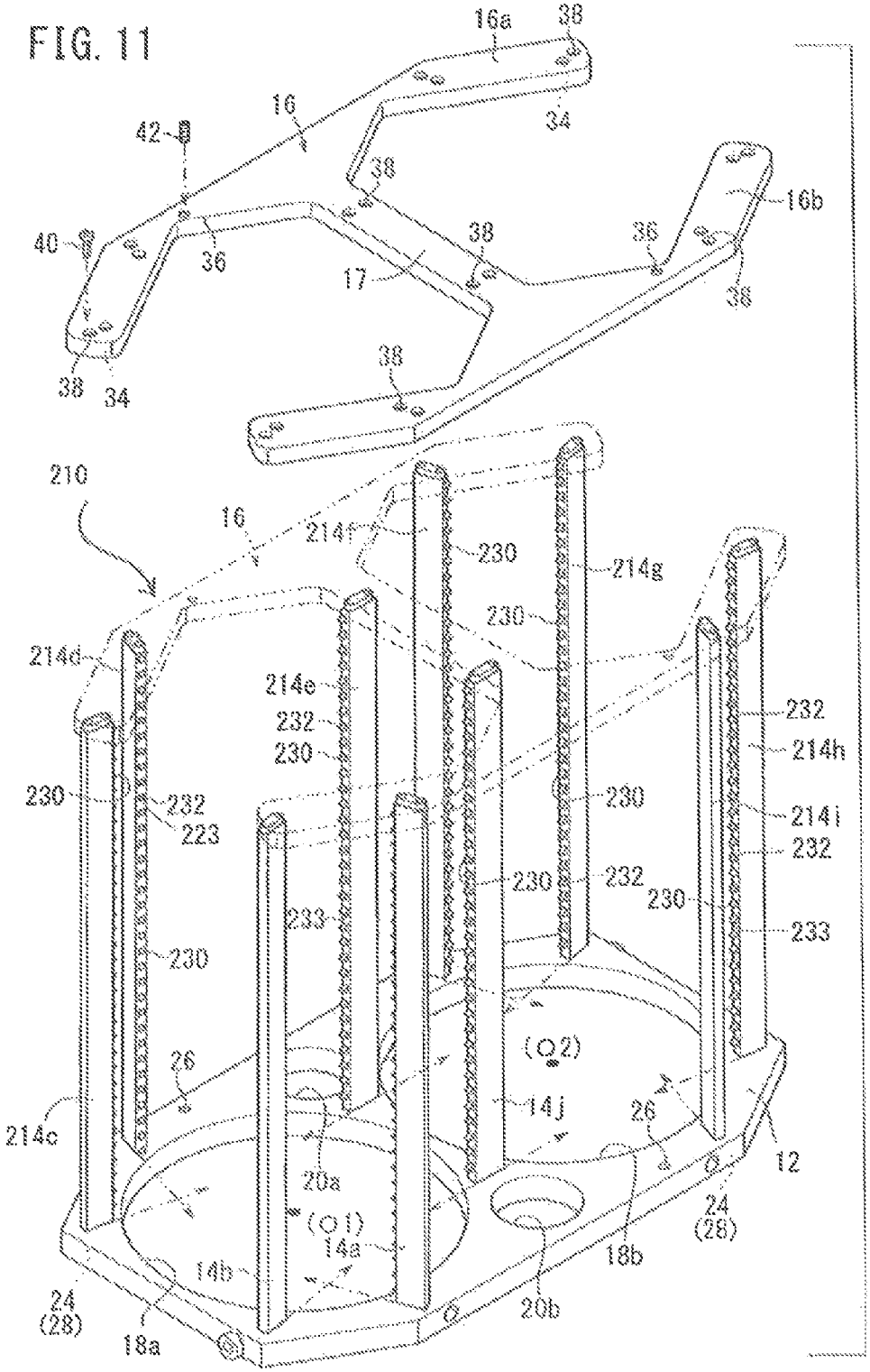
FIG. 11 is an overall outline perspective view of a conveyance rack according to a second embodiment.
Figure 12:
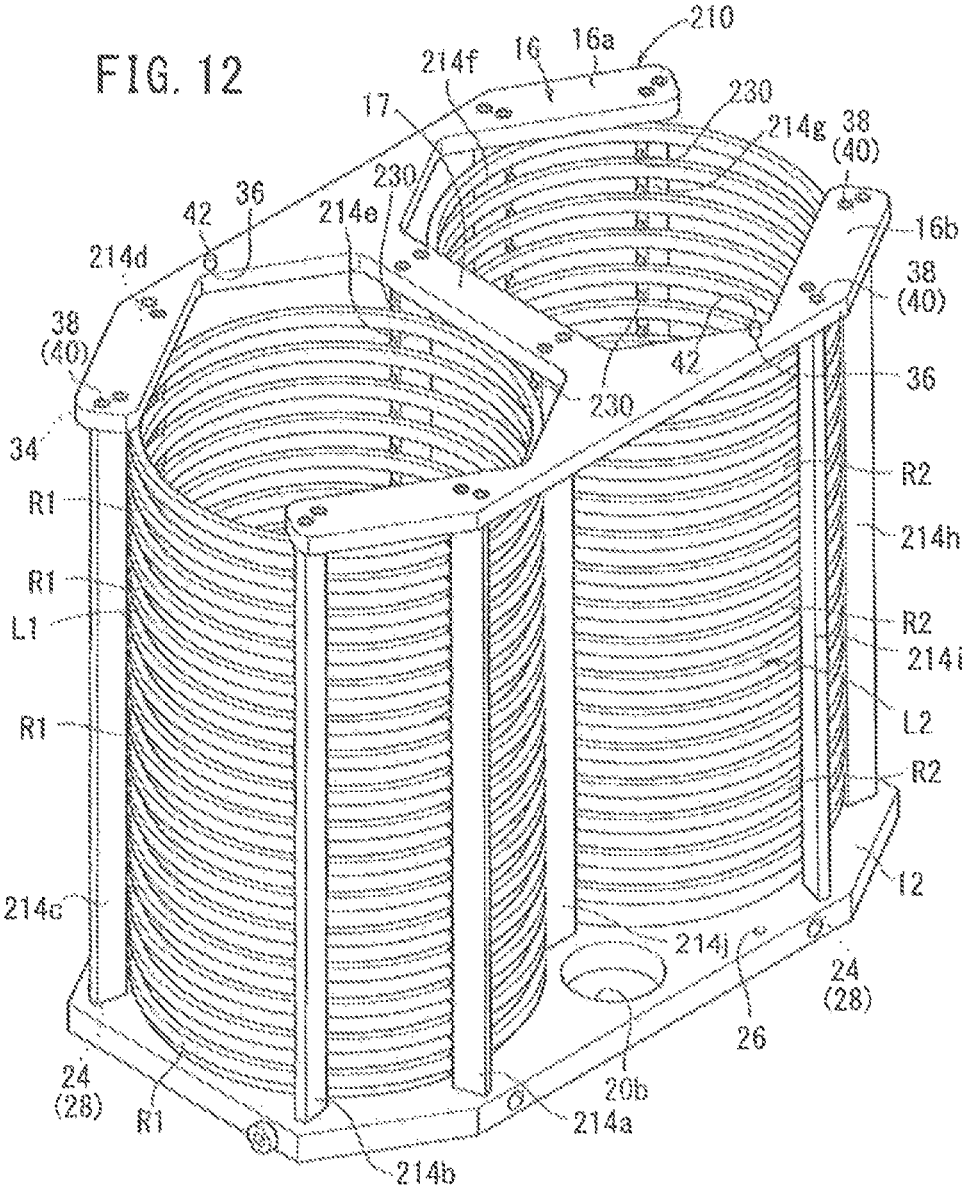
FIG. 12 is an overall outline perspective view showing a condition in which two columns of metal rings are retained in the conveyance rack of FIG. 11.

FIG. 11 is an overall outline perspective view of a conveyance rack 210 according to the second embodiment, and FIG. 12 is an overall outline perspective view showing a condition in which metal rings R1, R2 are retained in the conveyance rack 210. The conveyance rack 210 serves to retain and transport a first column L1 made up of a plurality of metal rings R1, and a second column L2 made up of a plurality of metal rings R2, and includes a base 12, ten retaining shafts 214*a* to 214*j* erected on the base 12, and a connecting plate 16 that connects all of the ten retaining shafts 214*a* to 214*j* together.

Among the retaining shafts 214*a* to 214*j*, the structure of the retaining shafts 214*a* to 214*d*, 214*f* to 214*i* is the same, whereas the structure of the retaining shafts 214*e*, 214*j* is the same.

The base 12 is of a form made by cutting out isosceles right triangles from the long side and over the short sides of a flat plate, to thereby form the base 12 in an octagonal shape. Further, for reducing the weight thereof, large circular openings 18*a*, 18*b* and small circular openings 20*a*, 20*b* are formed to penetrate through the base 12. By forming the large circular openings 18*a*, 18*b* and the small circular openings 20*a*, 20*b*, the base 12 is made lightweight, which as a result, contributes to lessening the weight of the conveyance rack 210.

In this case, as shown in FIG. 11, centers of the large circular openings 18*a*, 18*b* coincide with respective centers O1, O2 of the first column L1 (metal rings R1) and the second column L2 (metal rings R2).

Figure 13:
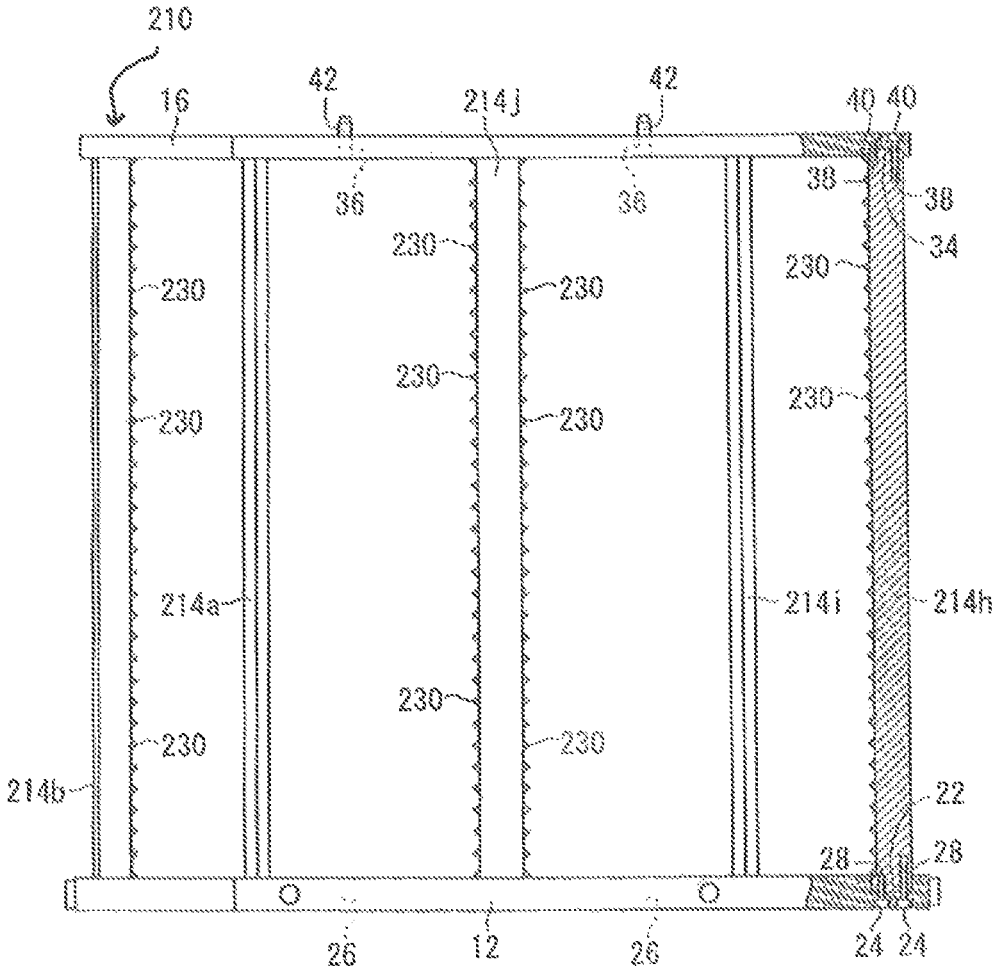
FIG. 13 is a partial vertical cross sectional side view of the conveyance rack of FIG. 11.

Further, as shown in FIG. 13, on the base 12 there are formed retaining shaft insertion recesses 22, bolt insertion holes 24 that penetrate from the lower surface of the base 12 into the retaining shaft insertion recesses 22, and two connecting pin insertion holes 26. Lower ends of the retaining shafts 214*a* to 214*j* are inserted respectively into the retaining shaft insertion recesses 22, and are connected to the base 12 by bolts 28, which are inserted through the bolt insertion holes 24. Owing thereto, the retaining shafts 214*a* to 214*j* are erected in an upstanding manner on the base 12.

Figure 14:
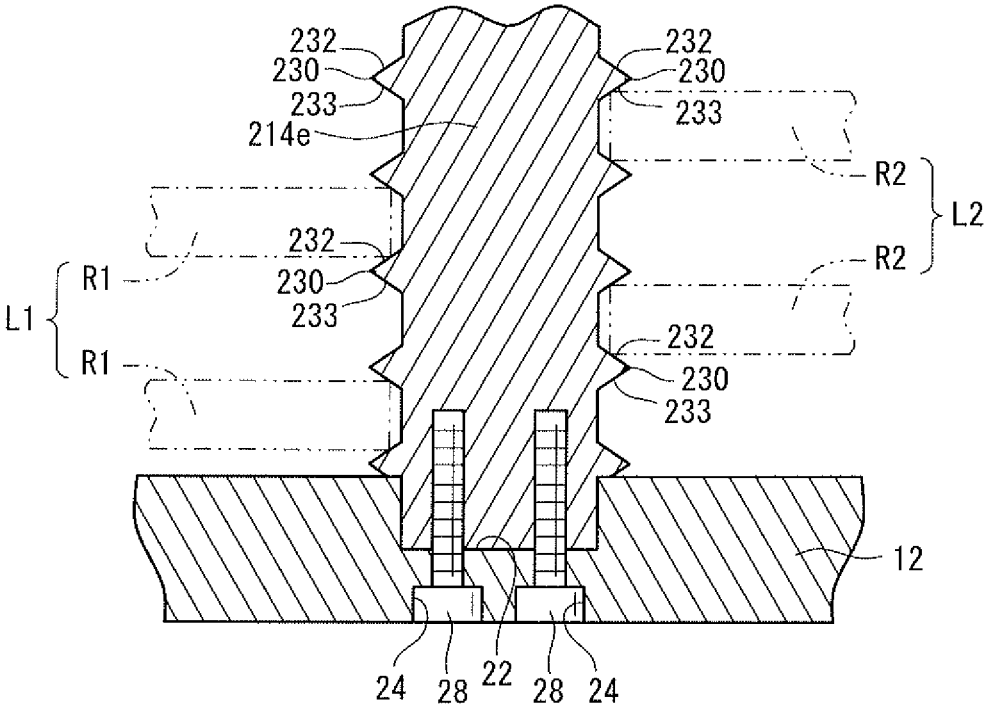
FIG. 14 is an enlarged vertical cross sectional view of essential elements of the conveyance rack of FIG. 11.
Figure 15:
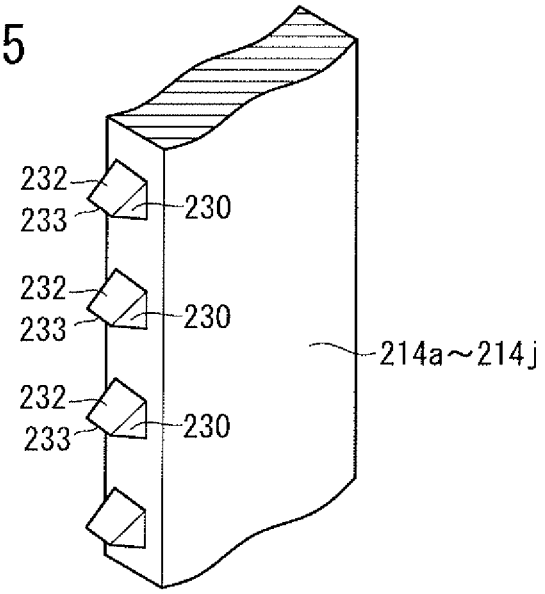
FIG. 15 is an outline perspective view of essential elements of a retaining shaft constituting the conveyance rack of FIG. 11.

FIGS. 14 and 15 are a vertical cross-sectional view and an outline perspective view, respectively, of essential elements of the retaining shaft 214*e*. As can be comprehended from FIGS. 14 and 15, the retaining shaft 214*e* is formed as a solid rectangular columnar body, and is formed with substantially triangular columnar shaped protrusions 230 (hereinafter referred to simply as "protrusions") on two short side surfaces thereof.

As discussed above, the retaining shaft 214*j* is of the same structure as the retaining shaft 214*e*. Further, the remaining retaining shafts 214*a* to 214*d*, 214*f* to 214*i*, apart from the protrusions 230 being formed on only one of the two short side surfaces thereof, are constructed in conformity with the retaining shaft 214*e*.

The retaining shafts 214*a* to 214*e*, 214*j* are arranged to surround the first column L1, whereas the retaining shafts 214*e* to 214*j* are arranged to surround the second column L2. However, the short side surfaces of the retaining shafts 214*a* to 214*j* are disposed to face in directions away from the centers O1, O2 of the metal rings R1, R2, and therefore, the apexes of all of the protrusions 230 also face in directions away from the centers O1, O2 of the metal rings R1, R2 (see FIGS. 11 and 17).

As shown in FIG. 14, the sides (i.e., apexes) of the respective substantially triangular columnar shaped protrusions 230 project from the retaining shafts 214*a* to 214*j* so as to face toward the metal rings R1, R2. Owing thereto, on the protrusions 230, there are formed inclined surfaces 232 that face vertically downward, and inclined surfaces 233 that face vertically upward as the protrusions 230 approach the side of the metal rings R1, R2.

As shown by the two-dot-chain line in FIG. 14, the metal rings R1, R2 are gripped by respective adjacent protrusions 230, 230, and more specifically, are gripped by the lower inclined surface 232 and the upper inclined surface 233 of the protrusions 230. Alternatively, lower end surfaces of the metal rings R1, R2 may be placed on the protrusions 230 that are positioned beneath the metal rings R1, R1, whereas the inclined surface 233 of the upwardly positioned protrusion 230 and upper end surfaces of the metal rings R1, R2 may be separated mutually from each other.

The retaining shafts 214*a* to 214*j* that are shaped in this manner can be fabricated, for example, by forming the protrusions 230 by carrying out a cutting process on solid rectangular columnar bodies from outer wall sides thereof. Alternatively, the rectangular columnar bodies and the protrusions 230 may be fabricated separately, and the protrusions 230 may be attached with respect to short side walls of the rectangular columnar bodies, for example, by boring screw holes into the rectangular columnar bodies, while lower surfaces of the protrusions 230 are provided with threaded round bars thereon for screw engagement with the screw holes, and the threaded round bars are threaded into the screw holes.

Naturally, as shown in FIG. 11, the retaining shafts 214*a* to 214*j* are erected on the base 12 so that the positions of the protrusions 230 are in agreement. Accordingly, the metal rings R1 are interposed between respective protrusions 230 of the retaining shafts 214*a* to 214*e*, 214*j*, and the metal rings R2 are interposed between respective protrusions 230 of the retaining shafts 214*e* to 214*j*. More specifically, among the retaining shafts 214*a* to 214*j*, two of the retaining shafts 214*e* and 214*j* serve to retain both the metal rings R1 and R2 (i.e., the first column L1 and the second column L2).

In the forgoing structure, on respective side wall surfaces of the retaining shafts 214*a* to 214*j*, a nickel film is formed, for example, by carrying out a nickel plating process thereon. Instead of forming a nickel film, the retaining shafts 214*a* to 214*j* may be constituted entirely from nickel.

The connecting plate 16 is substantially H-shaped in form, having long bar parts 16*a*, 16*b* that extend mutually in parallel, and a short bar part 17 that bridges roughly central portions of the long bar parts 16*a*, 16*b*. The connecting plate 16, which is shaped in this manner, is remarkably lighter in weight compared to a flat plate shaped connecting plate. More specifically, by forming the connecting plate 16 to be H-shaped, the connecting plate 16, and consequently the conveyance rack 10, can be made even lighter in weight.

Ends of the long bar parts 16*a*, 16*b* are made to approach each other. As a result, roughly C-shaped portions are formed by roughly half of the long bar parts 16*a*, 16*b* and the short bar part 17. Stated otherwise, two substantially C-shaped openings are formed on the connecting plate 16.

Further, retaining shaft insertion recesses 34 are formed in a depressed fashion on the lower surface of the connecting plate 16, at positions corresponding to the retaining shaft insertion recesses 22 in the base 12, whereas on the upper surface thereof, connecting pin fixing holes 36 are formed at positions corresponding to the positions of the connecting pin insertion holes 26 on the base 12. Moreover, bolt insertion holes 38 are formed to penetrate from the upper end surface of the connecting plate 16 to the retaining shaft insertion recesses 34. Respective upper ends of the retaining shafts 214*a* to 214*j* are inserted into the retaining shaft insertion recesses 34, and are connected to the connecting plate 16 by bolts 40, which are inserted into the bolt insertion holes 38.

On the other hand, screw threads are engraved on inner walls of the connecting pin fixing holes 36. Connecting pins 42, the side walls of which are formed with threads, are screw-engaged in the connecting pin fixing holes 36. As described later, in the case that respective conveyance racks 210 are stacked on one another, the connecting pins 42 are inserted into the connecting pin insertion holes 26 of the base 12 of the upper conveyance rack 210.

The conveyance rack 210 according to the second embodiment is constructed basically as described above. Next, effects and advantages of the conveyance rack 210 shall be described in relation to a heat treatment method on the metal rings R1, R2, which is conducted using the conveyance rack 210.

At first, before the connecting plate 16 is connected to the retaining shafts 214*a* to 214*j*, the metal rings R1, R2 are retained by the retaining shafts 214*a* to 214*j* as the first column L1 and the second column L2. Of course, the retaining shafts 214*a* to 214*j* are erected beforehand on the base 12 through the bolts 28, which are inserted respectively into the bolt insertion holes 24.

The metal rings R1, R2 are fabricated, for example, by cutting a cylindrical drum made from maraging steel into predetermined widths, and possess an elastic restorative force with respect to being pressed. More specifically, when such a pressing force is released, the metal rings R1, R2 return to their original shape due to an elastic action thereof.

Plural metal rings R1, which are constituted in this manner, are gripped from the outer circumferential side thereof by a non-illustrated gripping device. At this time, a gripping force (pressing force) is imposed on the metal rings R1 through the gripping device, whereby all of the metal rings R1 are deformed in an elliptical shape or a substantially hexagonal shape, for example. Stated otherwise, the metal rings R1 are gripped by the gripping device under a condition of being deformed in an elliptical shape or a substantially hexagonal shape or the like. Naturally, deformation thereof is carried out within a range in which the metal rings R1 remain elastic.

The plural metal rings R1, which have been deformed in an elliptical shape or the like, are transferred to a position between the retaining shafts 214*a* to 214*e*, 214*j*. The aforementioned gripping device is stopped in the heightwise direction of the retaining shafts 214*a* to 214*e*, 214*j*, at a position at which the metal rings R1 are arranged respectively between adjacent protrusions 230.

Thereafter, all of the metal rings R1 are released simultaneously from the gripping force of the aforementioned gripping device, along with the metal rings R1 being restored to their original substantially true circular shape due to the elastic restorative force. At this time, the respective metal rings R1 are interposed between the protrusions 230 of the retaining shafts 214*a* to 214*e*, 214*j*, and as a result, as shown in FIG. 12, the plural metal rings R1 are retained simultaneously by the retaining shafts 214*a* to 214*e*, 214*j* as the first column L1.

Next, the gripping device simultaneously grips the plural metal rings R2, which are deformed in the same elliptical shape or the like as mentioned above, and in this state, the metal rings R2 are transferred to a position between the retaining shafts 214*e* to 214*j*. Thereafter, similar to the above, after the gripping device is stopped at a position in which the metal rings R2 are arranged respectively between the adjacent protrusions 230 of the retaining shafts 214*e* to 214*j*, all of the metal rings R2 are released simultaneously from the gripping force of the gripping device. Along with being released, all of the metal rings R2 are restored to their original substantially true circular shape, such that outer walls thereof are interposed respectively between respective protrusions 230 of the retaining shafts 214*e* to 214*j*. As a result, the plural metal rings R2 are retained by the retaining shafts 214*e* to 214*j* as the second column L2. The metal rings R1, R2 are retained at different levels to avoid mutual interference therebetween.

Figure 16:
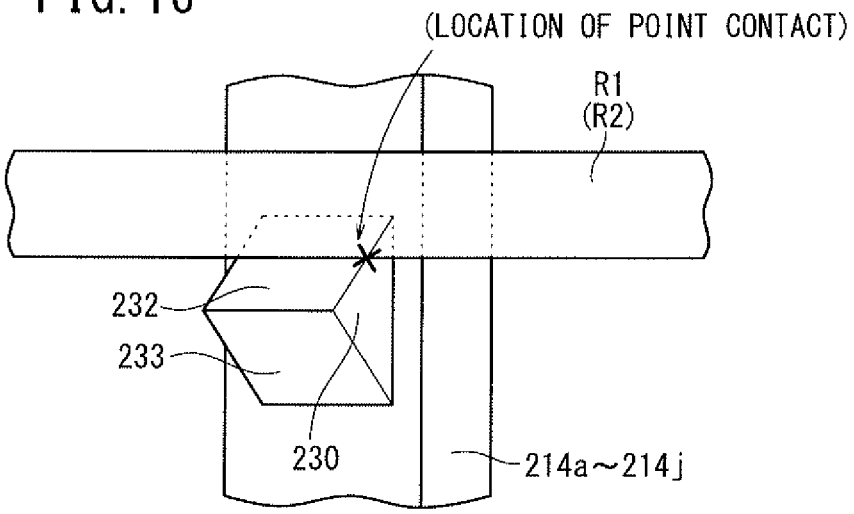
FIG. 16 is a front view of essential elements from the center of a metal ring, showing a condition in which a lower end surface of the metal ring is in point contact with a retaining protrusion shown in FIG. 15.

At this time, as shown in FIG. 16, the lower end surface of the metal ring R1 (R2) contacts the inclined surface 232 on the protrusion 230. Because the apex of the protrusion 230 faces toward a direction away from the center O1 (O2) of the metal ring R1 (R2), the lower end surface of the metal ring R1 (R2) is in point contact, only at the location (point) shown by the character x, with respect to the inclined surface 232. More specifically, the metal rings R1 (R2) and the protrusions 230 are placed in a state of point contact with each other. In the foregoing explanations and in FIG. 16, for the sake of convenience, the protrusion 230 that is positioned on the upper end surface side of the metal ring R1 (R2) is omitted, and explanations have been given only concerning the lower end surface side. However, in a similar manner, the upper end surfaces of the metal rings R1 (R2) also are in point contact with respect to the inclined surface 233 of the upwardly positioned protrusions 230.

Figure 17:
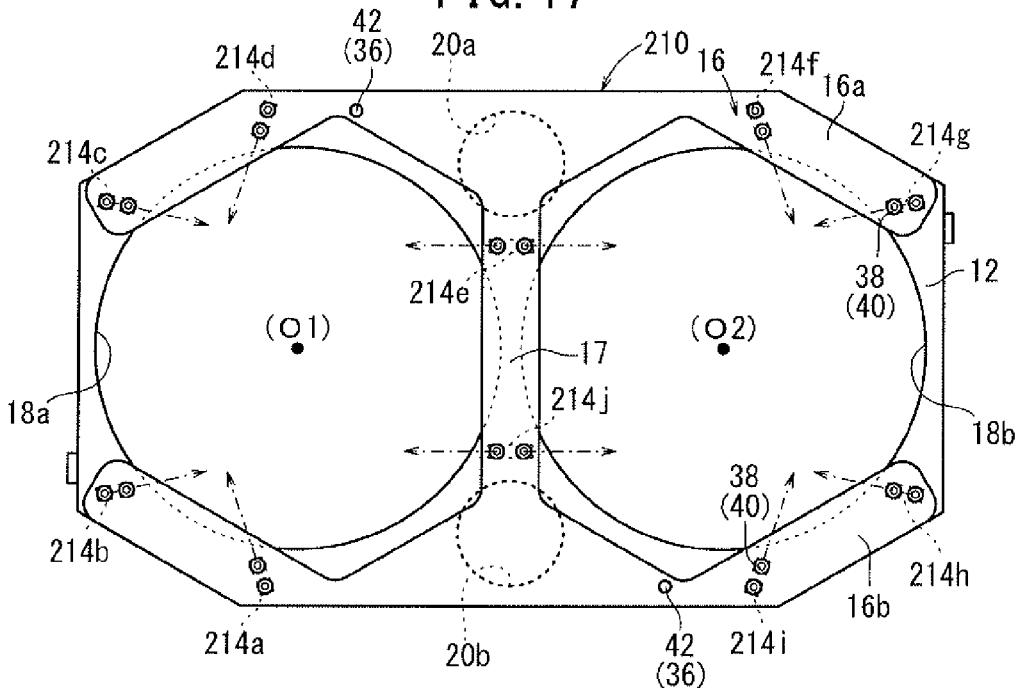
FIG. 17 is an upper plan view of the conveyance rack of FIG. 11.

Once the metal rings R1, R2 have been retained in the foregoing manner, upper ends of the retaining shafts 214*a* to 214*j* are inserted into the retaining shaft insertion recesses 34 formed on the lower surface of the connecting plate 16. Thereafter, as shown in FIG. 17, respective upper ends of the retaining shafts 214*a* to 214*j* are connected with respect to the connecting plate 16. (In FIG. 17, the metal rings R1, R2 have been omitted from illustration, in order to show the positional relationship between the base 12, the retaining shafts 214*a* to 214*j*, and the connecting plate 16.) Further, when needed, connecting pins 42 are threaded into screw-engagement with the connecting pin fixing holes 36.

In accordance with the above steps, the metal rings R1, R2 and the conveyance rack 210 are placed in the condition shown in FIG. 12. The connecting plate 16 interconnects the retaining shafts 214*a* to 214*j*, whereby the retaining shafts 214*a* to 214*j* are prevented from inclining, and falling out of the metal rings R1, R2 from the retaining shafts 214*a* to 214*j* due to inclination thereof also is prevented.

In this manner, in the case that the connecting plate 16 is connected after the metal rings R1, R2 have been retained by the retaining shafts 214*a* to 214*j*, a simple structure can be utilized as the aforementioned gripping device. The metal rings R1, R2 may also be retained by the retaining shafts 214*a* to 214*j* after the connecting plate 16 has been connected to respective upper ends of the retaining shafts 214*a* to 214*j* that have been erected on the base 12, although in this case, it is necessary to use a gripping device which is slightly more complex than the aforementioned gripping device, and for which control to transfer the metal rings R1, R2 must be performed somewhat more precisely. In this case, the metal rings R1, R2 may be inserted from between two adjacent shafts from among the retaining shafts 214*a* to 214*j*.

Alternatively, the metal rings R1, R2 may be gripped while being deformed in a substantially hexagonal shape, within a range in which the metal rings R1, R2 remain elastic, by a non-illustrated gripping device. In this case, after the upper ends of the retaining shafts 14*a* to 14*j*, which are erected on the base 12, have been connected to the substantially H-shaped connecting plate 16, the gripping device is inserted into the C-shaped openings. In this state, along with the metal rings R1, R2 being released from the gripping device, the metal rings R1, R2, which have been restored under the elasticity thereof, are gripped between the retaining shafts 14*a* to 14*j*.

Figure 18:
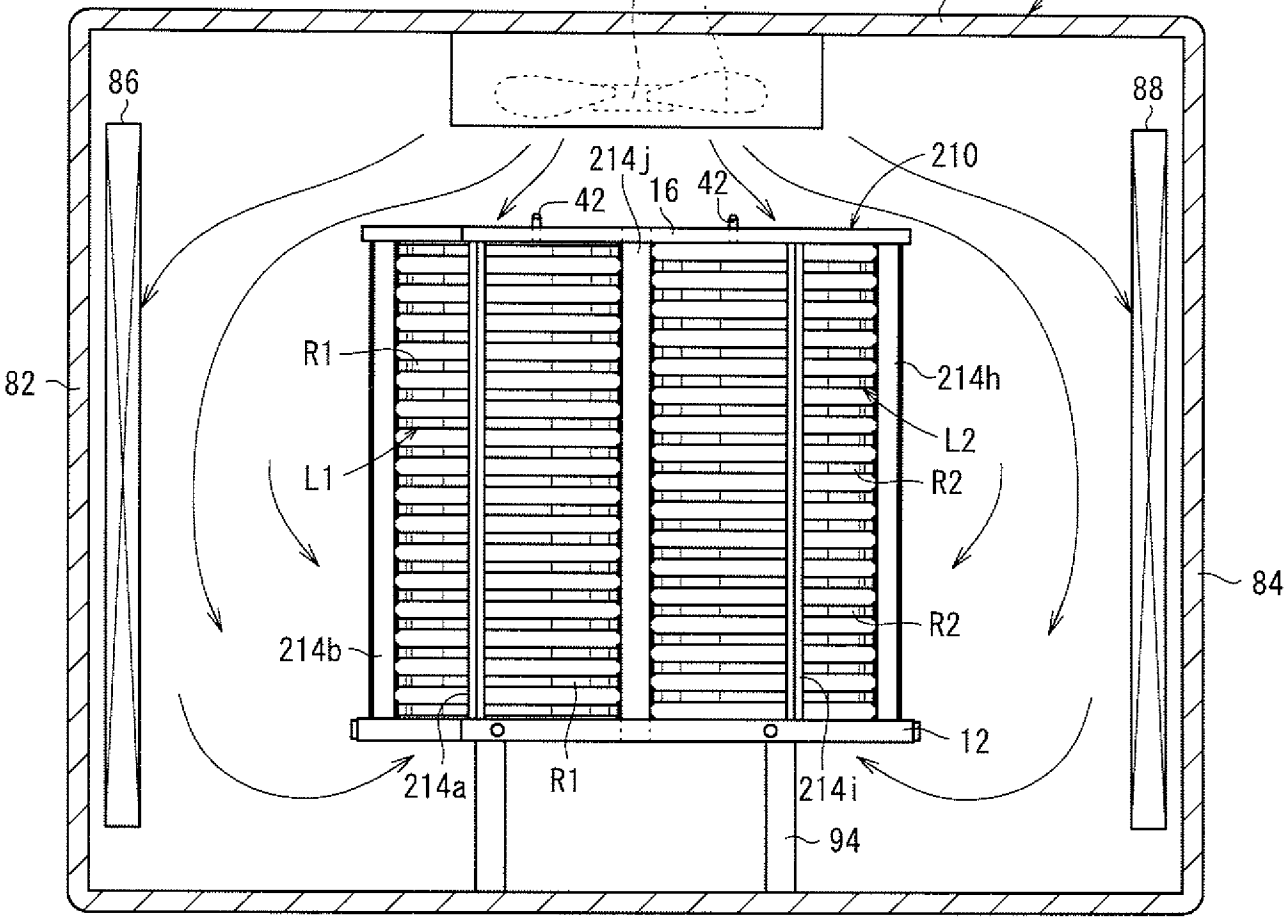
FIG. 18 is a vertical cross sectional front view showing a condition in which the conveyance rack is introduced into a heat treatment furnace.

Next, the metal rings R1, R2 are transported together with the conveyance rack 210 into the interior of the heat treatment furnace 80 shown in FIG. 18, under the action of a non-illustrated transfer. As noted above, large circular openings 18*a*, 18*b* and small circular openings 20*a*, 20*b* are formed to penetrate through the base 12 that constitutes the conveyance rack 210, whereas the connecting plate 16 is formed in a substantially H-shape. Accordingly, the conveyance rack 210 is lighter in weight compared to a conveyance rack comprising a base and a connecting plate that are shaped as flat plates.

Furthermore, because the two centrally located retaining shafts 214*e*, 214*j* retain both the first column L1 of the metal rings R1 and the second column L2 of the metal rings R2, an increase in the number of retaining shafts can be avoided. By adopting such a structure, the retaining shafts 214*a* to 214*j* contribute greatly to reducing the weight thereof and thus of the conveyance rack 210.

Owing thereto, the conveyance rack 210 can easily be transported. Further, less electrical power or the like is required to transport the conveyance rack 210.

The heat treatment furnace 80 is formed with a longitudinal dimension along the direction in which the conveyance rack 210 is transported, and is constituted by providing heaters 86, 88 on the inside of side walls 82, 84, and a convection fan 92 on the ceiling wall 90. The conveyance rack 210, which is supported on the aforementioned transfer via a mounting jig 94, is conveyed into the heat treatment furnace 80 together with the mounting jig 94.

A nitriding treatment shall be described as an example of the heat treatment process. A nitriding gas, for example, such as ammonia or the like, is supplied to the interior of the heat treatment furnace 80 shown in FIG. 18. The nitriding gas is heated to a predetermined temperature, for example, 500° C., under the action of the heaters 86, 88, so as to enable nitriding of the metal rings R1, R2.

Along with the rise in temperature, the metal rings R1, R2 receive radiant heat, and thermal expansion is induced therein such that the metal rings R1, R2 approach the retaining shafts 214*a* to 214*j*.

As noted above, upper end surfaces and lower end surfaces of the metal rings R1, R2 are retained in a condition of point contact with respect to the protrusions 230 (see FIG. 16 concerning the lower end side). Thus, the restraining force of the protrusions 230 with respect to the metal rings R1, R2 is small. Owing thereto, the metal rings R1, R2 can thermally expand without being obstructed by the protrusions 230.

More specifically, in the second embodiment as well, suppression of thermal expansion of the metal rings R1, R2 can be avoided. Thus, concerns over the occurrence of strain on the metal rings R1, R2 can be dispensed with.

The nitriding gas, which has risen in temperature, rises toward the ceiling wall 90 of the heat treatment furnace 80 (see FIG. 18). In the second embodiment also, the convection fan 92 is energized to rotate the agitating blades 96, whereby the nitriding gas inside the heat treatment furnace 80 is subjected to convection. Consequently, the nitriding gas descends along the side walls, and the mounting jig 94, and then rises again in the vicinity of the conveyance rack 210.

In the foregoing manner, the lower surfaces and upper surfaces of the metal rings R1, R2 are in a state of point contact with respect to the protrusions 230. More specifically, the area of contact between the metal rings R1, R2 and the protrusions 230 is extremely small. Owing thereto, the nitriding gas can wrap around and enter sufficiently into the vicinity of the contact locations between the metal rings R1, R2 and the protrusions 230.

Stated otherwise, according to the second embodiment, the nitriding gas comes into contact with substantially the entirety of the metal rings R1, R2. Further, heat transfer between the metal rings R1, R2 and the protrusions 230 is suppressed to a minimum, and therefore the temperature of the metal rings R1, R2 is substantially uniform over the entirety thereof. In other words, the temperature at the contact points between the retaining shafts 214*a* to 214*j* and the metal rings R1, R2 is substantially the same as the temperature at other locations on the metal rings R1, R2.

For this reason, nitriding progresses substantially uniformly over the entirety of the metal rings R1, R2. More specifically, variations in the progression of nitriding are avoided, and therefore, the thickness of the nitriding layer, and thus variations in the degree of hardening of the metal rings R1, R2 can be avoided.

In this manner, according to the second embodiment, in which the protrusions 230 disposed on the retaining shafts 214*a* to 214*j* and the metal rings R1, R2 are placed in a state of point contact, similar to the first embodiment, the temperature of the metal rings R1, R2 can be kept substantially the same over the entirety thereof, and the nitriding gas can come into contact with substantially the entirety of the metal rings R1, R2. Consequently, nitriding is substantially uniform over the entirety of the metal rings R1, R2, and thus the rings R1, R2 can be hardened substantially uniformly.

Further, because a nickel film is formed on side wall surfaces of the retaining shafts 214*a* to 214*j*, constituent elements of the retaining shafts 214*a* to 214*j* are prevented from diffusing into the metal rings R1, R2 during the nitriding process. More specifically, the nickel film functions as a barrier with respect to diffusion of constituent elements of the retaining shafts 214*a* to 214*j* into the metal rings R1, R2. Naturally, the same effects can be achieved if the retaining shafts 214*a* to 214*j* are constituted entirely from nickel.

In this manner, after the metal rings R1, R2 have been subjected to the nitriding process, the conveyance rack 210 is taken out of the heat treatment furnace 80. Thereafter, the nuts 48 are loosened, the connecting plate 16 is removed from the retaining shafts 214*a* to 214*j*, and the metal rings R1, R2 are exposed.

The exposed metal rings R1, R2 are gripped by the gripping device, are removed from the retaining shafts 214*a* to 214*j* while being deformed in a elliptical shape or the like, and are transported to a predetermined station or storage location. Of course, the metal rings R1, R2, upon being released from the gripping device, are restored to their substantially true circular shape due to their elastic action.

Henceforth, when another new batch of metal rings R1, R2 is retained, the conveyance rack 210 including the retaining shafts 214*a* to 214*j* fabricated in the foregoing manner is reused repeatedly.

Figure 19:
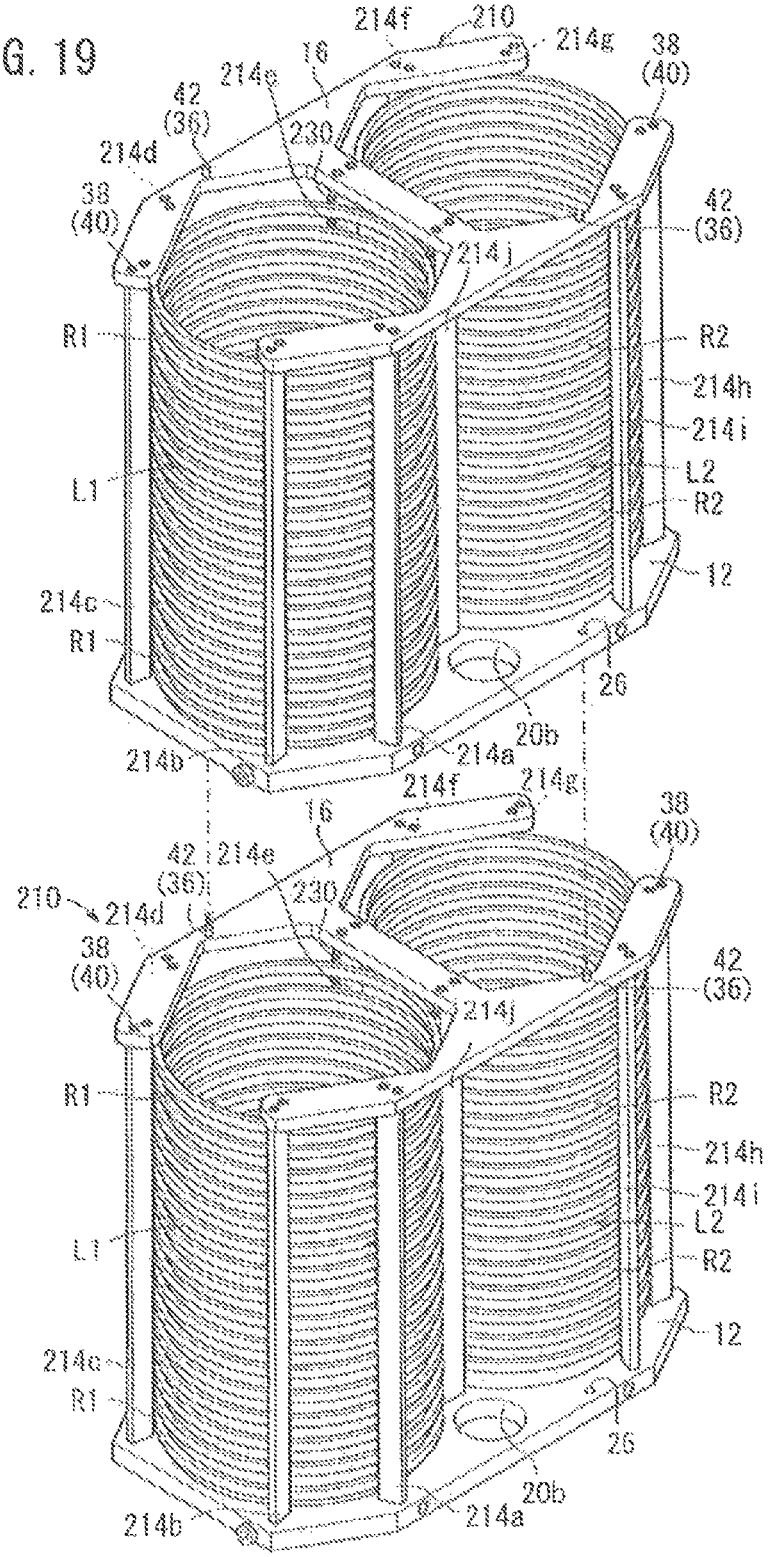
FIG. 19 is an exploded perspective view during stacking of conveyance racks.
Figure 20:
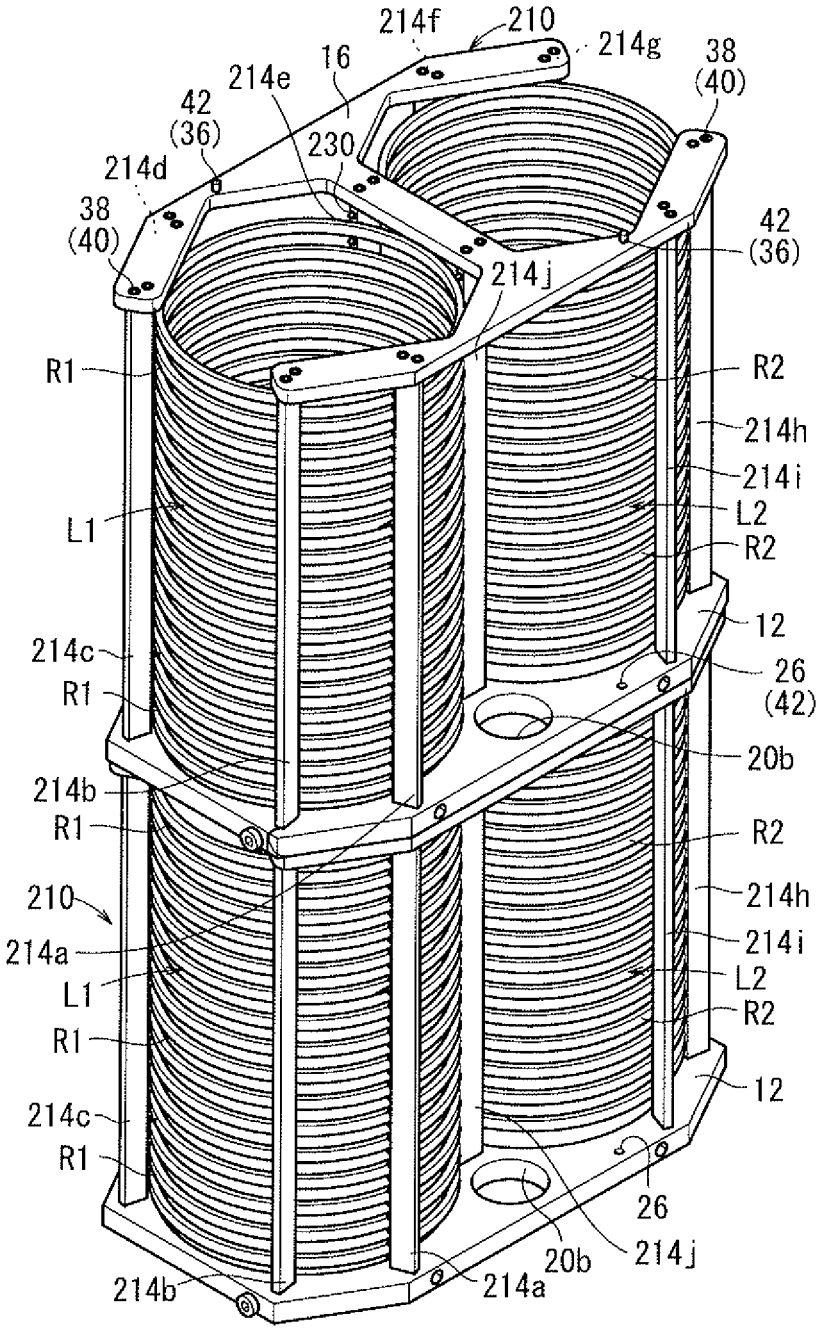
FIG. 20 is an overall outline perspective view showing a condition in which the conveyance racks from FIG. 19 are stacked.

In FIG. 18, a case is shown in which the conveyance rack 210 is transported into the heat treatment furnace 80 in a non-stacked state. However, if a large capacity heat treatment furnace is used, then as shown in FIGS. 19 and 20, respective conveyance racks 210, 210 may be stacked on each other through connecting pins 42, and transported into the interior of the heat treatment furnace in this state.

Similarly, it is a matter of course that the conveyance racks 210 may be stacked in three or more levels.

In the above embodiment, the connecting plate 16 is used. However, the conveyance rack may also be constructed only from the base 12 and the retaining shafts 214*a* to 214*j* without using the connecting plate 16.

Further, in this embodiment, the metal rings R1, R2 are retained by ten retaining shafts 214*a* to 214*j* as the first column L1 and the second column L2. However, in this case, it is sufficient if there are at least four retaining shafts.

Furthermore, an example has been described in which metal rings R1, R2 that make up a CVT belt are exemplified as the workpieces, which are subjected to a nitriding process. However, the workpieces and the heat treatment carried out thereon are not particularly limited. For example, in the case that ring members requiring a carburizing process are taken as workpieces, a carburizing gas may be supplied instead of the aforementioned nitriding gas.

Still further, it is not particularly required for the metal rings R1, R2 to be gripped between respective adjacent protrusions 230, 230. As noted above, the lower end surfaces of the metal rings R1, R2 may be placed in point contact with respect to inclined surfaces 232 of the protrusions 230 that are positioned beneath the metal rings R1, R2, and may be supported only by such point contact therewith.

On the protrusions 230, it is sufficient if the inclined surfaces 232 exist, which face vertically downward, without the need for the inclined surfaces 233. More specifically, for example, protrusions may be provided, the lower sides of which are disposed perpendicularly with respect to the retaining shafts 214*a* to 214*j*.

Further, the protrusions in the second embodiment are not limited in particular to the protrusions 230 made from triangular columnar shaped bodies having the inclined surfaces 232. Apexes thereof may also be frustoconical shaped or conical shaped bodies that face toward the metal rings R1, R2.

Figure 21:
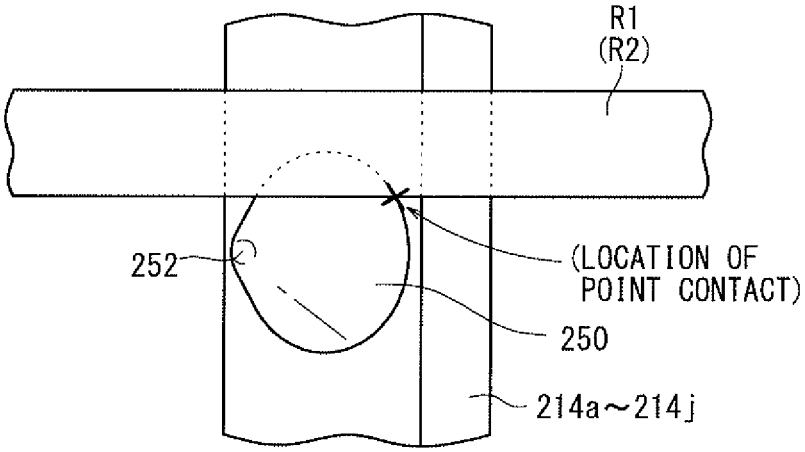
FIG. 21 is a front view of essential elements from the center of a metal ring in the second embodiment, showing a condition in which a lower end surface of the metal ring is in point contact with another form of retaining protrusion.

FIG. 21 shows essential elements of the retaining shaft, which is equipped with protrusions 252 having tapered reduced-diameter portions 250 having conical shaped bodies. Naturally, in this case as well, orientations of the short side surfaces of the retaining shafts 214*a* to 214*j* are set such that apexes of the protrusions 252 are directed away from the centers O1, O2 of the metal rings R1, R2 (see FIG. 11).

As can be understood from FIG. 21, in this case as well, the metal rings R1, R2 are in point contact with respect to the tapered reduced-diameter portions 250 of the protrusions 252.

Next, a third embodiment shall be described, in which a conveyance rack is equipped with retaining shafts formed from cylindrical shaped bodies. Structural features of the conveyance rack, which are the same as those of the conveyance rack 10 according to the first embodiment and the conveyance rack 210 according to the second embodiment, are designated by the same reference characters.

Figure 22:
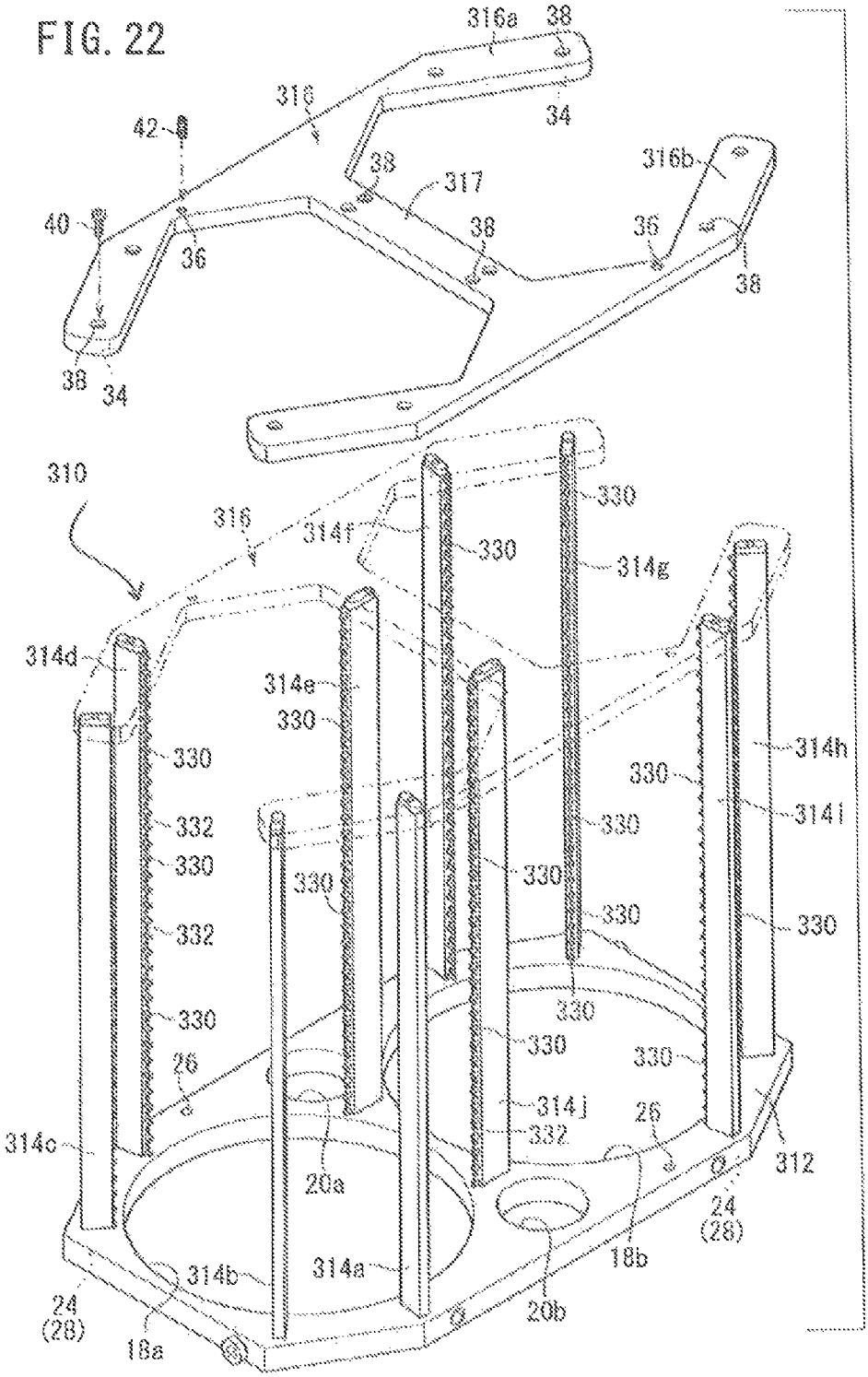
FIG. 22 is an overall outline perspective view of a conveyance rack according to a third embodiment.
Figure 23:
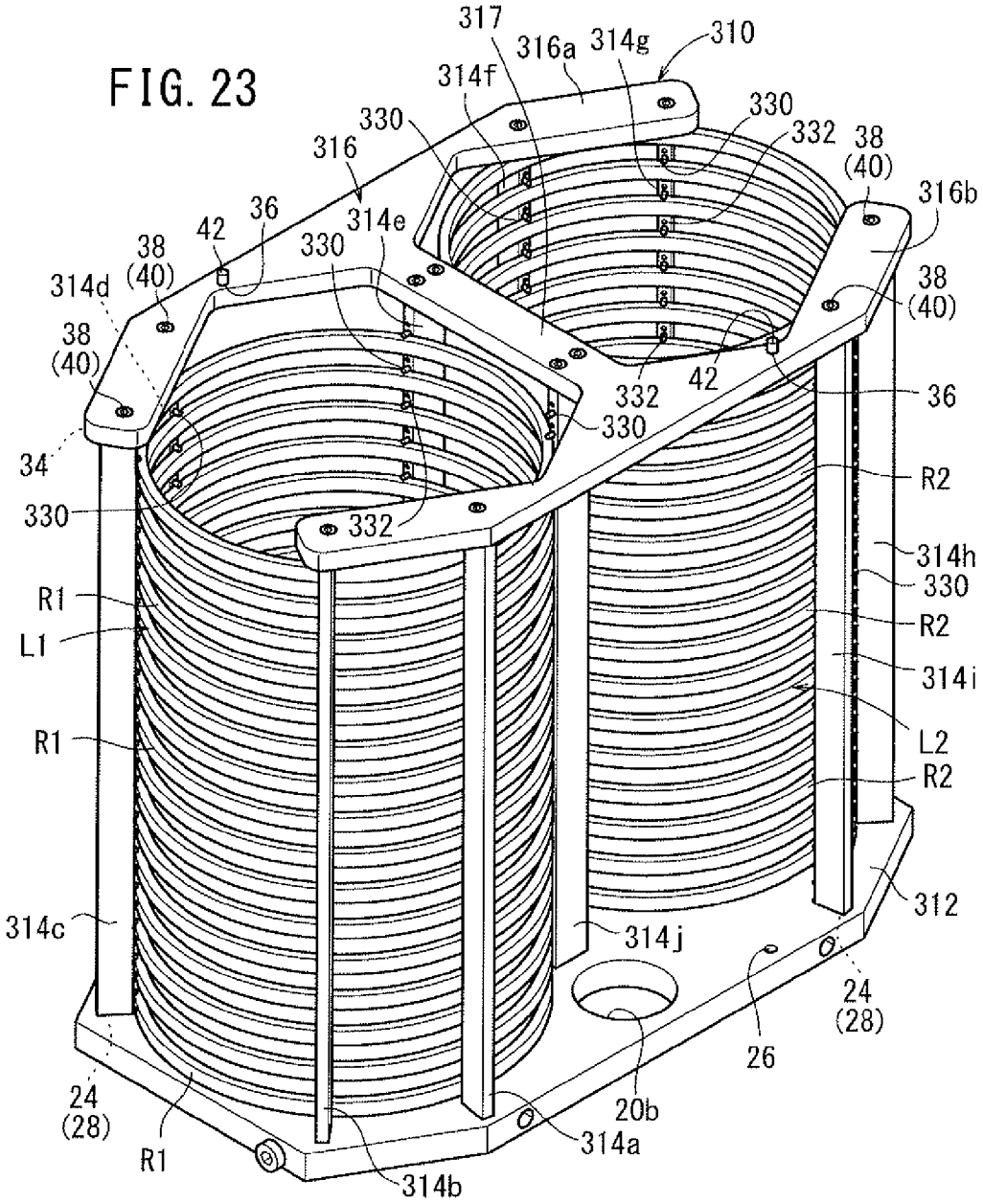
FIG. 23 is an overall outline perspective view showing a condition in which two columns of metal rings are retained in the conveyance rack of FIG. 22.

FIG. 22 is an overall outline perspective view of a conveyance rack 310 according to the third embodiment, and FIG. 23 is an overall outline perspective view showing a condition in which metal rings R1, R2 are retained in the conveyance rack 310. The conveyance rack 310 serves to retain and transport a first column L1 made up of a plurality of metal rings R1, and a second column L2 made up of a plurality of metal rings R2, and includes a base 312, ten retaining shafts 314*a* to 314*j* erected on the base 312, and a connecting plate 316 that connects all of the ten retaining shafts 314*a* to 314*j* together.

Among the retaining shafts 314*a* to 314*j*, the structure of the retaining shafts 314*a* to 314*d*, 314*f* to 314*i* is the same, whereas the structure of the retaining shafts 314*e*, 314*j* is the same.

The base 312 is of a form made by cutting out isosceles right triangles from the long side and over the short sides of a flat plate, to thereby form the base 312 in an octagonal shape. Further, for reducing the weight thereof, large circular openings 18*a*, 18*b* and small circular openings 20*a*, 20*b* are formed to penetrate through the base 312. By forming the large circular openings 18*a*, 18*b* and the small circular openings 20*a*, 20*b*, the base 312 is made lightweight, which as a result, contributes to lessening the weight of the conveyance rack 310.

Figure 24:
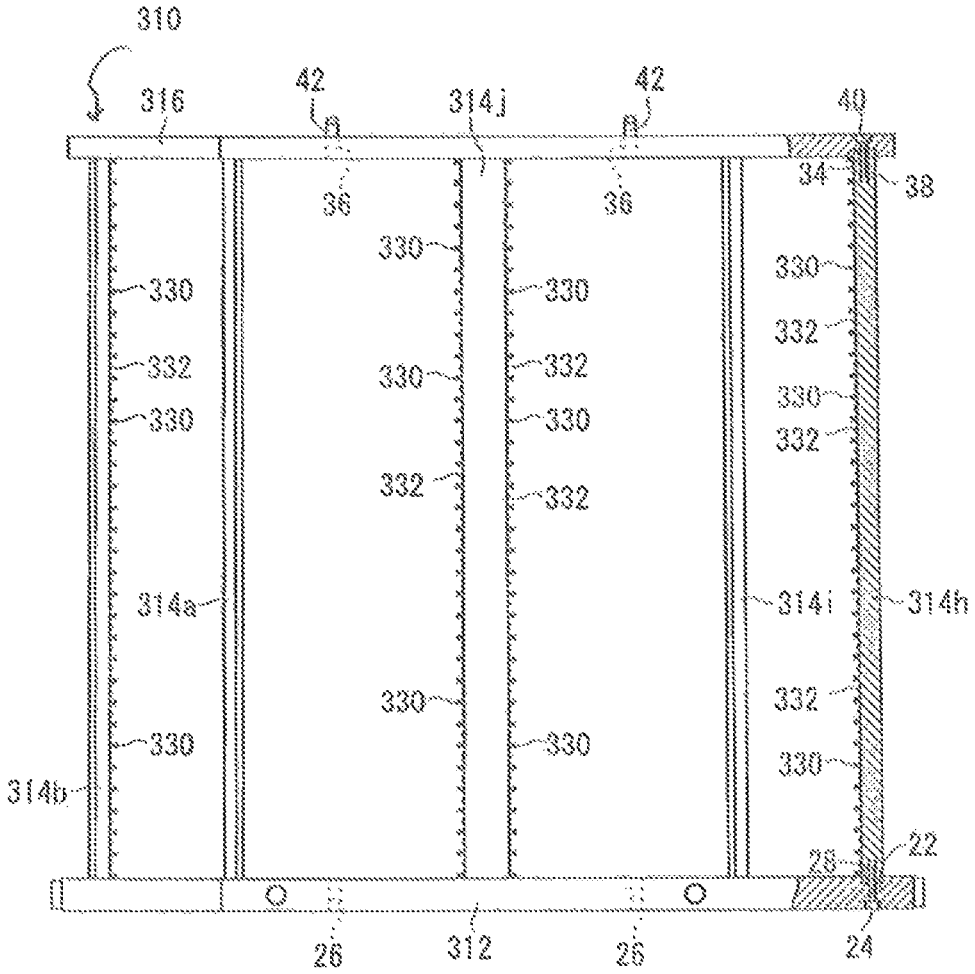
FIG. 24 is a partial vertical cross sectional side view of the conveyance rack of FIG. 22.

Further, as shown in FIG. 24, on the base 312 there are formed retaining shaft insertion recesses 22, bolt insertion holes 24 that penetrate from the lower surface of the base 312 into the retaining shaft insertion recesses 22, and two connecting pin insertion holes 26. Lower ends of the retaining shafts 314*a* to 314*j* are inserted respectively into the retaining shaft insertion recesses 22, and are connected to the base 312 by bolts 28, which are inserted through the bolt insertion holes 24. Owing thereto, the retaining shafts 314*a* to 314*j* are erected in an upstanding manner on the base 312.

Figure 25:
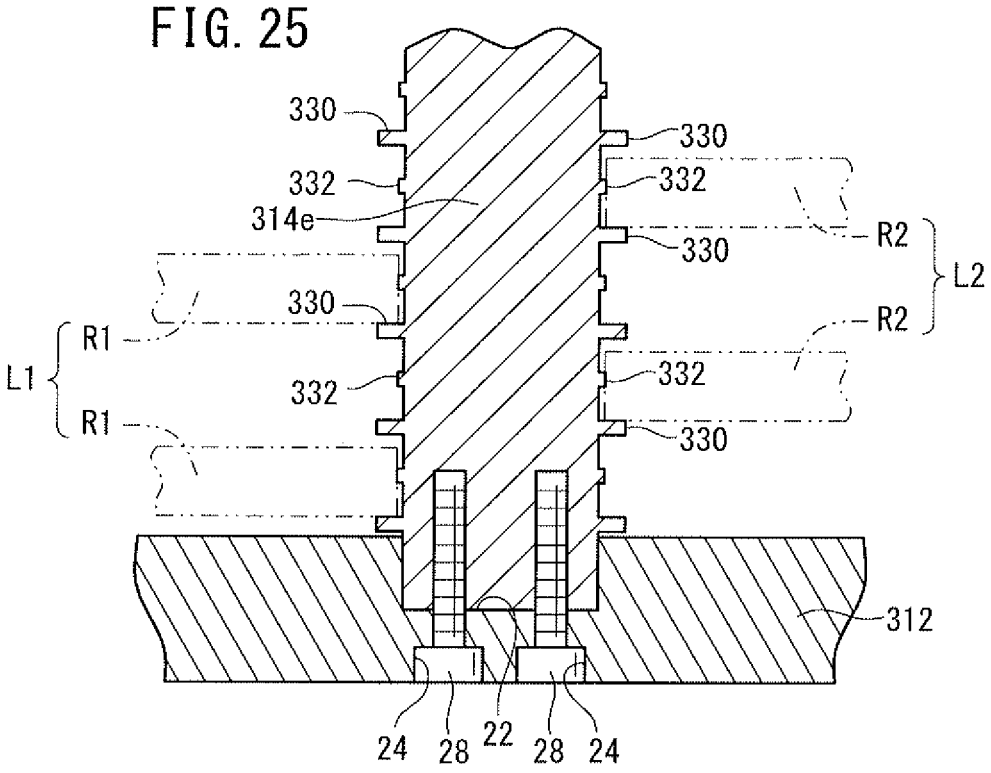
FIG. 25 is an enlarged vertical cross sectional view of essential elements of the conveyance rack of FIG. 22.
Figure 26:
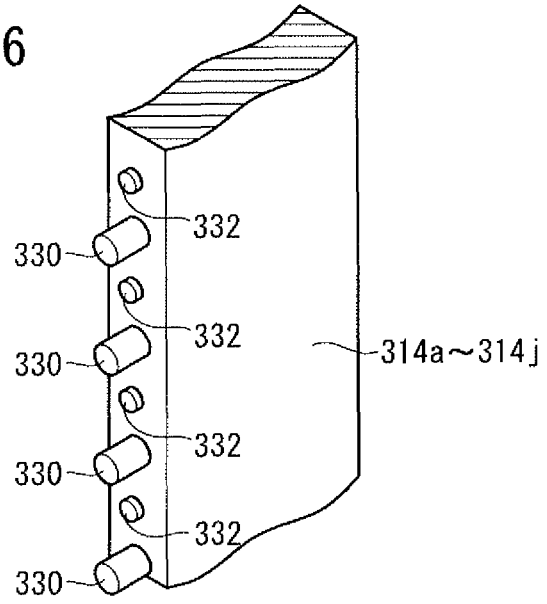
FIG. 26 is an outline perspective view of essential elements of a retaining shaft constituting the conveyance rack of FIG. 22.

FIGS. 25 and 26 are a vertical cross-sectional view and an outline perspective view, respectively, of essential elements of the retaining shaft 314*e*. As can be comprehended from FIGS. 25 and 26, the retaining shaft 314*e* is formed as a rectangular columnar body, and is formed with a plurality of substantially cylindrical shaped mounting protrusions 330 and blocking projections 332 on the two short side surfaces thereof.

As discussed above, the retaining shaft 314*j* is of the same structure as the retaining shaft 314*e*. Further, the remaining retaining shafts 314*a* to 314*d*, 314*f* to 314*i*, apart from the mounting protrusions 330 and the blocking projections 332 being formed on only one of the two short side surfaces thereof, are constructed in conformity with the retaining shaft 314*e*.

Respective apexes of the mounting protrusions 330 of the retaining shafts 314*a* to 314*d*, 314*f* to 314*i* are disposed to point toward the center of the metal rings R1, R2. On the other hand, the apexes of the mounting protrusions 330 of the retaining shafts 314*e*, 314*j* face toward the metal rings R1, R2 and extend so as to point in the longitudinal direction of the base 312.

If the diameters of the mounting protrusions 330 are excessively large, the circumferential dimension thereof becomes large, and therefore, the mounting protrusions 330 come into line contact with respect to the metal rings R1, R2. In order to avoid this problem, in the third embodiment, the respective diameters of the mounting protrusions 330 should be set to a dimension that enables point contact with respect to the metal rings R1, R2.

The blocking projections 332 also are formed as cylindrical bodies, each of the blocking projections 332 being disposed between mutually adjacent mounting protrusions 330, 330. Further, the axial direction (heightwise dimension) of the respective blocking projections 332 extending toward the metal rings R1, R2 is set to be smaller compared to the mounting protrusions 330.

As shown by the two-dot-chain line in FIG. 25, the metal rings R1, R2 are inserted between respective adjacent mounting protrusions 330, 330. However, respective lower end surfaces of the metal rings R1, R2 are mounted in a point contact condition only on the mounting protrusions 330 that are positioned therebeneath, while the upper end surfaces thereof are separated from the mounting protrusions 330 that are positioned thereabove. More specifically, the metal rings R1, R2 do not abut against the mounting protrusions 330 positioned thereabove.

On the other hand, side walls of the metal rings R1, R2 abut against the top surfaces of the respective blocking projections 332. The metal rings R1, R2 press the blocking projections 332 by the expansive force thereof toward sides of the retaining shafts 314*a* to 314*j*. Stated otherwise, the metal rings R1, R2 are pressed from each of the blocking projections 332 of the retaining shafts 314*a* to 314*j*, whereby the metal rings R1, R2 are slightly compressed in a diametrical inward direction, and are blocked by the blocking projections 332, in a state in which an elastic deforming force (expansive force) thereof acts in a direction to restore the metal rings R1, R2 to their original diameter.

The retaining shafts 314*a* to 314*j* that are shaped in this manner can be fabricated, for example, by forming the mounting protrusions 330 by carrying out a cutting process on solid rectangular columnar bodies from outer wall sides thereof. Alternatively, the rectangular columnar bodies and the mounting protrusions 330 may be fabricated separately, and the mounting protrusions 330 may be attached with respect to short side walls of the rectangular columnar bodies, for example, by boring screw holes into the short side walls of rectangular columnar bodies, while lower surfaces of the mounting protrusions 330 are provided with threaded round bars thereon for screw engagement with the screw holes, and the threaded round bars are threaded into the screw holes.

Naturally, as shown in FIG. 22, the retaining shafts 314*a* to 314*j* are erected on the base 312 so that the positions of the mounting protrusions 330 and the blocking projections 332 are in agreement. Accordingly, lower end surfaces of the metal rings R1 are mounted on respective mounting protrusions 330 of the retaining shafts 314*a* to 314*e*, 314*j*, and the metal rings R2 are mounted on respective mounting protrusions 330 of the retaining shafts 314*e* to 314*j*. More specifically, among the retaining shafts 314*a* to 314*j*, two of the retaining shafts 314*e* and 314*j* serve to retain both the metal rings R1 and R2 (i.e., the first column L1 and the second column L2).

Further, the blocking projections 332 provided on the retaining shafts 314*a* to 314*j* abut against side walls of the metal rings R1, R2. Top surfaces of the blocking projections 332 define an imaginary circle, the diameter of which is shorter than the diameters of the metal rings R1, R2, and therefore, the metal rings R1, R2 are pressed by the blocking projections 332 and slightly compressed in an inward diametrical direction thereof.

In the forgoing structure, on respective side wall surfaces of the retaining shafts 314*a* to 314*j*, a nickel film is formed, for example, by carrying out a nickel plating process thereon. Instead of forming a nickel film, the retaining shafts 314*a* to 314*j* may be constituted entirely from nickel.

The connecting plate 316 is substantially H-shaped in form, having long bar parts 316*a*, 316*b* that extend mutually in parallel, and a short bar part 317 that bridges roughly central portions of the long bar parts 316*a*, 316*b*. The connecting plate 316, which is shaped in this manner, is remarkably lighter in weight compared to a flat plate shaped connecting plate. More specifically, by forming the connecting plate 316 to be substantially H-shaped, the connecting plate 316, and consequently the conveyance rack 310, can be made even lighter in weight.

Ends of the long bar parts 316*a*, 316*b* are made to approach each other. As a result, roughly C-shaped portions are formed by roughly half of the long bar parts 316*a*, 316*b* and the short bar part 317. Stated otherwise, two substantially C-shaped openings are formed on the connecting plate 316.

Further, retaining shaft insertion recesses 34 are formed in a depressed fashion on the lower surface of the connecting plate 316, at positions corresponding to the retaining shaft insertion recesses 22 in the base 312, whereas on the upper surface thereof, connecting pin fixing holes 36 are formed at positions corresponding to the positions of the connecting pin insertion holes 26 on the base 312. Moreover, bolt insertion holes 38 are formed to penetrate from the upper end surface of the connecting plate 316 to the retaining shaft insertion recesses 34. Respective upper ends of the retaining shafts 314*a* to 314*j* are inserted into the retaining shaft insertion recesses 34, and are connected to the connecting plate 316 by bolts 40, which are inserted into the bolt insertion holes 38.

On the other hand, screw threads are engraved on inner walls of the connecting pin fixing holes 36. Connecting pins 42, the side walls of which are formed with threads, are screw-engaged in the connecting pin fixing holes 36. As described later, in the case that respective conveyance racks 310 are stacked on one another, the connecting pins 42 are inserted into the connecting pin insertion holes 26 of the base 312 of the upper conveyance rack 310.

The conveyance rack 310 according to the third embodiment is constructed basically as described above. Next, effects and advantages of the conveyance rack 310 shall be described in relation to a heat treatment method on the metal rings R1, R2, which are conveyed using the conveyance rack 310.

At first, before the connecting plate 316 is connected to the retaining shafts 314*a* to 314*j*, the metal rings R1, R2 are retained by the retaining shafts 314*a* to 314*j* as the first column L1 and the second column L2. Of course, the retaining shafts 314*a* to 314*j* are erected beforehand on the base 312 through the bolts 28, which are inserted respectively into the bolt insertion holes 24.

The metal rings R1, R2 are fabricated, for example, by cutting a cylindrical drum made from maraging steel into predetermined widths, and possess an elastic restorative force with respect to being pressed. More specifically, when such a pressing force is released, the metal rings R1, R2 return to their original shape due to an elastic action thereof.

Plural metal rings R1, which are constituted in this manner, are gripped from the outer circumferential side thereof by a non-illustrated gripping device. At this time, a gripping force (pressing force) is imposed on the metal rings R1 through the gripping device, whereby all of the metal rings R1 are deformed in an elliptical shape or a substantially hexagonal shape, for example. Stated otherwise, the metal rings R1 are gripped by the gripping device under a condition of being deformed in an elliptical shape or a substantially hexagonal shape or the like. Naturally, deformation thereof is carried out within a range in which the metal rings R1 remain elastic.

The plural metal rings R1, which have been deformed in an elliptical shape or the like, are transferred to a position between the retaining shafts 314*a* to 314*e*, 314*j*. The aforementioned gripping device is stopped in the heightwise direction of the retaining shafts 314*a* to 314*e*, 314*j*, at a position at which the metal rings R1 are arranged respectively between adjacent mounting protrusions 330.

Thereafter, all of the metal rings R1 are released simultaneously from the gripping force of the aforementioned gripping device, along with the metal rings R1 being restored to their original substantially true circular shape. At this time, lower end surfaces of the respective metal rings R1 are mounted on the mounting protrusions 330 positioned therebeneath. Simultaneously, side walls of the metal rings R1 come into abutment against the blocking projections 332.

In the foregoing manner, the diameter of an imaginary circle inscribed by the respective apexes of the blocking projections 332, which are formed on the retaining shafts 314*a* to 314*e*, 314*j* is small in comparison with the diameters of the metal rings R1. Therefore, the metal rings R1 are pressed by the blocking projections 332 and are compressed slightly in a diametrical inward direction.

As a result, as shown in FIG. 23, the plural metal rings R1 are retained simultaneously by the retaining shafts 314*a* to 314*e*, 314*j* as the first column L1.

Next, the gripping device simultaneously grips the plural metal rings R2, which are deformed in the elliptical shape or the like as mentioned above, and in this state, the metal rings R2 are transferred to a position between the retaining shafts 314*e* to 314*j*. Thereafter, similar to the above, after the gripping device is stopped at a position in which the metal rings R2 are arranged respectively between the adjacent mounting protrusions 330 of the retaining shafts 314*e* to 314*j*, all of the metal rings R2 are released simultaneously from the gripping force of the gripping device. Along with being released, all of the metal rings R2 are restored to their original substantially true circular shape.

Figure 27:
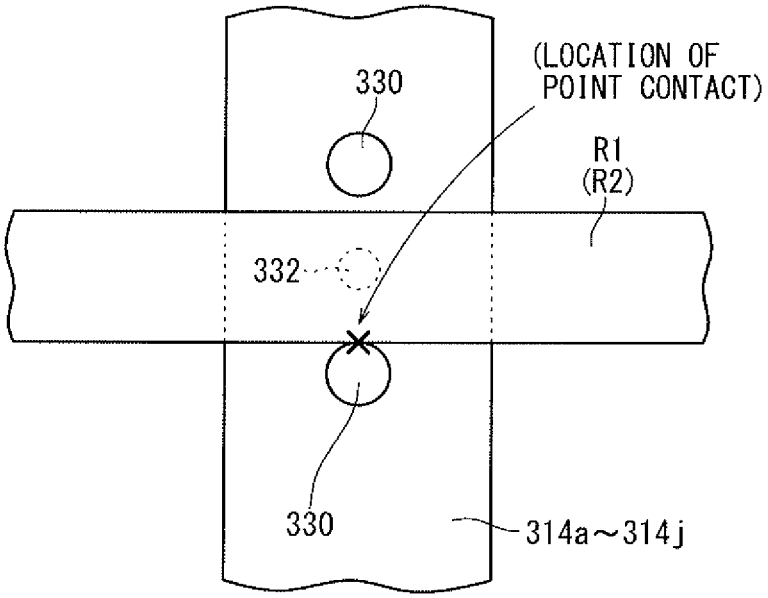
FIG. 27 is a front view of essential elements from the center of a metal ring, showing a condition in which a lower end surface of the metal ring is in point contact with a protrusion shown in FIG. 26.
Figure 28:
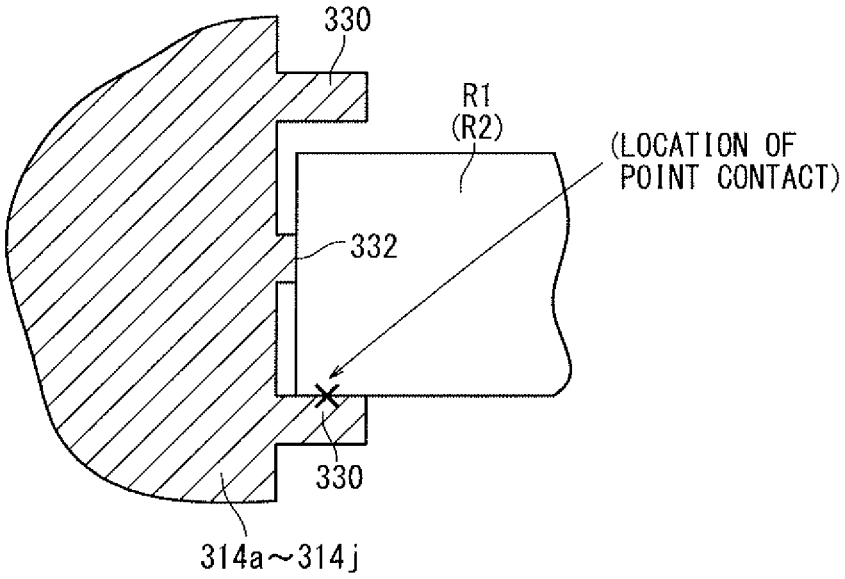
FIG. 28 is a side view of essential elements showing a condition in which a lower end surface of the metal ring is in point contact with a protrusion, shown along an axial direction of a mounting protrusion and a blocking protrusion.

Of course, at this time, as shown in FIG. 27, respective lower end surfaces of the metal rings R2 are mounted on the mounting protrusions 330 that are positioned therebeneath, and at the same time, as shown in FIG. 28, side walls of the metal rings R2 come into abutment against the blocking projections 332, and the metal rings R2 are pressed by the blocking projections 332 and are compressed slightly in a diametrical inward direction. As a result, the plural metal rings R2 are retained simultaneously by the retaining shafts 314*e* to 314*j* as the second column L2.

The metal rings R1, R2 are retained at different levels to avoid mutual interference therebetween.

In the foregoing manner, according to the third embodiment, the diameters of the mounting protrusions 330 are set to dimensions to enable point contact with respect to the metal rings R1, R2. Accordingly, as shown in FIG. 27, lower end surfaces of the metal rings R1 (R2) are in point contact at the location indicated by the symbol x, with respect to the curved side walls on the mounting protrusions 330. More specifically, the metal rings R1 (R2) and the mounting protrusions 330 are placed in a condition of point contact mutually with each other.

In the third embodiment, the blocking projections 332 press and retain the metal rings R1, R2 in a state of exhibiting an expansive force (see FIG. 28). Consequently, the mounting protrusions 330 do not serve a primary role to maintain the metal rings R1, R2, but rather, can serve an auxiliary role to prevent the metal rings R1, R2 from dropping out vertically downward. Therefore, the area of contact between the metal rings R1, R2 and the mounting protrusions 330 can be minimized to the greatest extent possible.

Figure 29:
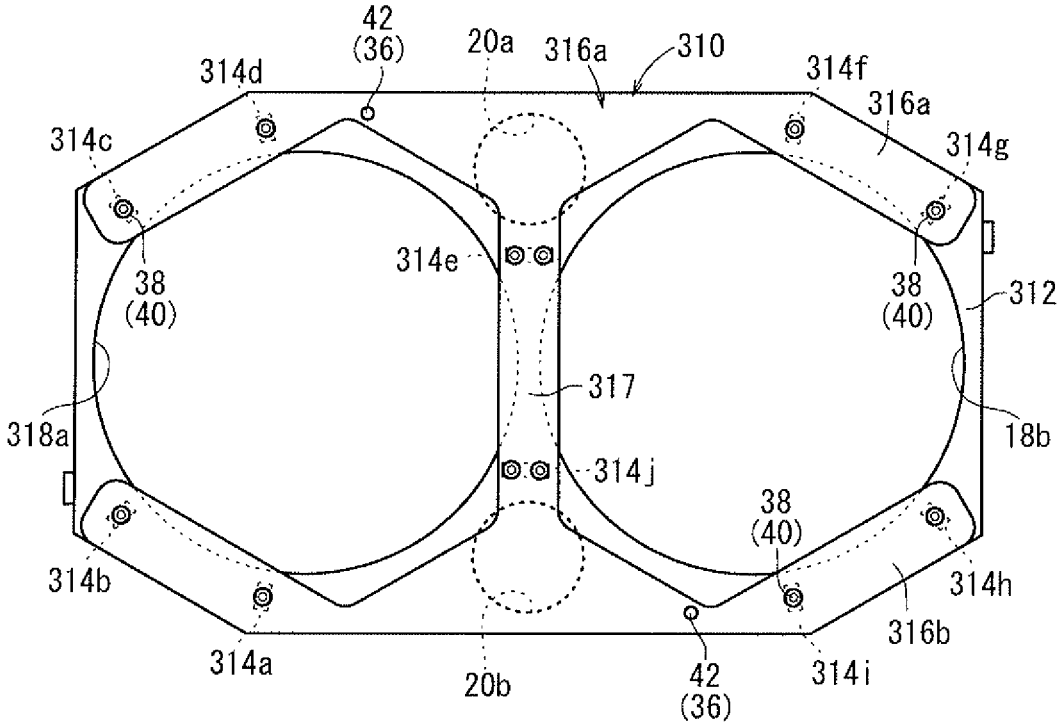
FIG. 29 is an upper plan view of the conveyance rack of FIG. 22.

Once the metal rings R1, R2 have been retained in the foregoing manner, respective upper ends of the retaining shafts 314*a* to 314*j* are inserted into the retaining shaft insertion recesses 34 formed on the lower surface of the connecting plate 316. Thereafter, as shown in FIG. 29, respective upper ends of the retaining shafts 314*a* to 314*j* are connected with respect to the connecting plate 316 through the bolts 40 inserted into the bolt insertion holes 38. (In FIG. 29, the metal rings R1, R2 have been omitted from illustration, in order to show the positional relationship between the base 312, the retaining shafts 314*a* to 314*j*, and the connecting plate 316.) Further, when needed, connecting pins 42 are threaded into screw-engagement with the connecting pin fixing holes 36.

In accordance with the above steps, the metal rings R1, R2 and the conveyance rack 310 are placed in the condition shown in FIG. 23. The connecting plate 316 interconnects the retaining shafts 314*a* to 314*j*, whereby the retaining shafts 314*a* to 314*j* are prevented from inclining, and falling out of the metal rings R1, R2 from the retaining shafts 314*a* to 314*j* due to inclination thereof also is prevented.

In this manner, in the case that the connecting plate 316 is connected after the metal rings R1, R2 have been retained by the retaining shafts 314*a* to 314*j*, a simple structure can be utilized as the aforementioned gripping device. The metal rings R1, R2 may also be retained by the retaining shafts 314*a* to 314*j* after the connecting plate 316 has been connected to respective upper ends of the retaining shafts 314*a* to 314*j* that have been erected on the base 312, although in this case, it is necessary to use a gripping device which is slightly more complex than the aforementioned gripping device, and for which control to transfer the metal rings R1, R2 must be performed somewhat more precisely. In this case, the metal rings R1, R2 may be inserted from between two adjacent shafts from among the retaining shafts 314*a* to 314*j*.

Alternatively, the metal rings R1, R2 may be gripped while being deformed in a substantially hexagonal shape, within a range in which the metal rings R1, R2 remain elastic, by a non-illustrated gripping device. In this case, after respective upper ends of the retaining shafts 314*a* to 314*j*, which are erected on the base 312, have been connected to the substantially H-shaped connecting plate 316, the gripping device is inserted from the substantially C-shaped openings in the connecting plate 316. In this state, along with the metal rings R1, R2 being released from the gripping device, the metal rings R1, R2, which have been restored under the elasticity thereof, are gripped between the retaining shafts 314*a* to 314*j*.

Figure 30:
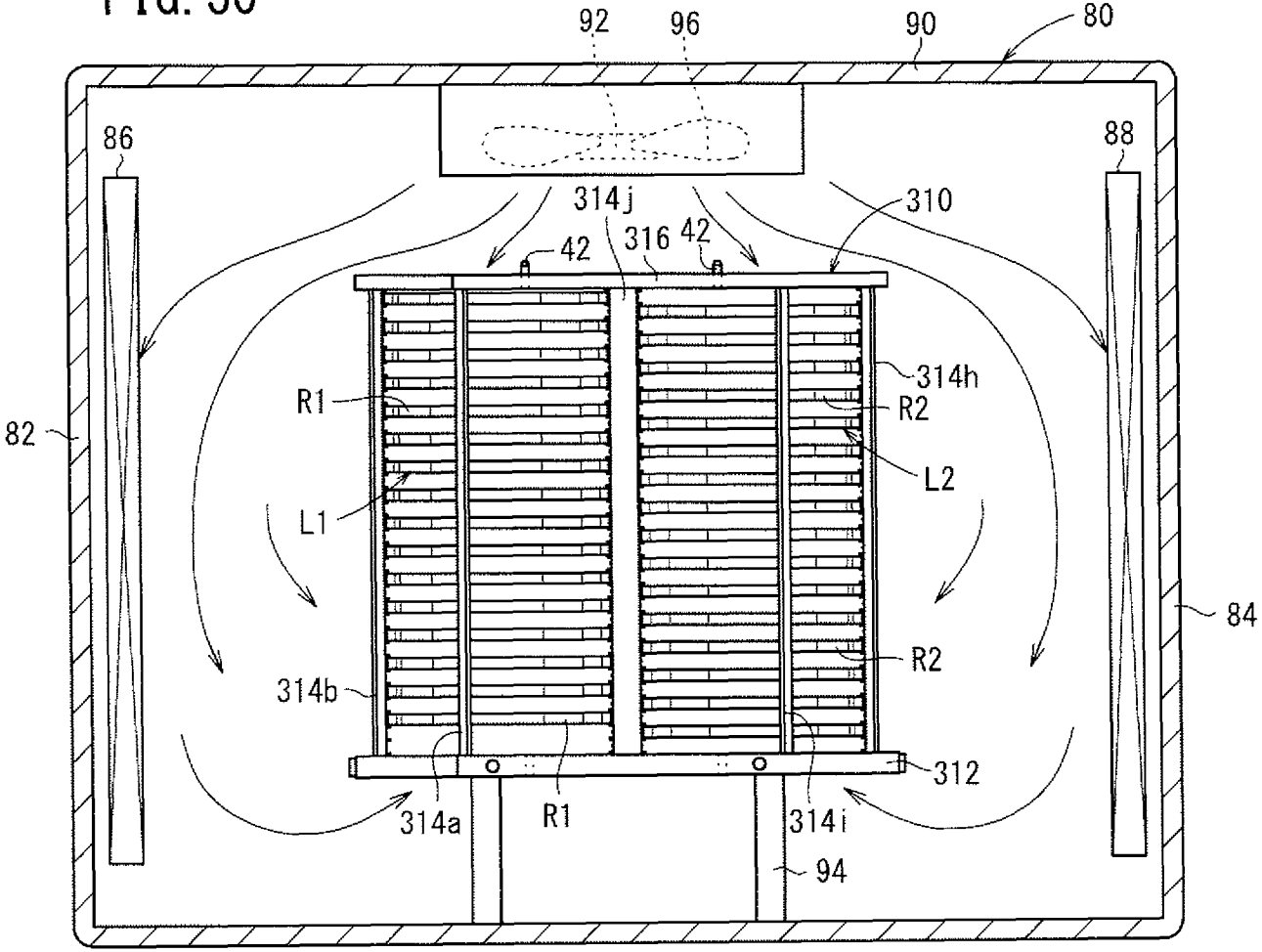
FIG. 30 is a vertical cross sectional front view showing a condition in which the conveyance rack is introduced into a heat treatment furnace.

Next, the metal rings R1, R2 are transported together with the conveyance rack 310 into the interior of the heat treatment furnace 80 shown in FIG. 30, under the action of a non-illustrated transfer. As noted above, large circular openings 18*a*, 18*b* and small circular openings 20*a*, 20*b* are formed to penetrate through the base 312 that constitutes the conveyance rack 310, whereas the connecting plate 316 is formed in a substantially H-shape. Accordingly, the conveyance rack 310 is lighter in weight compared to a conveyance rack comprising a base and a connecting plate that are shaped as flat plates.

Furthermore, because the two centrally located retaining shafts 314*e*, 314*j* retain both the first column L1 of the metal rings R1 and the second column L2 of the metal rings R2, an increase in the number of retaining shafts can be avoided. By adopting such a structure, the retaining shafts 314*a* to 314*j* contribute greatly to reducing the weight thereof and thus of the conveyance rack 310.

Owing thereto, the conveyance rack 310 can easily be transported. Further, less electrical power is required to transport the conveyance rack 310.

The heat treatment furnace 80 is formed with a longitudinal dimension along the direction in which the conveyance rack 310 is transported, and is constituted by providing heaters 86, 88 on the inside of side walls 82, 84, and a convection fan 92 on the ceiling wall 90. The conveyance rack 310, which is supported on the aforementioned transfer via a mounting jig 94, is conveyed into the heat treatment furnace 80 together with the mounting jig 94.

A nitriding treatment shall be described as an example of the heat treatment process. A nitriding gas, for example, such as ammonia or the like, is supplied to the interior of the heat treatment furnace 80 shown in FIG. 30. The nitriding gas is heated to a predetermined temperature, for example, 500° C., under the action of the heaters 86, 88, so as to enable nitriding of the metal rings R1, R2.

Along with the rise in temperature, the metal rings R1, R2 receive radiant heat, and thermal expansion is induced therein such that the metal rings R1, R2 approach the retaining shafts 314*a* to 314*j*.

As noted above, lower end surfaces of the metal rings R1, R2 are retained in a condition of point contact with respect to the mounting protrusions 330 (see FIG. 27). Thus, the restraining force of the mounting protrusions 330 with respect to the metal rings R1, R2 is small. Owing thereto, the metal rings R1, R2 can thermally expand without being obstructed by the mounting protrusions 330.

More specifically, in the third embodiment as well, suppression of thermal expansion of the metal rings R1, R2 can be avoided. Thus, concerns over the occurrence of strain on the metal rings R1, R2 can be dispensed with.

In addition, because the metal rings R1, R2 are in point contact with respect to the mounting protrusions 330, the area of mutual contact therebetween is small. Owing thereto, the amount of heat of the metal rings R1, R2 captured or usurped by the mounting protrusions 330 is small. More specifically, by ensuring that the state of contact between the metal rings R1, R2 and the mounting protrusions 330 is one of point contact, so that the area of mutual contact therebetween is small, transfer of heat from the metal rings R1, R2 into the mounting protrusions 330 can be suppressed.

Accordingly, the metal rings R1, R2 are easily raised in temperature. Stated otherwise, the temperature thereof can easily be raised to a degree at which nitriding progresses sufficiently.

The nitriding gas, which has risen in temperature, rises toward the ceiling wall 90 of the heat treatment furnace 80 (see FIG. 30). In the third embodiment also, the convection fan 92 is energized to rotate the agitating blades 96, whereby the nitriding gas inside the heat treatment furnace 80 is subjected to convection. Consequently, the nitriding gas descends along the side walls, and then rises again in the vicinity of the mounting jig 94 and thus in the vicinity of the conveyance rack 310.

In the foregoing manner, the lower end surfaces of the metal rings R1, R2 are in a state of point contact with respect to the mounting protrusions 330. More specifically, the area of contact between the metal rings R1, R2 and the mounting protrusions 330 is extremely small. Owing thereto, the nitriding gas can wrap around and enter sufficiently into the vicinity of the contact locations between the metal rings R1, R2 and the mounting protrusions 330.

Stated otherwise, according to the third embodiment, the nitriding gas comes into contact with substantially the entirety of the metal rings R1, R2. Further, heat transfer between the metal rings R1, R2 and the mounting protrusions 330 is suppressed to a minimum, and therefore the temperature of the metal rings R1, R2 is substantially uniform over the entirety thereof. In other words, the temperature at the contact points between the retaining shafts 314*a* to 314*j* and the metal rings R1, R2 is substantially the same as the temperature at other locations on the metal rings R1, R2.

For this reason, nitriding progresses substantially uniformly over the entirety of the metal rings R1, R2. More specifically, variations in the progression of nitriding are avoided, and therefore, the thickness of the nitriding layer, and thus variations in the degree of hardening of the metal rings R1, R2 can be avoided.

In this manner, according to the third embodiment, in which the mounting protrusions 330 disposed on the retaining shafts 314*a* to 314*j* and the metal rings R1, R2 are placed in a state of point contact, the temperature of the metal rings R1, R2 can be kept substantially the same over the entirety thereof, and the nitriding gas can come into contact with substantially the entirety of the metal rings R1, R2. Consequently, nitriding is substantially uniform over the entirety of the metal rings R1, R2, and thus the rings R1, R2 can be hardened substantially uniformly.

Further, because a nickel film is formed on side wall surfaces of the retaining shafts 314*a* to 314*j*, constituent elements of the retaining shafts 314*a* to 314*j* are prevented from diffusing into the metal rings R1, R2 during the nitriding process. More specifically, the nickel film functions as a barrier with respect to diffusion of constituent elements of the retaining shafts 314*a* to 314*j* into the metal rings R1, R2. Naturally, the same effects can be achieved if the retaining shafts 314*a* to 314*j* are constituted entirely from nickel.

In this manner, after the metal rings R1, R2 have been subjected to the nitriding process, the conveyance rack 310 is taken out of the heat treatment furnace 80. Thereafter, the nuts 48 are loosened, the connecting plate 316 is removed from the retaining shafts 314*a* to 314*j*, and the metal rings R1, R2 are exposed.

The exposed metal rings R1, R2 are gripped by the gripping device, are removed from the retaining shafts 314*a* to 314*j* while being deformed in a elliptical shape or the like, and are transported to a predetermined station or storage location. Of course, the metal rings R1, R2, upon being released from the gripping device, are restored to their substantially true circular shape under their own elastic action.

Henceforth, when another new batch of metal rings R1, R2 is retained, the conveyance rack 310 including the retaining shafts 314*a* to 314*j* fabricated in the foregoing manner is reused repeatedly.

Figure 31:
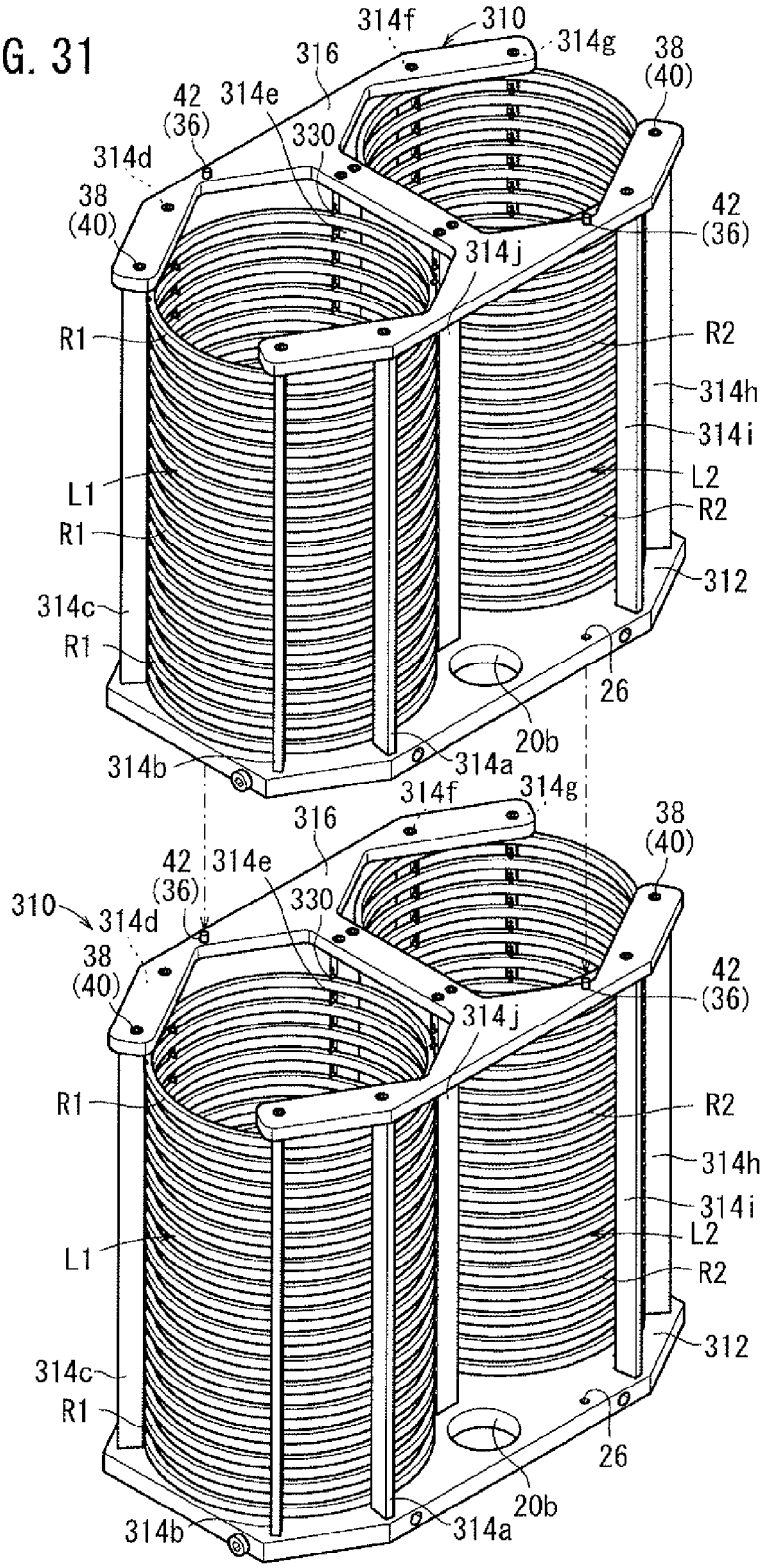
FIG. 31 is an exploded perspective view during stacking of conveyance racks.
Figure 32:
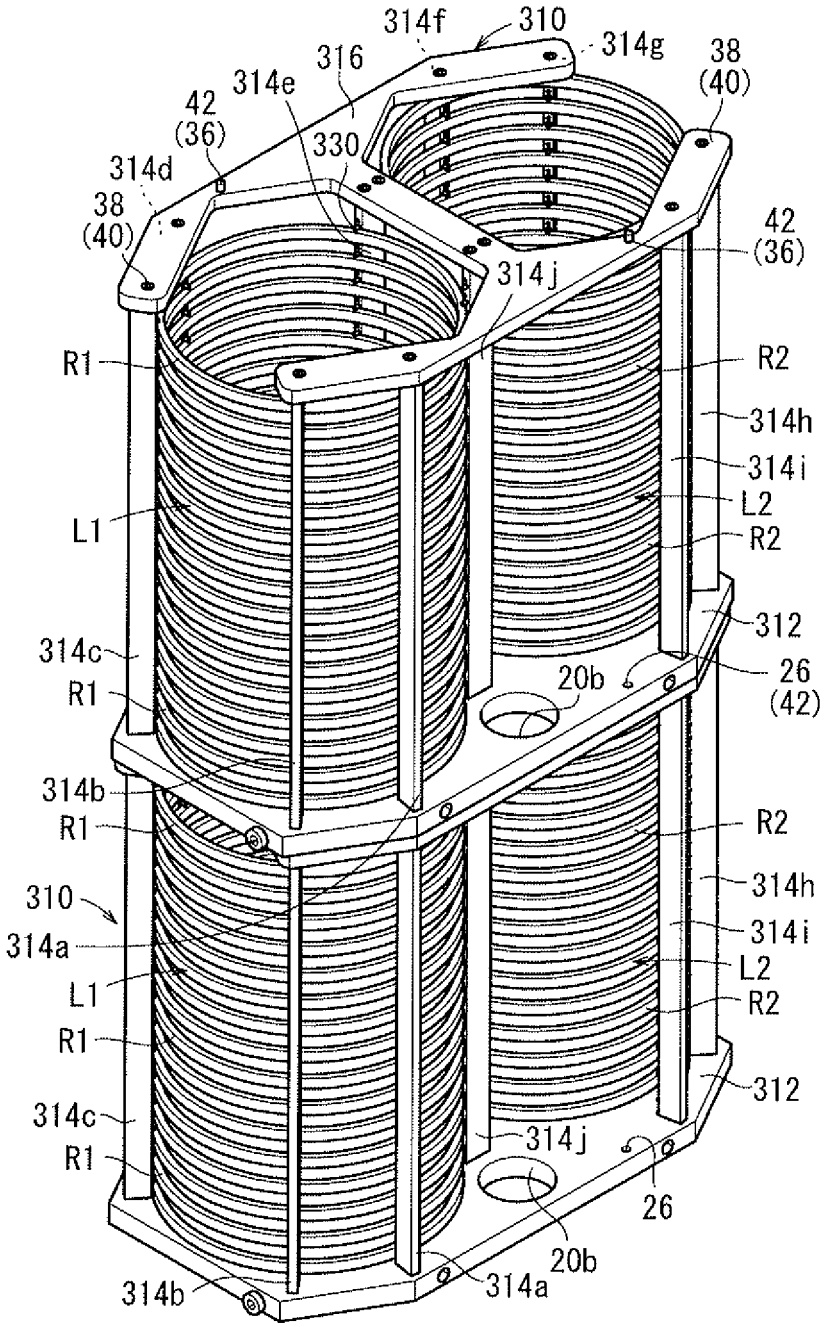
FIG. 32 is an overall outline perspective view showing a condition in which the conveyance racks from FIG. 31 are stacked.

In FIG. 30, a case is shown in which the conveyance rack 310 is transported into the heat treatment furnace 80 in a non-stacked state. However, if a large capacity heat treatment furnace is used, then as shown in FIGS. 31 and 32, respective conveyance racks 310, 310 may be stacked on each other through connecting pins 42, and transported into the interior of the heat treatment furnace in this state.

Similarly, it is a matter of course that the conveyance racks 310 may be stacked in three or more levels.

In the first through third embodiments, respective lower end parts of the retaining shafts 14*a* to 14*j*, 214*a* to 214*j*, 314*a* to 314*j* are inserted into the retaining shaft insertion recesses 22 that are formed on the base 12, 312, and together therewith, bolts 28, which pass through the bolt insertion holes 24, are threaded into bolt holes formed on the lower end parts of the retaining shafts 14*a* to 14*j*, 214*a* to 214*j*, 314*a* to 314*j*, whereby the retaining shafts 14*a* to 14*j*, 214*a* to 214*j*, 314*a* to 314*j* are erected on the base 12, 312 in a state of being positioned and fixed thereto (see FIGS. 5, 15 and 25). However, retaining shafts may also be erected in a displaceable manner with respect to the base 12, 312. Below, such a case shall be described as a fourth embodiment. In the following descriptions, constituent elements designated by the same reference characters as those in FIGS. 22 to 32 are illustrative of the same constituent elements, and therefore such features shall not be described in detail.

Figure 33:
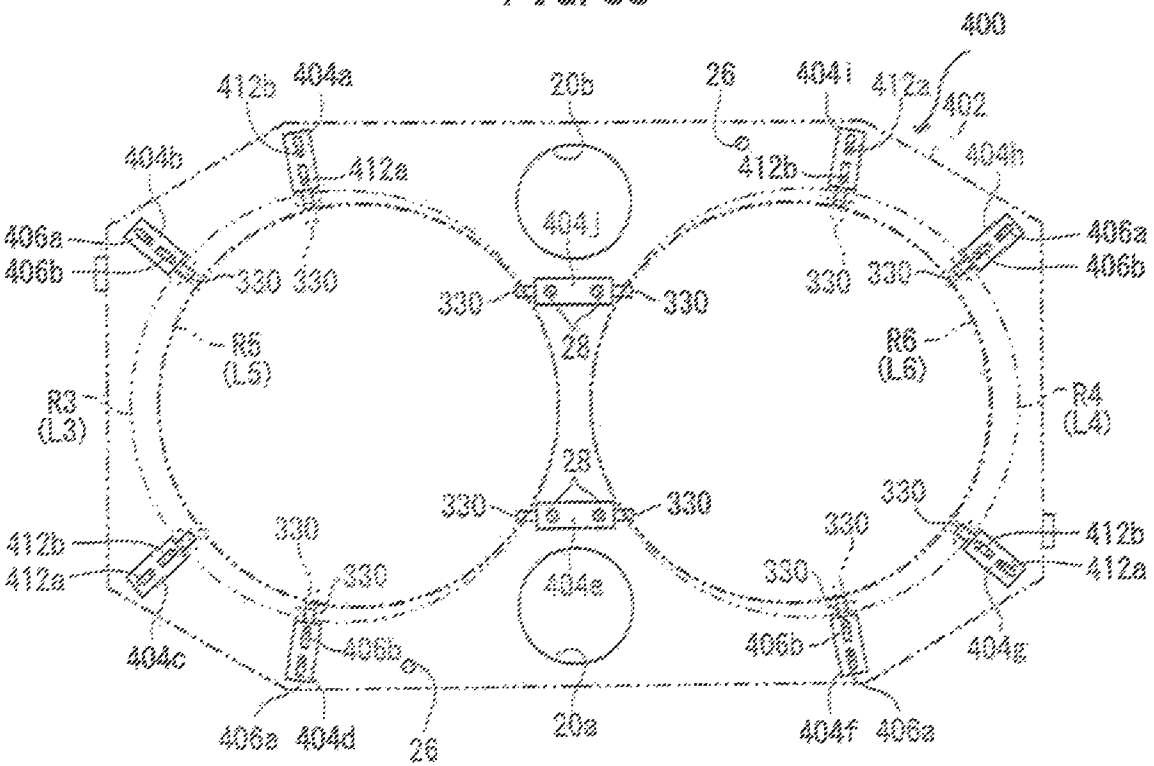
FIG. 33 is a planar sectional view of a conveyance rack according to a fourth embodiment, as seen from the side of a base constituting the conveyance rack.

FIG. 33 is a planar sectional view of a conveyance rack 400 according to a fourth embodiment, as seen from the side of a base 402 constituting the conveyance rack 400. In FIG. 33, in order to show clearly the positional relationship between the retaining shafts 404*a* to 404*j* and long hole shaped bolt insertion holes 406*a*, 406*b* extending through the base 402, the base 402 is illustrated by imaginary lines, and the long hole shaped bolt insertion holes 406*a*, 406*b* are shown by actual lines.

The conveyance rack 400 includes ten retaining shafts 404*a* to 404*j*, which are arranged similar to the retaining shafts 314*a* to 314*j* in the conveyance rack 310 according to the third embodiment. Six of the retaining shafts 404*a* to 404*e*, 404*j* serve to retain a first column L3 (plural metal rings R3), while six of the retaining shafts 404*e* to 404*j* serve to retain a second column L4 (plural metal rings R4).

Two of the retaining shafts 404*e*, 404*j* are constituted the same respectively as the retaining shafts 314*e*, 314*j* in the third embodiment, however, for facilitating description, different reference characters have been used therefor in the fourth embodiment.

The two retaining shafts 404*e*, 404*j*, which simultaneously support the first column L3 and the second column L4, are connected to the base 402 through bolts 28, in the same manner that the retaining shafts 314*e*, 314*j* in the third embodiment are connected to the base 312 through the bolts 28. More specifically, the retaining shafts 404*e*, 404*j* are fixed in position by being connected with respect to the base 402, by a structure which is the same as that shown in FIG. 25.

In contrast thereto, the remaining retaining shafts 404*a* to 404*d*, 404*f* to 404*i* are erected such that apexes of the respective mounting protrusions 330 are displaceable in directions to approach toward and separate away from the centers of the metal rings R3, R4.

Figure 34:
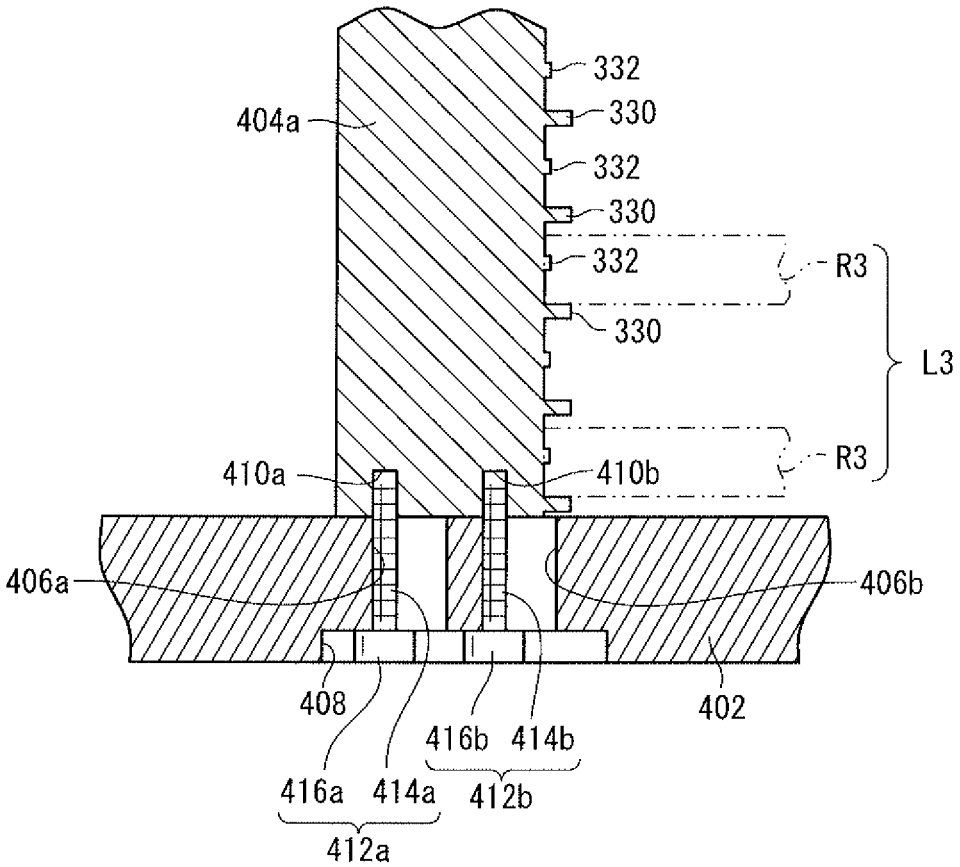
FIG. 34 is a vertical cross sectional view in the vicinity of one end of a retaining shaft constituting the conveyance rack of FIG. 33, when the retaining shaft is positioned at a rearward end.

In greater detail, as shown in FIG. 34, which is a vertical cross sectional view in the vicinity of one end of the retaining shaft 404*a*, at a location on which the retaining shaft 404*a* is erected on the base 402, two long hole shaped bolt insertion holes 406*a*, 406*b*, and a seating step portion 408, which is joined to and is somewhat wider than the long hole shaped bolt insertion holes 406*a*, 406*b*, are formed.

On the other hand, on the retaining shaft 404*a*, two bottomed bolt holes 410*a*, 410*b* are formed at positions overlapping respectively with the long hole shaped bolt insertion holes 406*a*, 406*b*.

The long hole shaped bolt insertion holes 406*a*, 406*b* are set to be narrow in width, so as to enable threaded parts 414*a*, 414*b* of the holding bolts 412*a*, 412*b* to be inserted therethrough, while being narrower compared to the head portions 416*a*, 416*b* of the holding bolts 412*a*, 412*b*. Accordingly, the threaded parts 414*a*, 414*b* of the holding bolts 412*a*, 412*b*, which have been inserted into the long hole shaped bolt insertion holes 406*a*, 406*b* from the side of the seating step portion 408, are threaded into the bolt holes 410*a*, 410*b*, and the head portions 416*a*, 416*b* thereof are seated on the seating step portion 408. By such seating, further upward advancement of the holding bolts 412*a*, 412*b* is suppressed.

From this state, by further tightening the holding bolts 412*a*, 412*b*, the base 402 is gripped in a fixed manner by the head portions 416*a*, 416*b* of the holding bolts 412*a*, 412*b* and the retaining shaft 404*a*. As a result, the retaining shaft 404*a* is positioned and fixed on the base 402.

The position shown in FIG. 34 corresponds to the position shown by the actual lines in FIG. 33. As can be understood from FIGS. 33 and 34, in this case, the retaining shaft 404*a* is at a position, which is separated maximally from the center of the metal rings R3. Stated otherwise, the retaining shaft 404*a* is positioned at a rearward end.

Of course, the retaining shafts 404*b* to 404*d*, 404*f* to 404*i* are arranged similarly, and are fixed and positioned on the base 402 in the same manner. Accordingly, as easily understood from FIG. 33, respective diameters of an inscribed circle formed by the retaining shafts 404*a* to 404*e*, 404*j* and an inscribed circle formed by the retaining shafts 404*e* to 404*j* are made maximum.

Accordingly, in this case, large diameter metal rings R3, R4 are capable of being retained.

In the case that metal rings R5, R6 are to be retained, which are smaller in diameter than the metal rings R3, R4, the procedure described below may be implemented.

First, the holding bolts 412*a*, 412*b* are loosened, and the head portions 416*a*, 416*b* of the holding bolts 412*a*, 412*b* are separated from the seating step portion 408. Owing thereto, the holding bolts 412*a*, 412*b* are released from the base 402, and therefore the retaining shafts 404*a* to 404*d*, 404*f* to 404*i* are made displaceable.

Figure 35:
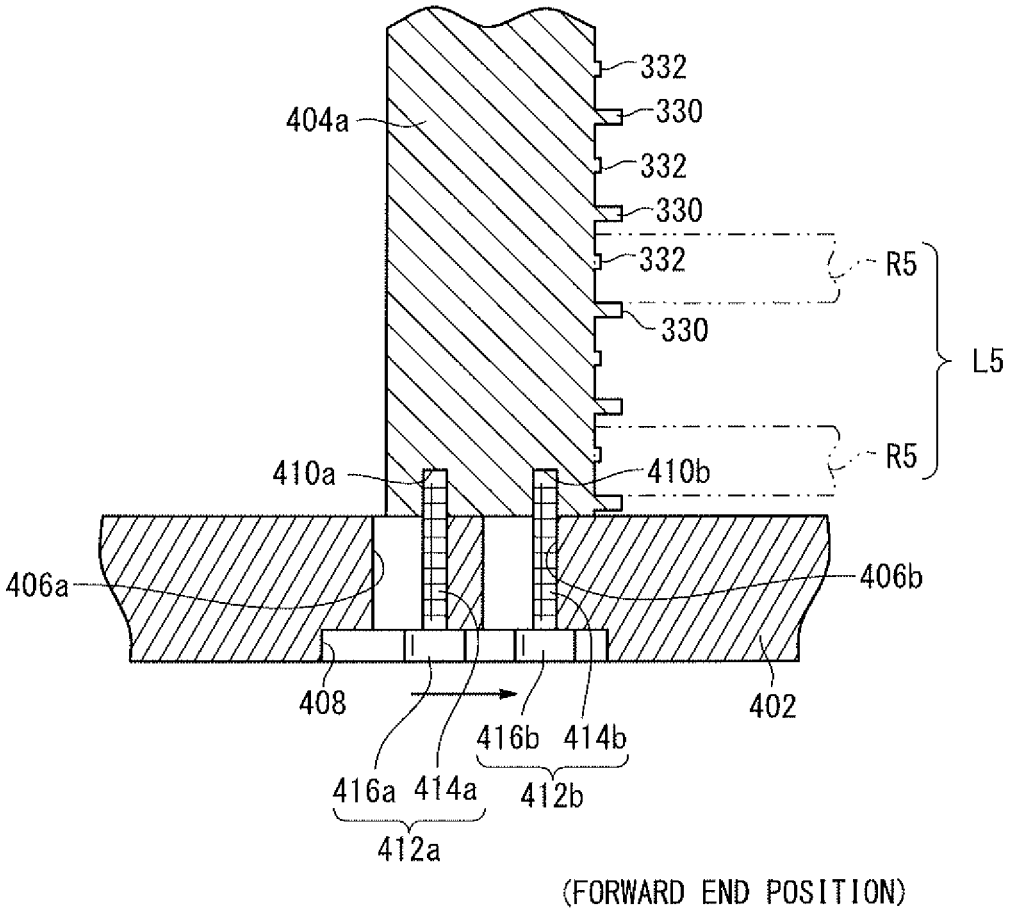
FIG. 35 is a vertical cross sectional view in the vicinity of one end of the retaining shaft of FIG. 34, when the retaining shaft is displaced toward a forward end.

Then, as shown in FIG. 35, the retaining shafts 404*a* to 404*d*, 404*f* to 404*i* are displaced in (forward end) directions to mutually approach one another. As a result, as shown by the imaginary lines in FIG. 33, the respective diameters of the inscribed circle defined by the retaining shafts 404*a* to 404*e*, 404*j*, and the inscribed circle defined by the retaining shafts 404*e* to 404*j* are made smaller. More specifically, the retaining shafts 404*a* to 404*d*, 404*f* to 404*i* are displaced in directions such that the diameters of the aforementioned inscribed circles become reduced.

Thereafter, the holding bolts 412*a*, 412*b* are retightened at the positions shown in FIG. 35, i.e., at the terminal end portion (forward end) of the long hole shaped bolt insertion holes 406*a*, 406*b*, and the head portions 416*a*, 416*b* of the holding bolts 412*a*, 412*b* are seated in the seating step portion 408, whereby the base 402 is gripped by the head portions 416*a*, 416*b* and the retaining shafts 404*a* to 404*j*. As a result, the retaining shafts 404*a* to 404*d*, 404*f* to 404*i* are fixed in position at the forward end.

Thereafter, similar to the explanation of the third embodiment, the first column L5 is retained by the retaining shafts 404*a* to 404*e*, 404*j*, whereas the second column L6 is retained by the retaining shafts 404*e* to 404*j*.

In this manner, in accordance with the fourth embodiment, in which the retaining shafts 404*a* to 404*d*, 404*f* to 404*i* are erected displaceably on the base 402, metal rings of various diameters, such as the metal rings R3, R4 and the metal rings R5, R6, can be retained.

Preferably, the longitudinal dimension of the long hole shaped bolt insertion holes 406*a*, 406*b* may be set corresponding to the diameter of the metal rings R3 (R4) and the diameter of the metal rings R5 (R6).

More specifically, as noted above, the longitudinal dimension of the long hole shaped bolt insertion holes 406*a*, 406*b* is suitably set, such that the retaining shafts 404*a* to 404*d*, 404*f* to 404*i* are capable of retaining the metal rings R3, R4 at the rearward end position (refer to the actual lines in FIG. 33), and also are capable of retaining the metal rings R5, R6 at the forward end position (refer to the imaginary lines in FIG. 33). In this case, the retaining shafts 404*a* to 404*d*, 404*f* to 404*i* can be displaced to appropriate positions corresponding to the diameter of the metal rings R3 (R4), and the diameter of the metal rings R5 (R6), without carrying out measurements of the displacement positions of the retaining shafts 404*a* to 404*d*, 404*f* to 404*i* for each case.

The retaining shafts 404*a* to 404*d*, 404*f* to 404*i* may be positioned and fixed at an intermediate position between the forward end position and the rearward end position, so as to be capable of retaining metal rings having diameters smaller than the diameters of the metal rings R3, R4, and greater than the diameters of the metal rings R5, R6.

Incidentally, when a heating treatment is carried out in the heat treatment furnace 80 (see FIG. 30), the conveyance rack 400 is heated to a high temperature. Due to such heating, while the conveyance rack 400 is subjected to thermal expansion, at this time, there is a tendency for the region in the vicinity of the retaining shafts 404*e*, 404*j* to expand more greatly in comparison with the region in the vicinity of the retaining shafts 404*a* to 404*d*, 404*f* to 404*i*. The reason for this tendency is conjectured to be that, since the retaining shafts 404*a* to 404*d*, 404*f* to 404*i* serve to retain only one of the first column L3 and the second column L4, whereas in contrast thereto, the retaining shafts 404*e*, 404*j* serve to retain both the first column L3 and the second column L4, as a result, in the retaining shafts 404*e*, 404*j*, the amount of heat transferred thereto from the metal rings R3, R4 is greater than the amount of heat transferred to the other retaining shafts 404*a* to 404*d*, 404*f* to 404*i*.

As a result, the base 402 and the connecting plate 316, which grip the retaining shafts 404*a* to 404*i* therebetween, are bent to mutually approach each other as they become located further toward side end portions that are distanced from the retaining shafts 404*e*, 404*j*. Due to such bending of the base 402 and the connecting plate 316, the retaining shafts 404*a* to 404*d*, 404*f* to 404*i* are gripped more forcefully by the base 402 and the connecting plate 316.

As shown in FIG. 33, after a heat treatment has been carried out with respect to the metal rings R3, R4, for example, in the case that a heat treatment is to be carried out with respect to metal rings R5, R6 of smaller diameters than the metal rings R3, R4, the retaining shafts 404*a* to 404*d*, 404*f* to 404*i* must be displaced in directions to approach one another. However, as noted above, because the retaining shafts 404*a* to 404*d*, 404*f* to 404*i* are gripped (restrained) by the base 402 and the connecting plate 316, which have become bent in directions toward one another, such displacement of the retaining shafts 404*a* to 404*d*, 404*f* to 404*i* cannot easily be performed.

In this case, for example, it may be considered to loosen all of the bolts 40 (see FIG. 22) that connect the retaining shafts 404*a* to 404*j* to the connecting plate 316, thereby releasing all of the retaining shafts 404*a* to 404*j* from being gripped between the base 402 and the connecting plate 316. Therefore, it becomes easy for the retaining shafts 404*a* to 404*d*, 404*f* to 404*i* to be displaced, and after completion of such displacement, the bolts 40 may be retightened.

However, in this case, because all of the bolts 40 are loosened and then retightened, a long time is required after releasing of the metal rings R3, R4 and until the heat treatment can be commenced on the metal rings R5, R6. Stated otherwise, working efficiency is deteriorated. Further, it is also necessary to establish positional agreement between the bolt insertion holes 38 of the connecting plate 316 (see FIG. 22) and the bolt holes formed on end surfaces of the retaining shafts 404*a* to 404*j*, and thus time is lost in relation to carrying out this operation as well.

Figure 36:
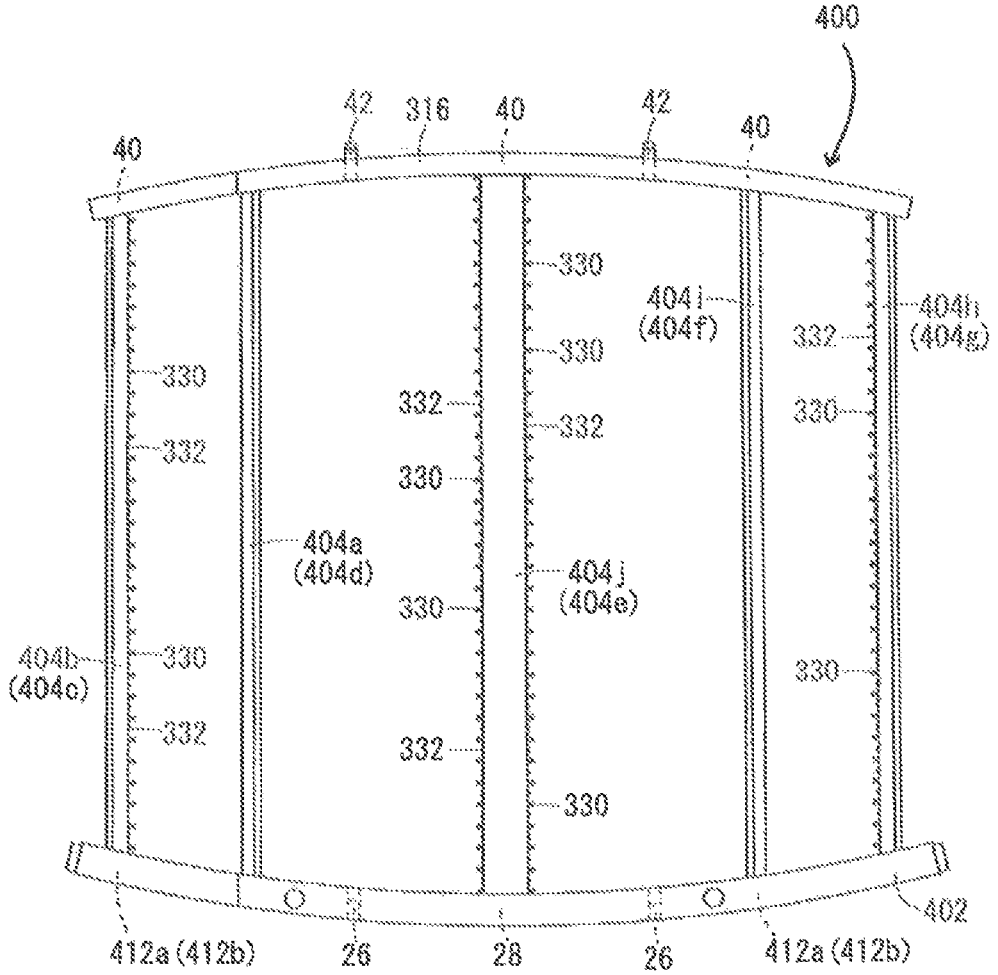
FIG. 36 is a front view showing a condition, in the conveyance rack according to the fourth embodiment, in which the axial dimension of retaining shafts that retain both of two columns of metal rings is greater compared with the dimension of retaining shafts that retain only one column from among the two columns of metal rings.

Consequently, as illustrated in the front view shown in FIG. 36, the heightwise dimension (axial dimension) of the retaining shafts 404*a* to 404*d*, 404*f* to 404*i* preferably is smaller than that of the retaining shafts 404*e*, 404*j*. The heightwise dimension thereof may also grow smaller as the retaining shafts 404*a* to 404*d*, 404*f* to 404*i* are distanced further from the retaining shafts 404*e*, 404*j*. To facilitate understanding, in FIG. 36, illustration of the metal rings R3, R4 has been omitted, and the difference in the height dimension has been exaggerated.

In this case, while the base 402 and the connecting plate 316 remain connected to all of the retaining shafts 404*a* to 404*j*, the base 402 and the connecting plate 316 are bent in directions to mutually approach one another (see FIG. 36). In such a condition, even if a heat treatment is carried out with respect to the metal rings R3, R4, which are retained by the retaining shafts 404*a* to 404*j*, the base 402 and the connecting plate 316 are not bent significantly more than described above.

Figure 37:
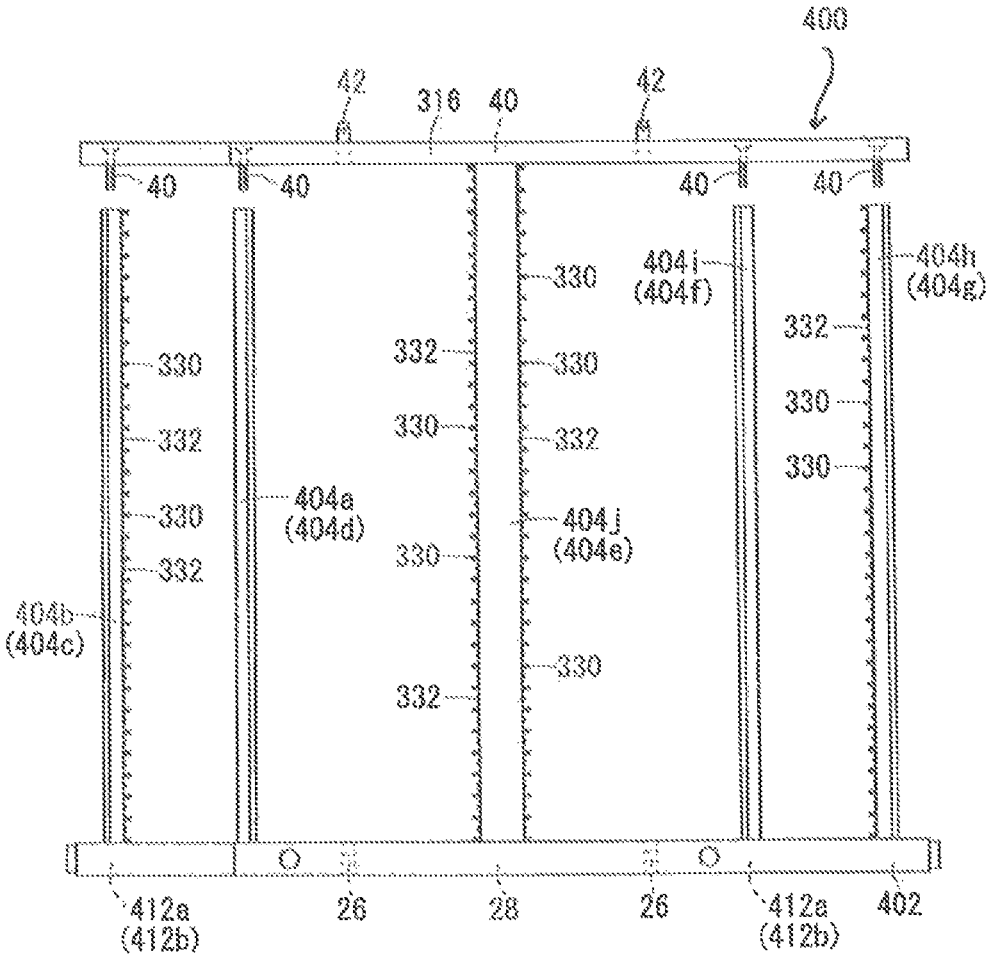
FIG. 37 is a front view showing a condition, from the state shown in FIG. 36, in which the base and the connecting plate are released from restraint with respect to retaining shafts that retain only one column from among two columns of metal rings.

In addition, after the metal rings R3, R4 on which the heat treatment has been performed are removed from the retaining shafts 404*a* to 404*j*, in the event they are replaced and a heat treatment is carried out with respect to the metal rings R5, R6 of a smaller diameter, then as shown in FIG. 37, the holding bolts 412*a*, 412*b* (see FIGS. 34 and 35), which join the retaining shafts 404*a* to 404*d*, 404*f* to 404*i* to the base 402, are loosened, and together therewith, each of the bolts 40 that join the retaining shafts 404*a* to 404*d*, 404*f* to 404*i* to the connecting plate 316 are loosened as well. At this time, the base 402 and the connecting plate 316 are returned under their own elasticity to shapes that extend in a planar direction.

More specifically, the base 402 and the connecting plate 316 are bent backward in directions that separate the retaining shafts 404*a* to 404*d*, 404*f* to 404*i* from each other. As a result, the retaining shafts 404*a* to 404*d*, 404*f* to 404*i* are released from restraint by the base 402 and the connecting plate 316, and therefore, the retaining shafts 404*a* to 404*d*, 404*f* to 404*i* can easily be displaced.

In FIG. 37, although a state is shown in which the bolts 40 are removed from the retaining shafts 404*a* to 404*d*, 404*f* to 404*i*, it is sufficient merely to loosen the bolts 40 to a degree that releases the retaining shafts 404*a* to 404*d*, 404*f* to 404*i* from being restrained by the base 402 and the connecting plate 316, and it is not particularly required for the bolts 40 to be removed.

After the retaining shafts 404*a* to 404*d*, 404*f* to 404*i* have been displaced, the holding bolts 412*a*, 412*b* (see FIGS. 34 and 35) and the bolts 40 are retightened. Thus, the base 402 and the connecting plate 316 act to restrain the retaining shafts 404*a* to 404*d*, 404*f* to 404*i* again.

On the other hand, the bolts 28 (see FIGS. 25 and 33) and the bolts 40 (see FIG. 22) are not loosened in the retaining shafts 404*e*, 404*j*. There is no need for retightening the bolts 28, 40 with respect to the retaining shafts 404*e*, 404*j*, and as a result, working time for such loosening and retightening can be shortened because constraint of the base and the connecting plate 316 with respect to the retaining shafts 404*e*, 404*j* is not released.

Additionally, in this case, agreement between the positioning of the bolt insertion holes 38 (see FIG. 22) of the connecting plate 316, and the positioning of the bolt holes that are formed in end surfaces of the retaining shafts 404*a* to 404*d*, 404*f* to 404*i* is kept as is. As noted above, because the retaining shafts 404*e*, 404*j* are retained in a state of being connected to the base 402 and the connecting plate 316, the occurrence of shifting in position of the bolt insertion holes 38 and the aforementioned bolt holes can be avoided. Accordingly, working time needed for such positioning of the bolt insertion holes 38 and the aforementioned bolt holes can be shortened.

In this manner, by setting the heightwise dimension of the retaining shafts 404*e*, 404*j*, which serve to retain both of the two columns of metal rings R3, R4 (R5, R6), so as to be greater compared to the retaining shafts 404*a* to 404*d*, 404*f* to 404*i* that retain either the metal rings R3 (R5) or the metal rings R4 (R6), the retaining shafts 404*a* to 404*d*, 404*f* to 404*i* can easily be displaced, and together therewith, the time required from releasing the metal rings R3, R4 until the metal rings R5, R6 are retained can be shortened. Consequently, working efficiency of the metal rings R5, R6 can be enhanced.

Figure 38:
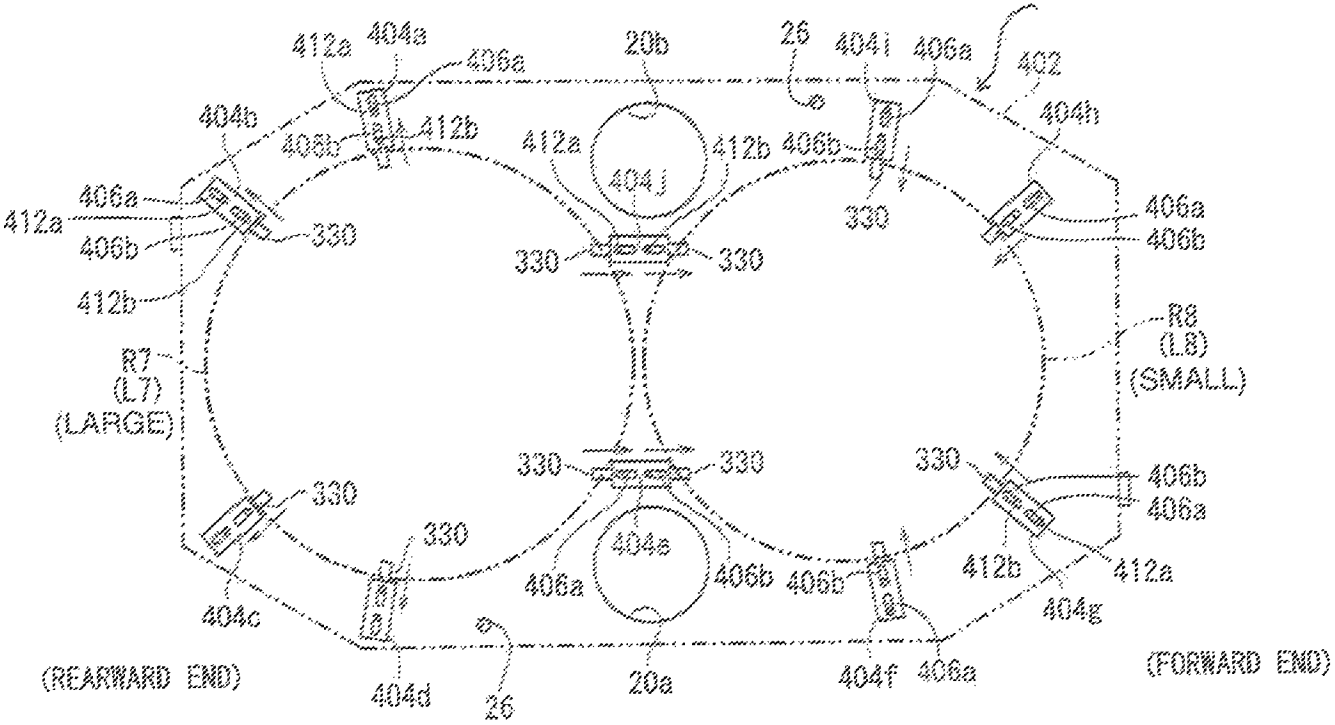
FIG. 38 is a planar sectional view of a conveyance rack according to a modified example of the fourth embodiment in which all of the retaining shafts are displaceable, as seen from the side of a base constituting the conveyance rack.
Figure 39:
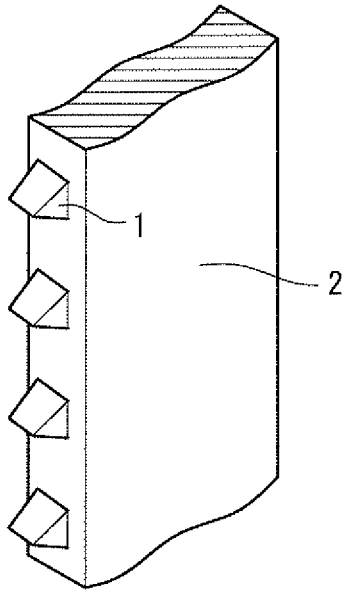
(PRIOR ART) FIG. 39
FIG. 39 is an outline perspective view of essential elements of a retaining shaft constituting a conveyance rack according to a conventional technique.
Figure 40:
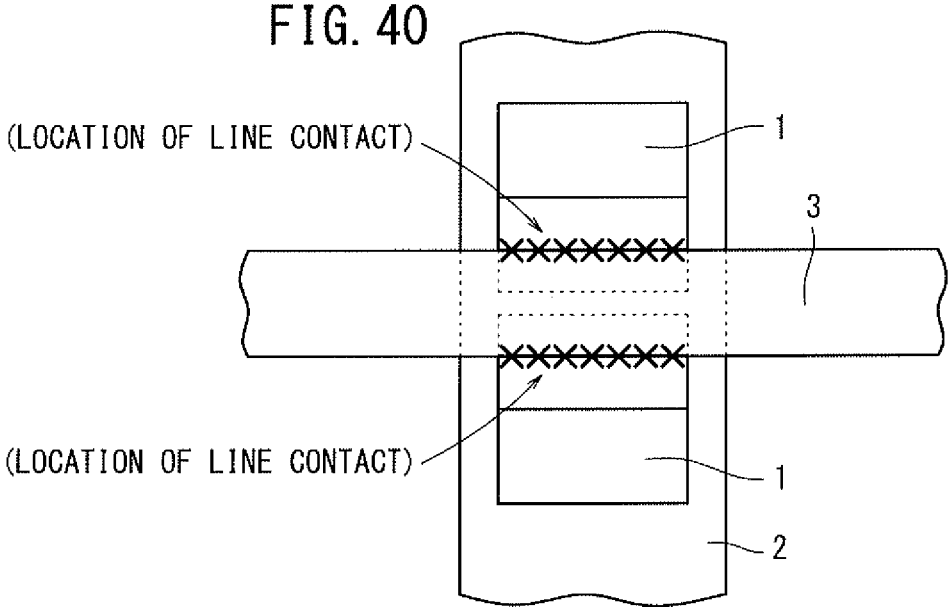
(PRIOR ART) FIG. 40
FIG. 40 is a front view of essential elements from the center of a metal ring, showing a condition in which the metal ring is gripped between protrusions shown in FIG. 39.
Figure 41:
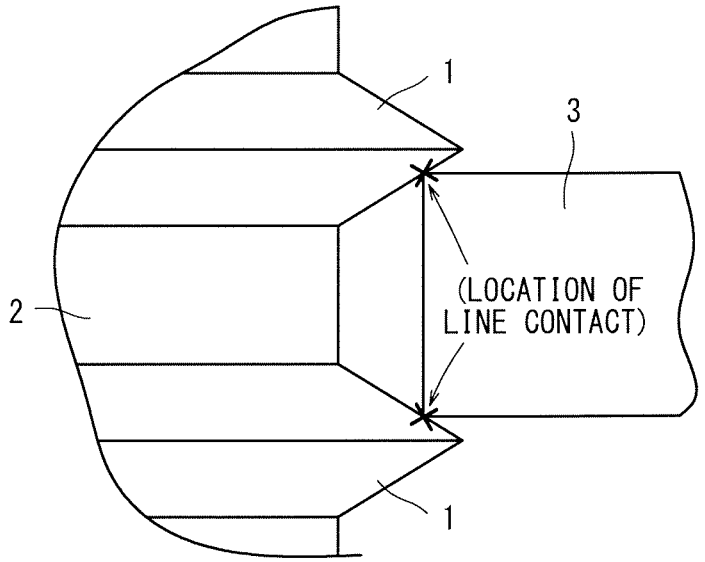
FIG. 41 (PRIOR ART)
FIG. 41 is a side view of essential elements showing a condition in which the metal ring is gripped between the protrusions shown in FIG. 39, shown along an axial direction of the protrusions.

Furthermore, as shown in FIG. 38, the retaining shafts 404*e*, 404*j* may also be erected displaceably with respect to the base 402. In this case, which is a modified example of the fourth embodiment, at the locations at which the retaining shafts 404*e*, 404*j* are erected on the base 402, there may also be formed the long hole shaped bolt insertion holes 406*a*, 406*b* and the seating step portion 408, as mentioned above (see FIGS. 34 and 35).

In addition, threaded parts 414*a*, 414*b* of the holding bolts 412*a*, 412*b* are screw-engaged with the bolt holes 410*a*, 410*b* formed on lower ends of the retaining shafts 404*e*, 404*j*, and the base 402 may be gripped between the head portions 416*a*, 416*b* that are seated on the seating step portion 408 and the retaining shafts 404*e*, 404*j*. As a result, the retaining shafts 404*e*, 404*j* are fixed in position.

Upon displacement of the retaining shafts 404*e*, 404*j*, in the same manner as mentioned above, the base 402 is released by loosening the holding bolts 412*a*, 412*b*.

In FIG. 38, a condition is exemplified in which the retaining shafts 404*a* to 404*d* are located at a rearward position, whereas the retaining shafts 404*g* to 404*i* are located at a forward position, while in addition, the retaining shafts 404*e*, 404*j* are displaced in direction to approach with respect to the retaining shafts 404*g* to 404*i*. In this case, as shown by the imaginary lines in FIG. 33, the diameter of the inscribed circle defined by the retaining shafts 404*a* to 404*e*, 404*j* is greater than the diameter of the inscribed circle defined by the retaining shafts 404*e* to 404*j*.

As understood from this fact, in this case, the diameter of the metal rings R7 (first column L7) retained by the retaining shafts 404*a* to 404*e*, 404*j*, and the diameter of the metal rings R8 (second column L8) retained by the retaining shafts 404*e* to 404*j* can be selected to differ mutually from each other.

In this case as well, it is a matter of course that the retaining shafts 404*a* to 404*j* may be fixed in position between the forward end position and the rearward end position.

Naturally, in the fourth embodiment as well, a condition is maintained by the blocking projections 332 in which the metal rings R3 to R8 are pressed in a state exhibiting an expansive force. Accordingly, in the fourth embodiment, in the same manner as the third embodiment, an effect is obtained in that, during heat treatment thereof, generation of strains on the metal rings R3 to R8 can be prevented.

In the third and fourth embodiments, the metal rings R1 to R8 may be gripped by respective adjacent mounting protrusions 330, 330. In this case, due to point contact between the metal rings R1 to R8 and the mounting protrusions 330, 330, the heat transfer amount from the metal rings R1 to R8 to the mounting protrusions 330, 330 can be suppressed to a minimum.

In any of the first through fourth embodiments, a conveyance rack may be constituted only by the base 12, 312, 402 and the retaining shafts 14*a* to 14*j*, 214*a* to 214*j*, 314*a* to 314*j*, 404*a* to 404*j*, without using connecting plate 16, 316.

Further, in the first through fourth embodiments, two types of metal rings among the metal rings R1 to R8 are retained by ten retaining shafts 14*a* to 14*j*, 214*a* to 214*j*, 314*a* to 314*j*, 404*a* to 404*j* as two columns made up of the first column L1 and the second column L2. However, in the case of retaining two columns in this manner, it is sufficient if there are at least four retaining shafts.

Furthermore, an example has been described above in which metal rings R1 to R8 that make up a CVT belt are exemplified as workpieces, which are subjected to a nitriding process. However, the workpieces and the heat treatment carried out thereon are not particularly limited. For example, in the case that ring members requiring a carburizing process are taken as workpieces, a carburizing gas may be supplied instead of the aforementioned nitriding gas.

In addition, the retaining shafts 14*a* to 14*j*, 214*a* to 214*j*, 314*a* to 314*j*, 404*a* to 404*j* may be formed from hollow bodies. In this case, the conveyance rack 10, 210, 310, 400 can be made even lighter in weight.

The invention claimed is:

1. A conveyance rack for retaining and conveying a plurality of metal rings that exhibit an elastic restorative force, comprising:

a base;

a plurality of retaining shafts erected on the base and which extend parallel to each other, the retaining shafts being provided on side surfaces thereof with a plurality of protrusions, which abut on lower end surfaces of the metal rings, wherein the retaining shafts comprise columnar members, which are shaped as polygons in horizontal cross section, one of the side surfaces of each columnar member facing toward the metal rings, and wherein the protrusions are provided only on the side surfaces that face toward the metal rings, wherein at least part of the plurality of retaining shafts is erected on the base so as to be capable of being displaced in a direction to enlarge or in a direction to reduce the diameter of an inscribed circle defined by the retaining shafts; and the plurality of retaining shafts are arranged to be capable of retaining the metal rings in two or more vertically arranged columns, the columns being parallel to each other; and further comprising a connecting plate, which is disposed at a position separated from the base and to which ends of the plurality of retaining shafts are connected, wherein ones of the retaining shafts, which retain both of the two or more vertically arranged columns of the metal rings, are fixed in position, whereas ones of the retaining shafts, which retain only one of the columns of the metal rings, are displaceable, and an axial dimension of the retaining shafts that are fixed in position is set greater than an axial dimension of the displaceable retaining shafts.

2. The conveyance rack according to claim 1, wherein the protrusions comprise triangular columnar shaped bodies including inclined surfaces, which are inclined vertically downward approaching the metal rings and which abut against lower end surfaces of the metal rings; and apex portions of the protrusions face toward directions away from centers of the metal rings.

3. The conveyance rack according to claim 1, wherein the protrusions are formed as cylindrical shaped bodies, diameters thereof being set at a dimension to make point contact with respect to the metal rings.

4. The conveyance rack according to claim 1, further comprising blocking projections, which are formed to project on the retaining shafts and are interposed between each of respective adjacent protrusions, and which press the metal rings in a radial inward direction thereof by abutment against side walls of the metal rings.

5. The conveyance rack according to claim 1, wherein regions of the protrusions in contact with the metal rings comprise tapered reduced diameter portions, which are reduced in diameter in tapered shapes approaching toward the metal rings.

6. The conveyance rack according to claim 1, wherein the protrusions abut in point contact with respect to lower end surfaces of the metal rings.

7. The conveyance rack according to claim 1, further comprising wherein the connecting plate comprises a substantially H-shaped body having two long bar portions that extend mutually in parallel and one short bar portion connecting the long bar portions, ends of the two long bar portions mutually approaching toward one another to form substantially C-shaped portions.

8. The conveyance rack according to claim 1, wherein the retaining shafts are made from nickel or nickel-base alloy, or alternatively, wherein a nickel or nickel-base alloy film is formed on surfaces of the retaining shafts.

* * * * *